US009745767B2

(12) United States Patent
Renaud et al.

(10) Patent No.: US 9,745,767 B2
(45) Date of Patent: Aug. 29, 2017

(54) SWIMMING POOL PRESSURE CLEANER INCLUDING AUTOMATIC TIMING MECHANISM

(71) Applicant: Hayward Industries, Inc., Elizabeth, NJ (US)

(72) Inventors: Benoit Joseph Renaud, Fort Atkinson, WI (US); David John Hardy, Clemmons, NC (US); Jason Wayne Parcell, Winston-Salem, NC (US); Scott Teuscher, Advance, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 0 days.

(21) Appl. No.: 14/487,846

(22) Filed: Sep. 16, 2014

(65) Prior Publication Data

US 2015/0259940 A1 Sep. 17, 2015

Related U.S. Application Data

(63) Continuation-in-part of application No. 14/207,110, filed on Mar. 12, 2014.

(Continued)

(51) Int. Cl.
*E04H 4/16* (2006.01)

(52) U.S. Cl.
CPC ..... *E04H 4/1672* (2013.01); *E04H 4/1663* (2013.01)

(58) Field of Classification Search
CPC ..... E04H 4/1663; E04H 4/1672

(Continued)

(56) References Cited

U.S. PATENT DOCUMENTS 1,095,281 A 5/1914 Kenney et al.
1,163,818 A 12/1915 Hadden et al.

(Continued)

FOREIGN PATENT DOCUMENTS

CA 590252 A 1/1960
DE 694971 C 8/1940

(Continued)

OTHER PUBLICATIONS

International Search Report of the International Searching Authority mailed Sep. 12, 2014, issued in connection with International Patent Application No. PCT/US14/24952 (5 pages).

(Continued)

*Primary Examiner* — Fred Prince
(74) *Attorney, Agent, or Firm* — McCarter & English, LLP

(57) ABSTRACT

A fluid distribution system for an underwater pool cleaner comprises an inlet body having an inlet for receiving a supply of pressurized fluid, a valve assembly body in fluid communication with the inlet of the inlet body and including a plurality of fluid outlets, a first one of the outlets provides fluid for propelling the underwater pool cleaner in a forward direction and a second one of the outlets provides fluid for propelling the underwater pool cleaner in a reverse direction, and a valve subassembly including a cam wheel that is fluidicly driven by the supply of pressurized fluid and periodically switches the supply of pressurized fluid from the first one of the outlets to the second one of the outlets to periodically change direction of propulsion of the underwater pool cleaner.

24 Claims, 70 Drawing Sheets

Related U.S. Application Data

(60) Provisional application No. 61/788,873, filed on Mar. 15, 2013.

(58) Field of Classification Search
USPC ... 210/167.15, 167.16, 167.17, 416.1, 416.2; 15/1.7
See application file for complete search history.

(56) References Cited

U.S. PATENT DOCUMENTS

| | | | |
|---|---|---|---|
| 2,039,741 | A | 5/1936 | Richards |
| 2,290,626 | A | 7/1942 | Bosomworth |
| 2,393,091 | A | 1/1946 | De Lacy-Mulhall |
| 3,291,145 | A | 12/1966 | Arneson |
| 3,319,654 | A | 5/1967 | Faldi |
| 3,372,708 | A | 3/1968 | Hotchkin |
| 3,384,914 | A | 5/1968 | Wilhelman |
| 3,392,738 | A | 7/1968 | Pansini |
| 3,494,376 | A | 2/1970 | Doeringsfeld et al. |
| 3,561,326 | A | 2/1971 | Cassaday |
| 3,667,502 | A | 6/1972 | Otto |
| 3,675,261 | A | 7/1972 | Burgess et al. |
| 3,805,815 | A | 4/1974 | Goodin |
| 3,921,654 | A | 11/1975 | Pansini |
| 3,931,740 | A | 1/1976 | Carter |
| 4,022,239 | A | 5/1977 | Schwindt et al. |
| 4,040,864 | A | 8/1977 | Steeves |
| 4,086,933 | A | 5/1978 | Pansini |
| 4,089,074 | A | 5/1978 | Sermons |
| 4,129,904 | A | 12/1978 | Pansini |
| 4,140,634 | A | 2/1979 | Harry |
| 4,154,680 | A | 5/1979 | Sommer |
| 4,281,995 | A | 8/1981 | Pansini |
| 4,385,639 | A | 5/1983 | Holborow |
| 4,429,429 | A | 2/1984 | Altschul |
| 4,463,525 | A | 8/1984 | Sheber |
| 4,522,221 | A | 6/1985 | Chivens et al. |
| 4,558,479 | A | 12/1985 | Greskovics et al. |
| 4,558,719 | A | 12/1985 | Rinkewich |
| 4,569,361 | A | 2/1986 | Frentzel |
| 4,575,423 | A | 3/1986 | Alanis et al. |
| 4,589,986 | A | 5/1986 | Greskovics et al. |
| 4,592,378 | A | 6/1986 | Frentzel |
| 4,604,757 | A | 8/1986 | Yokomatsu |
| 4,618,420 | A | 10/1986 | Alanis |
| 4,652,366 | A | 3/1987 | Brooks |
| 4,686,728 | A | 8/1987 | Rawlins |
| 4,739,789 | A | 4/1988 | Hamilton |
| 4,746,424 | A | 5/1988 | Drew |
| 4,749,478 | A | 6/1988 | Brooks |
| 4,768,532 | A | 9/1988 | Johnson |
| 4,776,299 | A | 10/1988 | Hill |
| 4,776,954 | A | 10/1988 | Brooks |
| 4,778,599 | A | 10/1988 | Brooks |
| 4,784,171 | A | 11/1988 | Campbell |
| 4,835,809 | A | 6/1989 | Roumagnac |
| 4,837,886 | A | 6/1989 | Rawlins |
| 4,838,485 | A | 6/1989 | Rinkewich |
| 4,839,063 | A | 6/1989 | Brooks |
| 4,849,024 | A | 7/1989 | Supra |
| 4,856,913 | A | 8/1989 | Campbell |
| 4,889,622 | A | 12/1989 | Newcombe-Bond |
| 4,994,178 | A | 2/1991 | Brooks |
| 5,029,600 | A | 7/1991 | McCullagh |
| 5,077,853 | A | 1/1992 | Campbell |
| 5,128,031 | A | 7/1992 | Midkiff |
| 5,133,854 | A | 7/1992 | Horvath |
| 5,143,605 | A | 9/1992 | Masciarelli |
| 5,222,873 | A | 6/1993 | Whitehead et al. |
| RE34,301 | E | 7/1993 | Brooks |
| 5,264,122 | A | 11/1993 | Lakotish |
| 5,278,749 | A | 1/1994 | De Man |
| 5,279,728 | A | 1/1994 | Weiss |
| 5,350,508 | A | 9/1994 | Van der Watt |
| 5,381,823 | A | 1/1995 | DiBartolo |
| 5,422,001 | A | 6/1995 | Yagoda et al. |
| 5,435,031 | A | 7/1995 | Minami et al. |
| 5,452,747 | A | 9/1995 | De Man |
| 5,454,940 | A | 10/1995 | Lakotish |
| 5,542,451 | A | 8/1996 | Foster |
| 5,682,846 | A | 11/1997 | Scharnweber |
| 5,705,058 | A | 1/1998 | Fischer |
| 5,779,894 | A | 7/1998 | Martensson |
| 5,788,850 | A | 8/1998 | Tuomey |
| 5,911,878 | A | 6/1999 | Benvenuto et al. |
| 5,933,899 | A * | 8/1999 | Campbell ..... E04H 4/1654 15/1.7 |
| 5,985,156 | A | 11/1999 | Henkin et al. |
| 6,039,886 | A | 3/2000 | Henkin et al. |
| 6,063,270 | A | 5/2000 | d'Offay |
| 6,074,553 | A | 6/2000 | Haski |
| 6,090,219 | A | 7/2000 | Henkin et al. |
| 6,193,885 | B1 | 2/2001 | Campbell |
| 6,280,611 | B1 | 8/2001 | Henkin et al. |
| 6,365,039 | B1 | 4/2002 | Henkin et al. |
| 6,387,250 | B1 | 5/2002 | Henkin et al. |
| 6,412,133 | B1 | 7/2002 | Erlich et al. |
| 6,473,928 | B1 | 11/2002 | Veloskey et al. |
| 6,581,624 | B1 | 6/2003 | Magami et al. |
| 6,601,255 | B1 | 8/2003 | van der Meyden et al. |
| 6,652,742 | B2 | 11/2003 | Henkin et al. |
| 6,685,843 | B2 | 2/2004 | Leaverton |
| RE38,479 | E | 3/2004 | Henkin et al. |
| 6,802,963 | B2 | 10/2004 | Campbell |
| 7,318,448 | B2 | 1/2008 | Fleischer et al. |
| 7,501,056 | B2 | 3/2009 | Henkin et al. |
| 7,677,268 | B2 | 3/2010 | Griffin et al. |
| 8,266,752 | B2 | 9/2012 | Henkin et al. |
| 9,394,711 | B2 | 7/2016 | Henkin et al. |
| 2003/0116203 | A1 | 6/2003 | Fleischer |
| 2004/0089593 | A1 | 5/2004 | Campbell |
| 2005/0279682 | A1 | 12/2005 | Davidson et al. |
| 2007/0094817 | A1 | 5/2007 | Stoltz et al. |
| 2008/0202997 | A1 | 8/2008 | Davidson et al. |
| 2009/0089944 | A1 | 4/2009 | Griffin et al. |
| 2014/0215730 | A1 | 8/2014 | Henkin et al. |
| 2014/0259466 | A1 | 9/2014 | Renaud et al. |

FOREIGN PATENT DOCUMENTS

| | | | |
|---|---|---|---|
| DE | 732034 | C | 2/1943 |
| EP | 0835357 | A1 | 4/1998 |
| EP | 0912261 | A1 | 5/1999 |
| JP | 54009457 | | 1/1979 |
| JP | 54015365 | | 5/1979 |
| JP | 54056251 | | 5/1979 |
| WO | 97/01689 | A1 | 1/1997 |
| WO | 97/49504 | A1 | 12/1997 |
| WO | 99/33582 | A1 | 7/1999 |
| WO | 99/34077 | A1 | 7/1999 |
| WO | 2005/001221 | A2 | 1/2005 |
| WO | 2006/014746 | A1 | 2/2006 |

OTHER PUBLICATIONS

Written Opinion of the International Searching Authority mailed Sep. 12, 2014, issued in connection with International Application No. PCT/US14/24952 (7 pages).

Office Action mailed Jan. 27, 2016, issued in connection with U.S. Appl. No. 14/207,110 (12 pages).

Office Action mailed Oct. 3, 2016, issued in connection with U.S. Appl. No. 14/207,110 (5 pages).

* cited by examiner

SWIMMING POOL PRESSURE CLEANER INCLUDING AUTOMATIC TIMING MECHANISM

CROSS-REFERENCE TO RELATED APPLICATIONS

This application claims the benefit of U.S. Provisional Application No. 61/788,873 filed Mar. 15, 2013, and U.S. patent application Ser. No. 14/207,110 filed Mar. 12, 2014, both of which are incorporated herein by reference in their entirety.

BACKGROUND OF THE INVENTION

Field of the Invention

The present invention relates to a swimming pool pressure cleaner, and, more specifically to a swimming pool pressure cleaner that is capable of switching between bottom and top cleaning modes, as well as automatically switching into a reverse mode.

Related Art

Swimming pools generally require a certain amount of maintenance. Beyond the treatment and filtration of pool water, the walls of the pool should be scrubbed regularly. Further, leaves and various debris can float on the surface of the pool water, and should be removed regularly. This means that a pool cleaner should be capable of cleaning both the walls of the pool as well as the surface of the pool water.

Swimming pool cleaners adapted to rise proximate a water surface of a pool for removing floating debris therefrom and to descend proximate to a wall surface of the pool for removing debris therefrom are generally known in the art. These "top-bottom" cleaners are often pressure-type or positive pressure pool cleaners that require a source of pressurized water to be in communication therewith. This source of pressurized water could include a booster pump or pool filtration system. Generally, this requires a hose running from the pump or system to the cleaner head. In some instances, a user may have to manually switch the pool cleaner from a pool wall cleaning mode to a pool water surface cleaning mode.

Additionally, swimming pool cleaners can utilize jet nozzles that discharge pressurized water to generate a vacuum or suction effect. This suction effect can be utilized to dislodge debris that is on a pool wall and to pull the debris and water through a filtering arrangement or filter bag. The jet nozzles can be placed inside a vacuum tube such that the debris and pool water are directed through the tube. The jet nozzles can be grouped and/or arranged to discharge the pressurized water stream in general alignment with the flow of water through the vacuum tube, e.g., parallel flow. However, this alignment of flow can result in areas of concentrated water flow, e.g., "hot areas," and areas with significantly reduced flow.

Accordingly, there is a need for improvements in pool cleaners that are capable of cleaning both the pool water surface and the pool walls, and jet nozzles that create more uniform distribution of water flow through a vacuum tube.

SUMMARY OF THE INVENTION

The present disclosure relates to a swimming pool pressure cleaner that is capable of switching between bottom and top cleaning modes, as well as automatically switching into a reverse mode. The cleaner includes a top housing having a retention mechanism attached thereto, a chassis, and a plurality of wheels rotationally connected to the chassis. The chassis houses a drive assembly that is connected with a water distribution manifold. The drive assembly includes a timer assembly, a reverse/spinout mode valve assembly, and a top/bottom mode valve assembly. The water distribution manifold includes a reverse/spinout mode manifold chamber, a top mode manifold chamber, and a bottom mode manifold chamber. An external pump provides pressurized water to the cleaner, which is provided to the timer assembly and to the reverse/spinout mode valve assembly. The timer assembly includes a turbine that is rotated by the pressurized water, and drives a gear reduction stack that drives a Geneva gear. The Geneva gear rotates a valve disk positioned within the reverse/spinout mode valve assembly. The valve disk includes a window that allows the provided pressurized fluid to flow there through to either a reverse drive chamber or a forward drive chamber of a reverse/spinout mode valve body. When the window is adjacent the reverse drive chamber, the pressurized fluid flows into the reverse drive chamber and to the reverse/spin-out mode manifold chamber, which in turn directs the pressurized fluid to a reverse/spinout jet nozzle. The reverse/spinout jet nozzle propels the cleaner rearward or offsets the general path of the cleaner. When the window is adjacent the forward drive chamber, the pressurized fluid flows into the forward drive chamber and to the top/bottom mode valve assembly. The top/bottom mode valve assembly includes a top/bottom mode valve body and a top/bottom mode valve disk that has a window. The top/bottom mode valve disk window directs the pressurized fluid into either a top mode chamber or a bottom mode chamber of the top/bottom mode valve body. When the window is adjacent the top mode chamber, the pressurized fluid flows into the top mode chamber and to the top mode manifold chamber, which in turn directs the pressurized fluid to at least one skimmer jet nozzle and a thrust/lift jet nozzle. The thrust/lift jet nozzle discharges the pressurized fluid to propel the cleaner generally toward a pool water surface and along the pool surface, while the at least one skimmer jet nozzle discharges the pressurized fluid into the debris retention mechanism. When the window is adjacent the bottom mode chamber, the pressurized fluid flows into the bottom mode chamber and to the bottom mode manifold chamber, which in turn directs the pressurized fluid to a forward thrust jet nozzle, and a suction jet ring. The forward thrust jet nozzle discharges the pressurized fluid to propel the cleaner along a pool wall surface. The suction jet ring is positioned adjacent a suction head provided on the bottom of the cleaner and a suction tube that extends from the suction jet ring toward the top housing. The suction jet ring directs the pressurized fluid to at least one vacuum jet nozzle that discharges the pressurized fluid through the suction tube and into the debris retention mechanism.

The present disclosure further relates to a fluid distribution system for controlling the operation of a device for cleaning a swimming pool. The distribution system includes an inlet body having an inlet for receiving a supply of pressurized fluid, a valve assembly body including first and second inlet openings and first and second outlet openings and defining a first valve chamber extending between the first inlet opening and the first outlet opening, and a second valve chamber extending between the second inlet opening and the second outlet opening, and a valve subassembly. The valve subassembly includes a turbine rotatably driven by a supply of pressurized fluid, a cam plate including a cam track and which is operatively engaged with the turbine such that the cam plate is rotationally driven by the turbine, the cam track having a first section and a second section, and a valve seal including a sealing member and a cam post, wherein the valve seal is rotatably mounted adjacent the cam plate and the valve assembly body with the cam post engaged with the cam track. The valve seal is rotatable between a first position where the sealing member is adjacent the first inlet opening and a second position where the sealing member is adjacent the second inlet opening. The valve assembly body is adjacent the inlet body such that the inlet is in fluidic communication with the first and second valve chambers. When the cam post is engaged with the first section of the cam track the valve seal is placed in the first position where the valve seal prevents fluid from flowing through the second inlet opening and across the second valve chamber. When the cam post is engaged with the second section of the cam track the valve seal is placed in the second position where the valve seal prevents fluid from flowing through the first inlet opening and across the first valve chamber.

The present disclosure further relates to a fluid distribution system for controlling the operation of a device for cleaning a swimming pool. The distribution system includes an inlet body having an inlet for receiving a supply of pressurized fluid, a valve assembly body including first and second inlet openings and first and second outlet openings and defining a first valve chamber extending between the first inlet opening and the first outlet opening, and a second valve chamber extending between the second inlet opening and the second outlet opening, a timer assembly, and a valve subassembly. The timer assembly and valve subassembly includes a turbine rotatably driven by a supply of pressurized fluid, a cam wheel including first and second cam tracks and which is operatively engaged with the turbine such that the cam wheel is rotationally driven by the turbine, and a rocker seal including first and second sealing member and a cam post, wherein the rocker seal is pivotally mounted adjacent the cam wheel and the valve assembly body with the cam post engageable with the first and second cam tracks. The rocker seal is pivotal between a first position where the first sealing member seals the first inlet opening and a second position where the second sealing member seals the second inlet opening. The valve assembly body is adjacent the inlet body such that the inlet is in fluidic communication with the first and second valve chambers. When the cam post is engaged with the first cam track the rocker seal is placed in the first position where the first sealing member prevents fluid from flowing through the second inlet opening and across the second valve chamber. When the cam post is engaged with the second cam track the rocker seal is placed in the second position where the second sealing member prevents fluid from flowing through the first inlet opening and across the first valve chamber.

The fluid distribution system could be incorporated into a swimming pool cleaner.

BRIEF DESCRIPTION OF THE DRAWINGS

The foregoing features of the invention will be apparent from the following Detailed Description of the Invention, taken in connection with the accompanying drawings, in which.

DETAILED DESCRIPTION OF THE INVENTION

The present invention relates to a positive pressure top/bottom pool cleaner, as discussed in detail below in connection with FIGS. 1-87.

Figure 1:
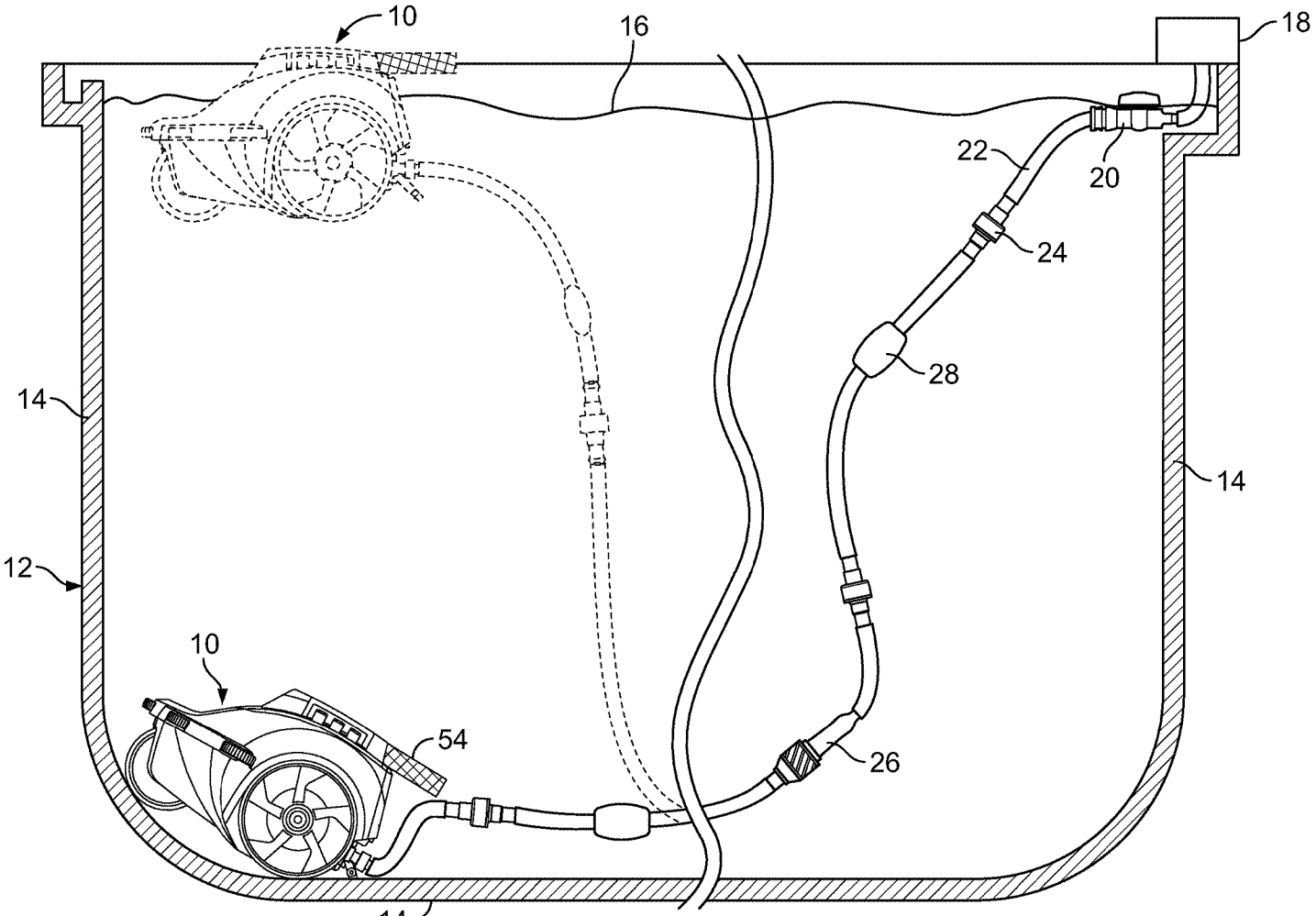
FIG. 1 is a schematic representation of a positive pressure pool cleaner of the present disclosure in a pool.
Figure 2:
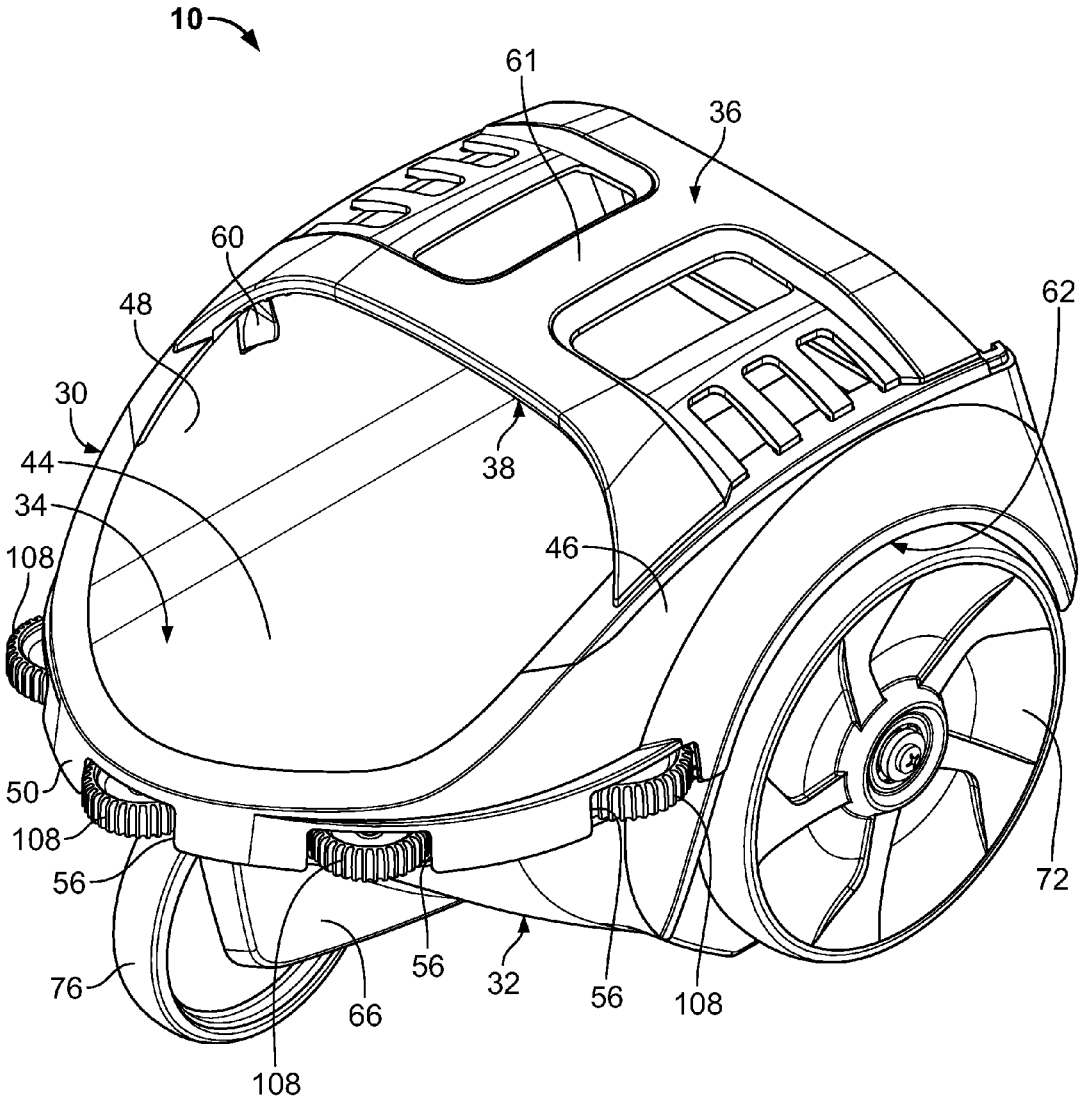
FIG. 2 is a first perspective view of the pool cleaner of the present disclosure.
Figure 3:
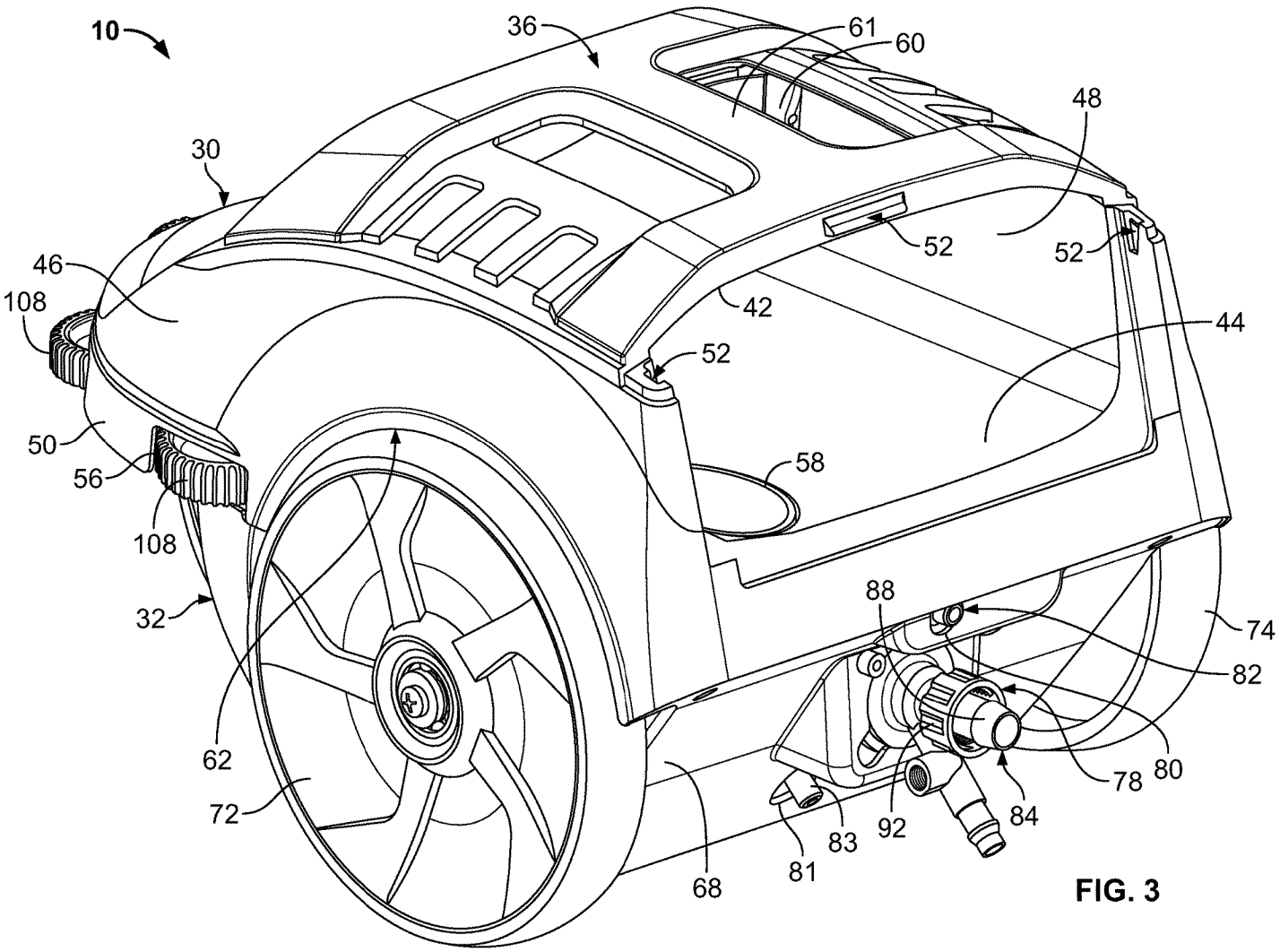
FIG. 3 is a second perspective view of the pool cleaner of the present disclosure.

Referring initially to FIG. 1, a positive pressure pool cleaner 10 of the present disclosure is shown operating in a swimming pool 12. The cleaner 10 is configured to switch between two cleaning modes, a bottom cleaning mode and a top/skim cleaning mode. When the cleaner 10 is in the bottom mode, it will traverse the pool walls 14, including side walls and bottom floor wall, cleaning them with a suction operation that removes debris. When the cleaner 10 is in the top mode, it travels across and skims the pool water line 16, trapping any floating debris proximate the pool water line 16. The cleaner 10 is capable of being switched between the bottom mode and the top mode by a user, as discussed in greater detail below. The cleaner 10 is also adapted to occasionally switch from a forward motion to backup/spin-out mode whereby the cleaner reverses direction and/or moves in a generally arcuate sideward path to prevent the cleaner 10 from being trapped and unable to move, e.g., by an obstruction or in the corner of the pool 12. A discussion of the backup/spin-out mode is provided below.

As shown in FIG. 1, the pool cleaner 10 is connected to an external pump 18 by a hose connection 20 and a segmented hose 22. The segmented hose 22 is connected to a rear inlet of the pool cleaner 10 and extends to the hose connection 20, which is connected to the external pump 18. This connection allows the external pump 18 to provide pressurized water to the pool cleaner 10 to both power locomotion of the cleaner 10 as well as the cleaning capabilities of the cleaner 10. The segmented hose 22 may include one or more swivels 24, one or more filters 26, and one or more floats 28 installed in-line with the segmented hose 22. As such, the pressurized water flowing through the segmented hose 22 can also flow through the one or more swivels 24, one or more filters 26. The swivel 24 allows the segmented hose 22 to rotate at the swivel 24 without detaching the cleaner 10 from the external pump 18. As such, when the cleaner 10 travels about the pool 12, the segmented hose 22 will rotate at the one or more swivels 24, thus preventing entanglement. The one or more filters 26 may provide a filtering functionality for the pressurized water being provided to the cleaner 10.

With reference to FIGS. 2-11, the cleaner 10 includes a top housing 30 and a chassis 32. The top housing 30 includes a body 34 and a cross member 36. The cross member 36 connects to and spans across sidewalls of the body 34, forming a skimmer opening 38, a channel 40, and a rear opening 42. The skimmer opening 38 is an opening generally at the front of the cleaner 10 formed between the body 34 and the cross member 36 such that the skimmer opening 38 allows the flow of liquid and debris between the body 34 and the cross member 36, along the channel 40, and exiting the rear opening 42. The body 34 includes a deck 44, first and second sidewalls 46, 48 extending generally upward from the deck, and a rounded front wall 50. As discussed, the cross member 36 spans across and connects to the sidewalls 46, 48. The deck 44, the sidewalls 46, 48, and the cross member 36 provide the structure that forms the channel 40.

A debris bag retention mechanism 52 is provided at the rear of the top housing 30 generally adjacent the rear opening 42. The retention mechanism 52 is adapted to have a debris bag 54 attached thereto. When the debris bag 54 (see FIG. 1) is attached to the retention mechanism 52 the rear opening 42 is adjacent the opening to the debris bag 54 such that any debris that passes through the rear opening 42, flows into, and is deposited in the debris bag 54. In operation, when the cleaner 10 is in top mode debris that floats along the water line 16 of the pool 12 would travel through the skimmer opening 38, across the channel 40, e.g., along the deck 44, and out through the rear opening 42 into the debris bag 54.

The rounded front wall 50 includes a plurality of removed portions 56 adapted for a plurality of diverter wheels to extend therethrough and past the rounded front wall 50. The deck 44 includes a debris opening 58 that traverses through the deck 44. The debris opening 58 allows debris removed from the pool walls 14 to be moved through the deck 44 of the top housing 34 and into the debris bag 54.

A plurality of skimmer/debris retention jets 60 are positioned on each of the first and second sidewalls 46, 48 of the top housing body 34 to spray pressurized water rearward toward the debris bag 54. The skimmer/debris retention jets 60 are in fluidic communication with a fluid distribution system, discussed in greater detail below, such that the skimmer/debris retention jets 60 spray pressurized water when the cleaner 10 is in the skim/top mode of operation. The skimmer/debris retention jets 60 function to force water and any debris that may be in the channel 40 rearward into the debris bag 54. Furthermore, the jetting of water rearward causes a venturi-like effect causing water that is more forward than the skimmer/debris retention jets 60 to be pulled rearward into the debris bag 54. Thus, the skimmer/debris retention jets 60 perform a skimming operation whereby debris is pulled and forced into the debris bag 54. Furthermore, the skimmer/debris retention jets 60 prevent debris that is in the debris bag 54 from exiting.

The chassis 32 includes a first wheel well 62, a second wheel well 64, a front wheel housing 66, a rear wall 68, and a bottom wall 70. The first wheel well 62 functions as a side wall of the chassis 32 and a housing for a first rear wheel 72. The second wheel well 64 functions as a second side wall of the chassis 32 and a housing for a second rear wheel 74. The first and second rear wheels 72, 74 are each respectively rotationally mounted to the first and second wheel wells 62, 64. The front wheel housing 66 extends outwardly from the front of the chassis 32 and functions to rotationally secure a front wheel 76 to the chassis 32. The front wheel 76, and the first and second rear wheels 72, 74, which are freely rotatable, support the cleaner 10 on the pool walls 14 and allow the cleaner 10 to traverse the pool walls 14.

Figure 54:
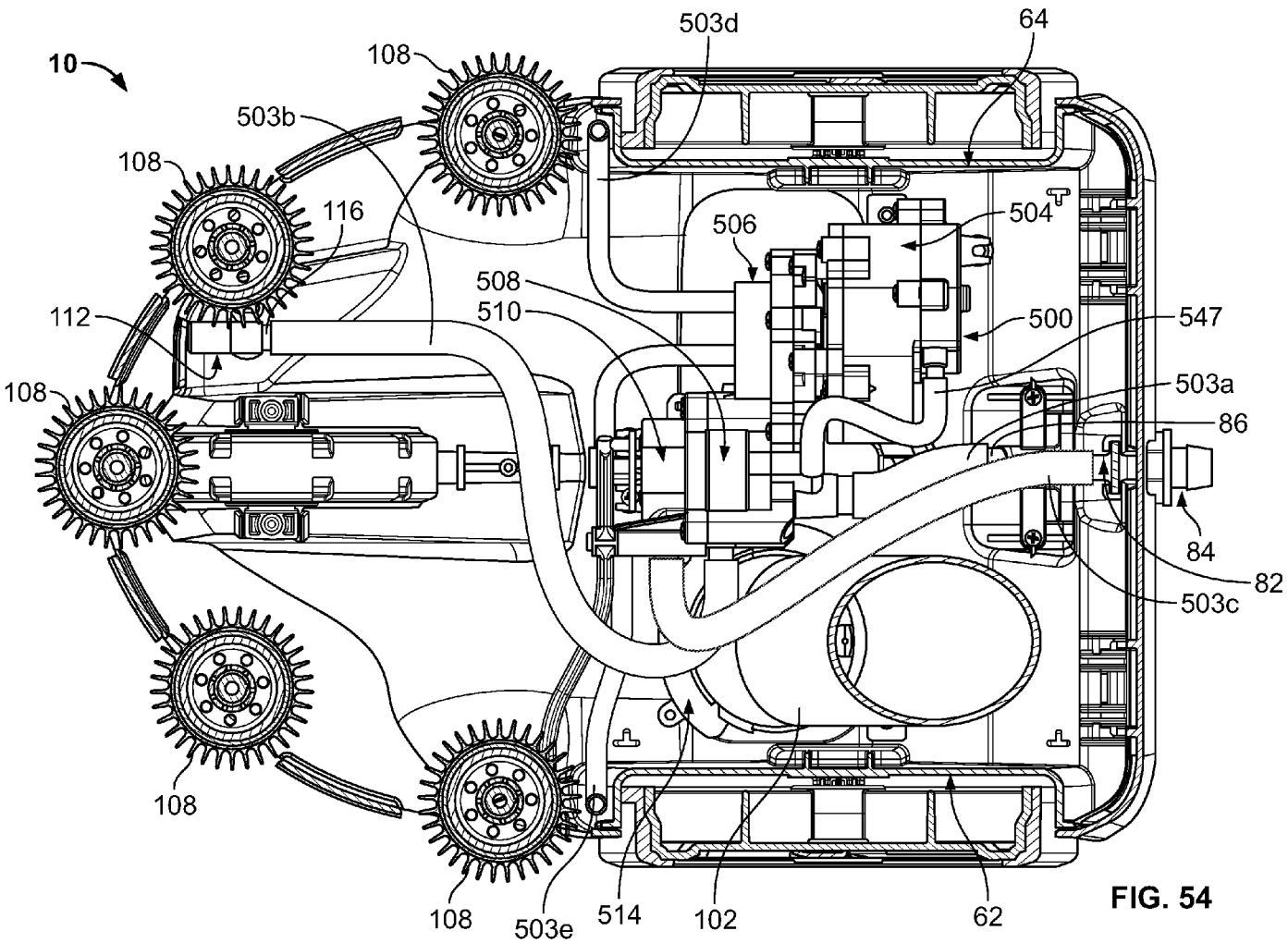
Figure 55:
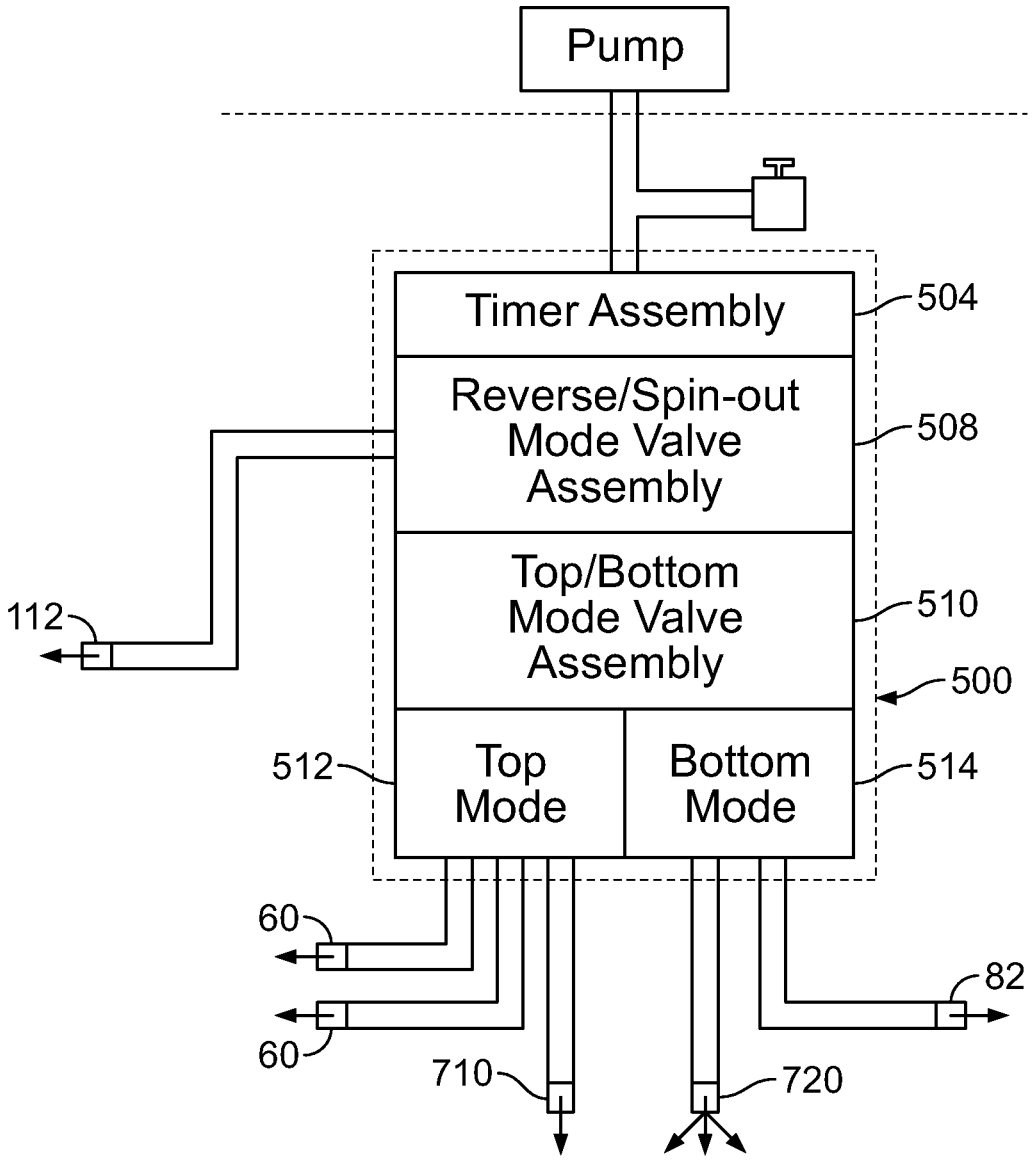
FIG. 55 is a schematic diagram of the water distribution and timing system of FIG. 52.
Figure 56:
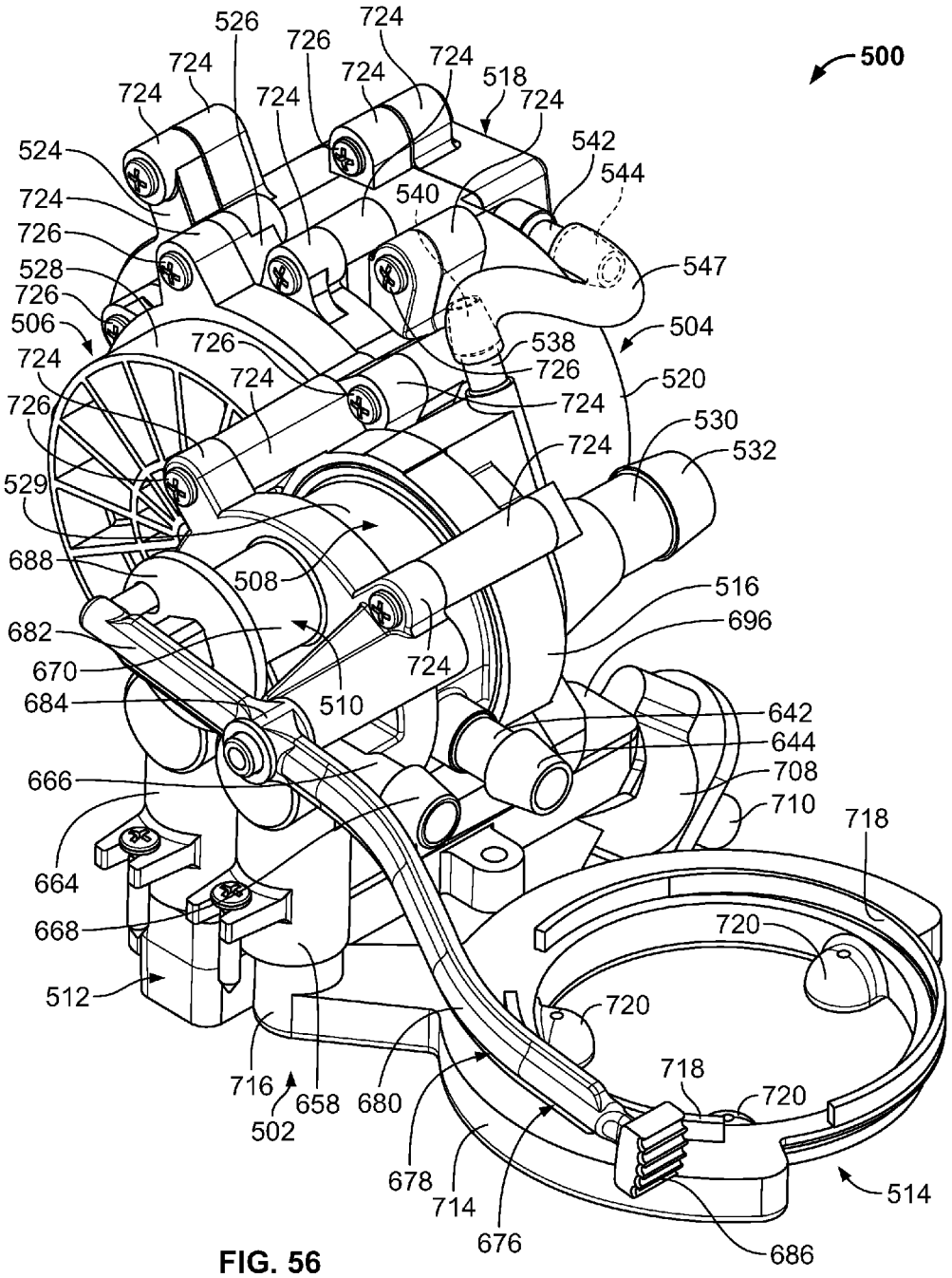
FIG. 56 is a first perspective view of the drive assembly and water distribution manifold of FIG. 52.
Figure 57:
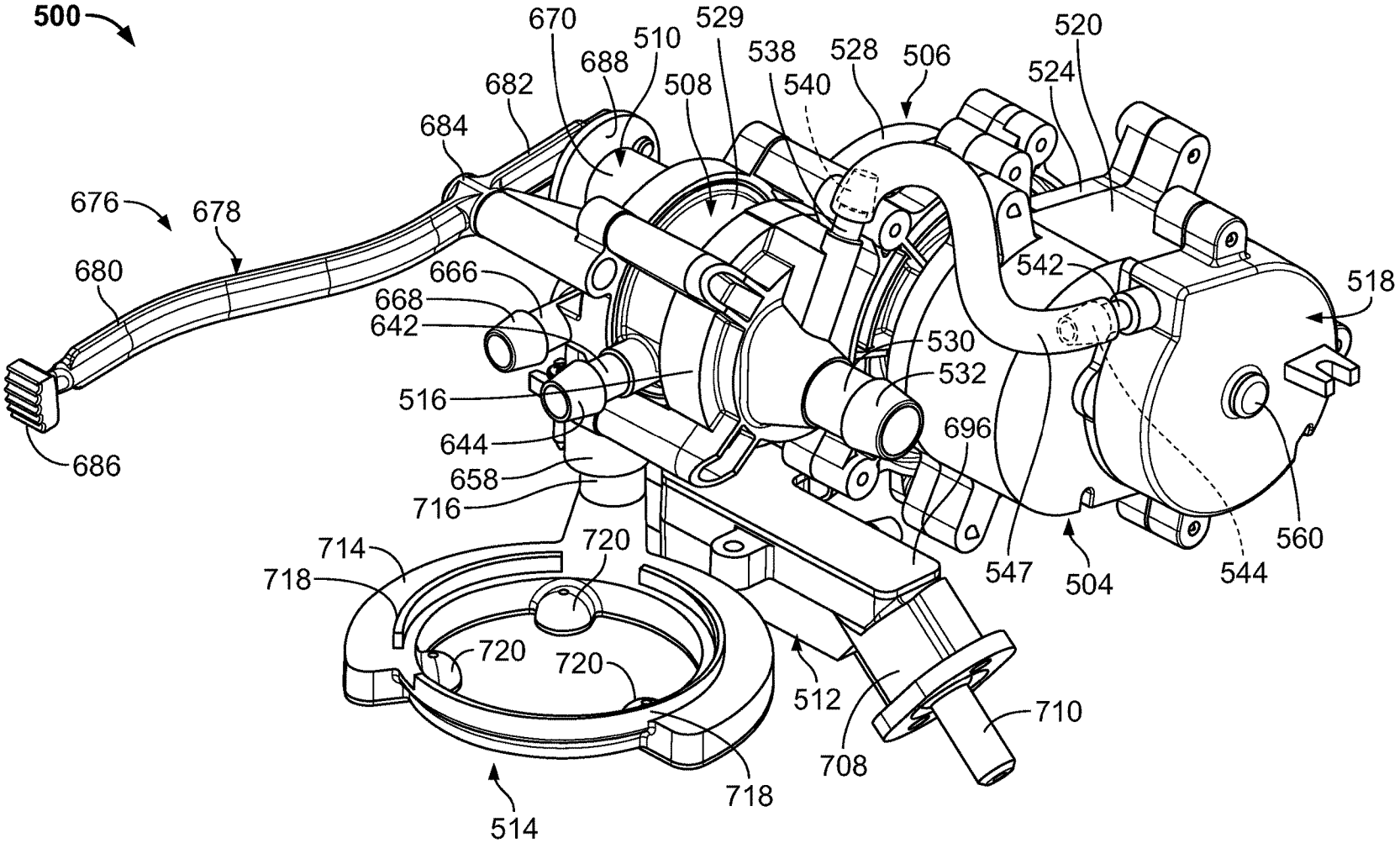
FIG. 57 is a second perspective view of the drive assembly and water distribution manifold of FIG. 52.
Figure 58:
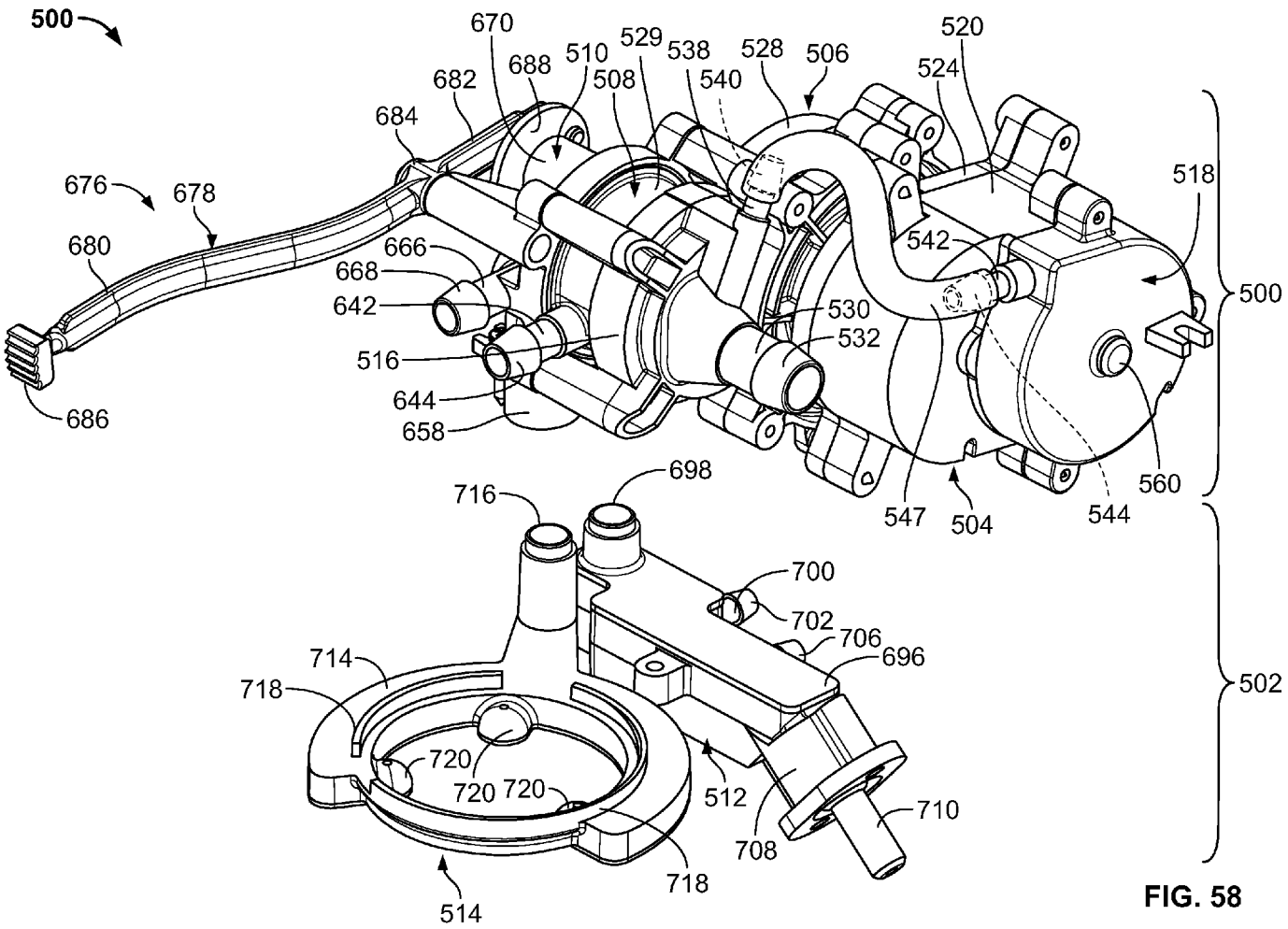
FIG. 58 is an exploded perspective view of the drive assembly and water distribution manifold of FIG. 52.
Figure 59:
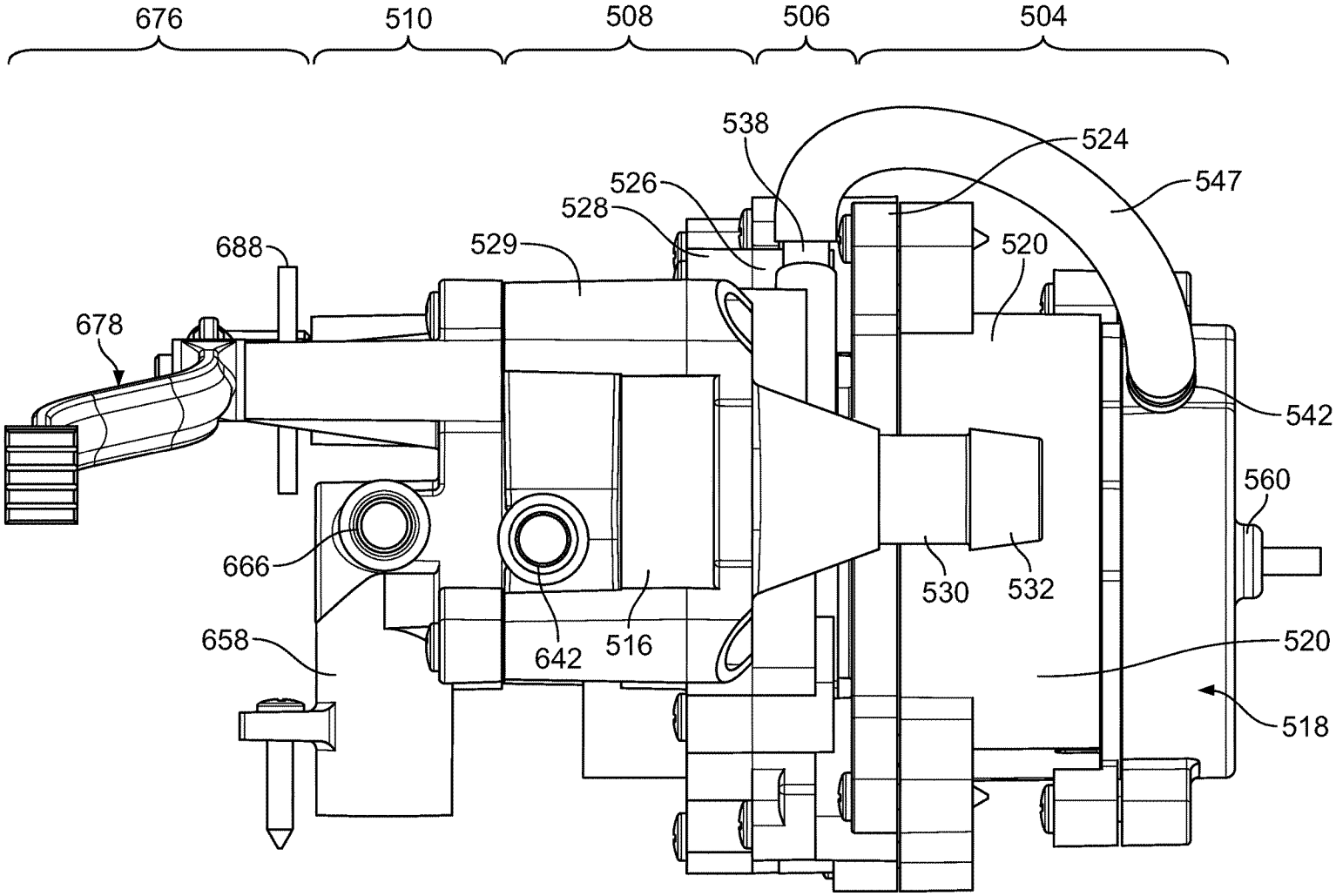
FIG. 59 is a right side view of the drive assembly of FIG. 52.
Figure 60:
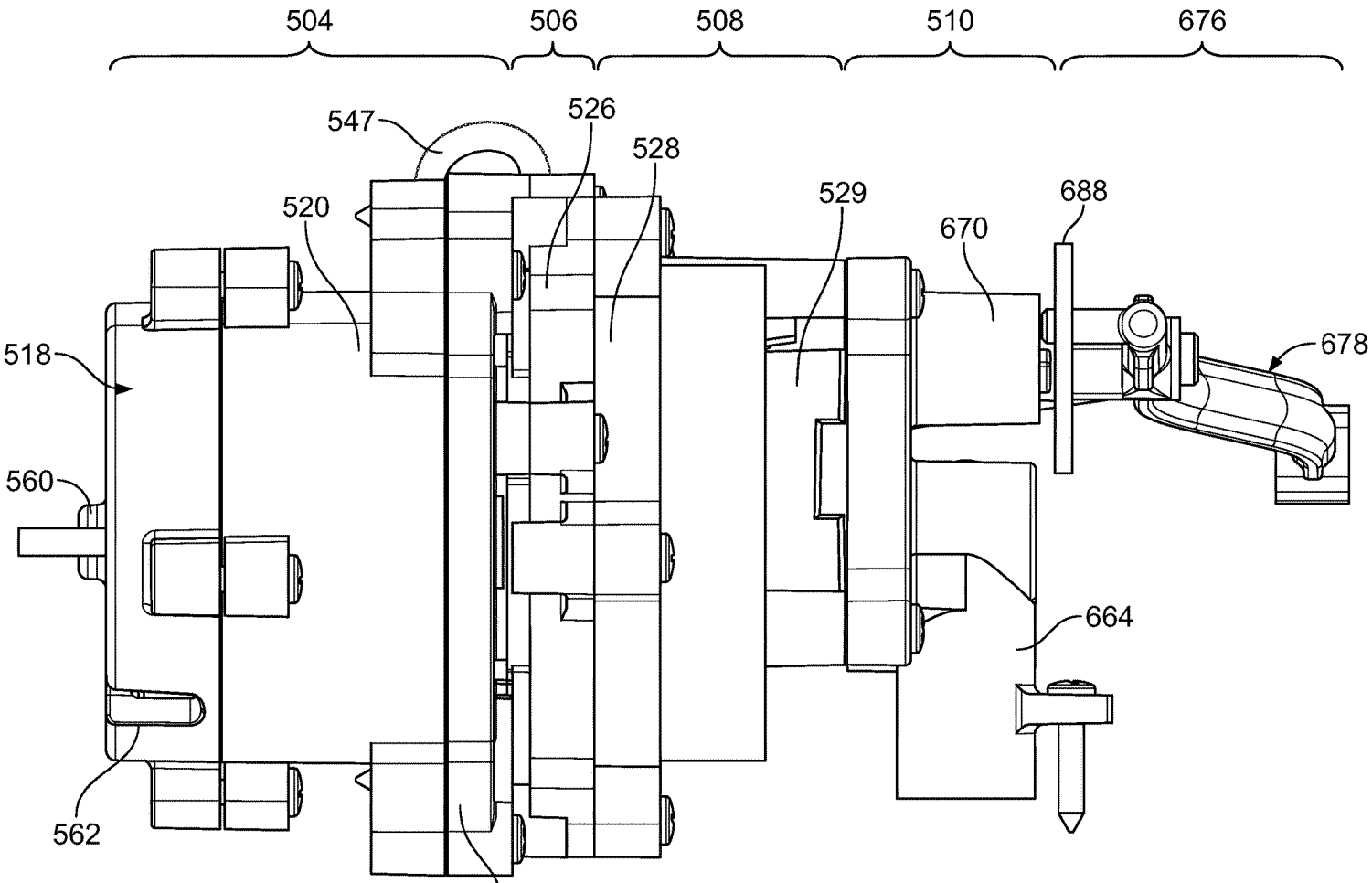
FIG. 60 is a left side view of the drive assembly of FIG. 52.
Figure 61:
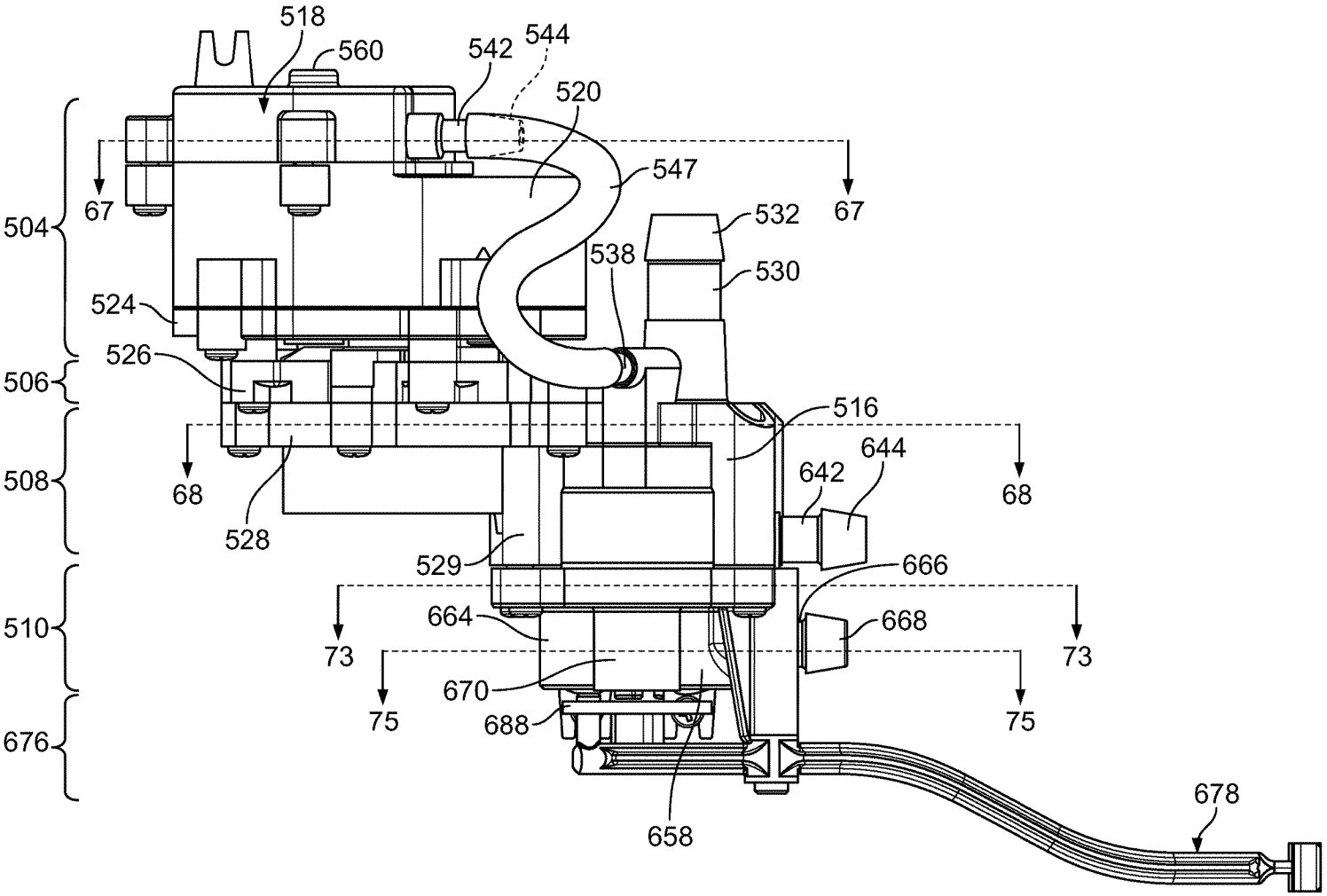
FIG. 61 is a top view of the drive assembly of FIG. 52.
Figure 62:
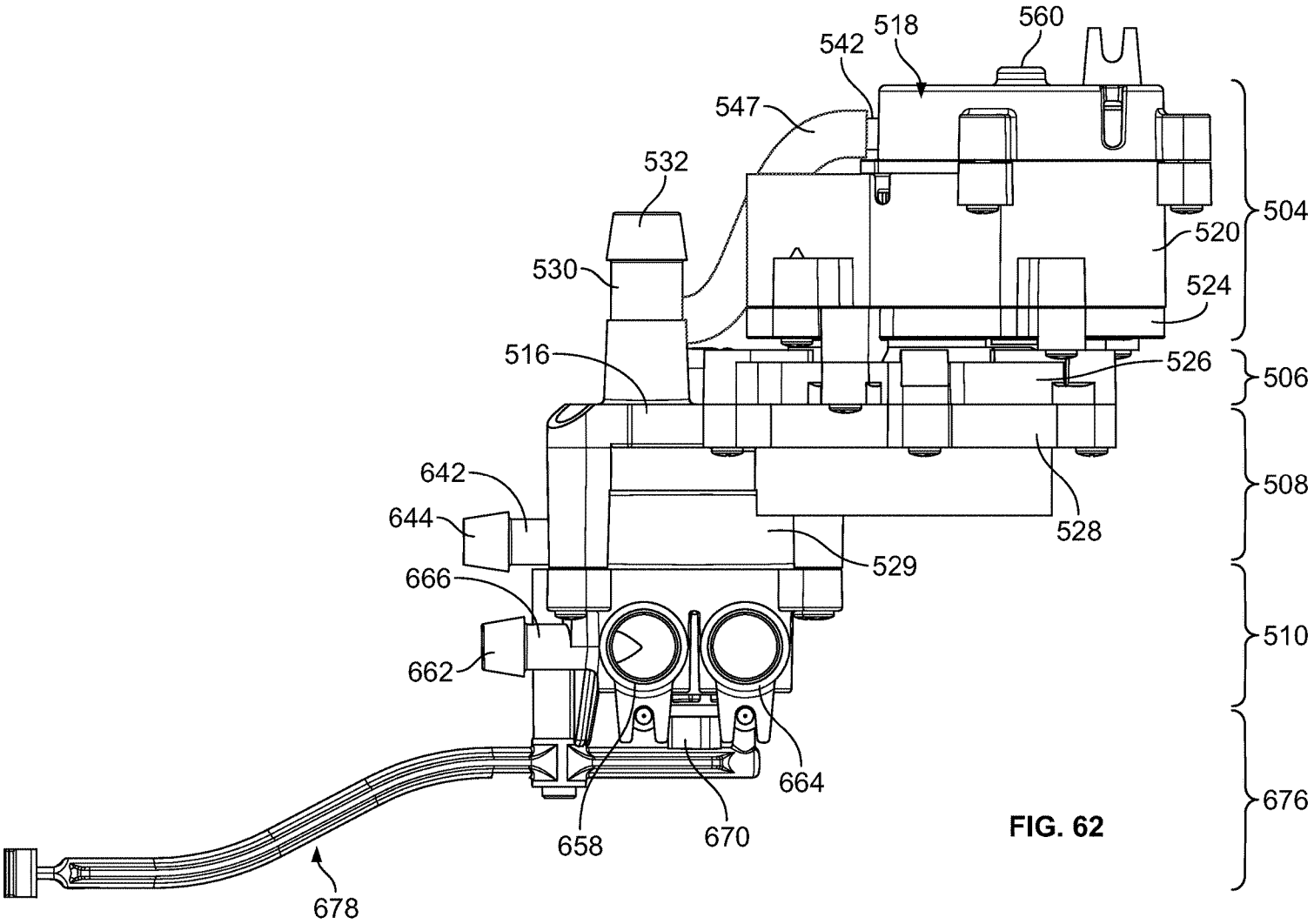
FIG. 62 is a bottom view of the drive assembly of FIG. 52.
Figure 63:
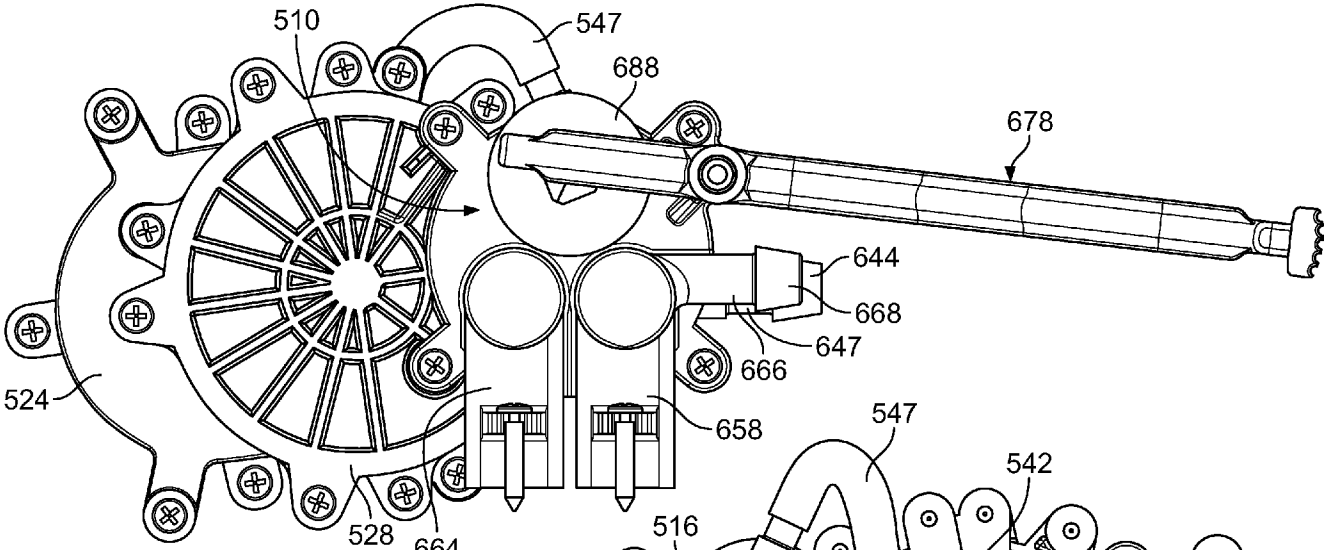
FIG. 63 is a front view of the drive assembly of FIG. 52.
Figure 64:
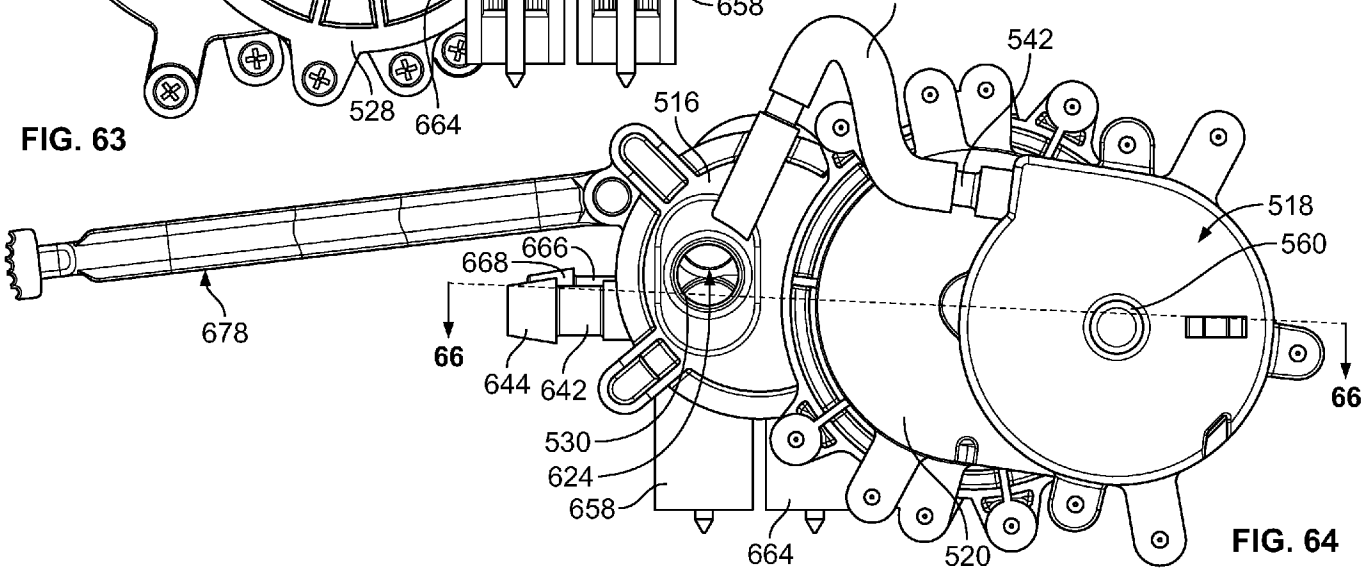
FIG. 64 is a rear view of the drive assembly of FIG. 52.

The rear wall 68 includes an inlet port 78, a top/bottom mode adjustment aperture 79, a forward (bottom mode) thrust jet nozzle aperture 80, and a top mode jet nozzle aperture 81. The rear wall 68 also includes a forward (bottom mode) thrust jet nozzle 82 extending through the forward thrust jet nozzle aperture 80, and a top mode jet nozzle 83 extending through the top mode jet nozzle aperture 81, which are discussed in greater detail below. The inlet port 78 includes an external nozzle 84 and an internal nozzle 86, each respectively have a barb 88, 90 that facilitates connection of a hose thereto. The external nozzle 84 allows a hose, such as the segmented hose 22, to be connected to the cleaner 10, putting the cleaner 10 in fluidic communication with the external pump 18. The external nozzle 84 is generally a fluid inlet, while the internal nozzle 86 is generally a fluid outlet. That is, the external nozzle 84 is connected to and in fluidic communication with the internal nozzle 86 such that water provided to the external nozzle 84 travels to and exits the internal nozzle 86. The internal nozzle 86 is connected to a hose 87, 403*a* (see FIGS. 11 and 54) which is connected, and in fluidic communication, with a drive assembly, discussed in greater detail below. The forward (bottom mode) thrust jet nozzle 82 extends through the rear wall 68, and includes an internal nozzle 94, and a barb 96, and is discussed in greater detail below.

Figure 4:
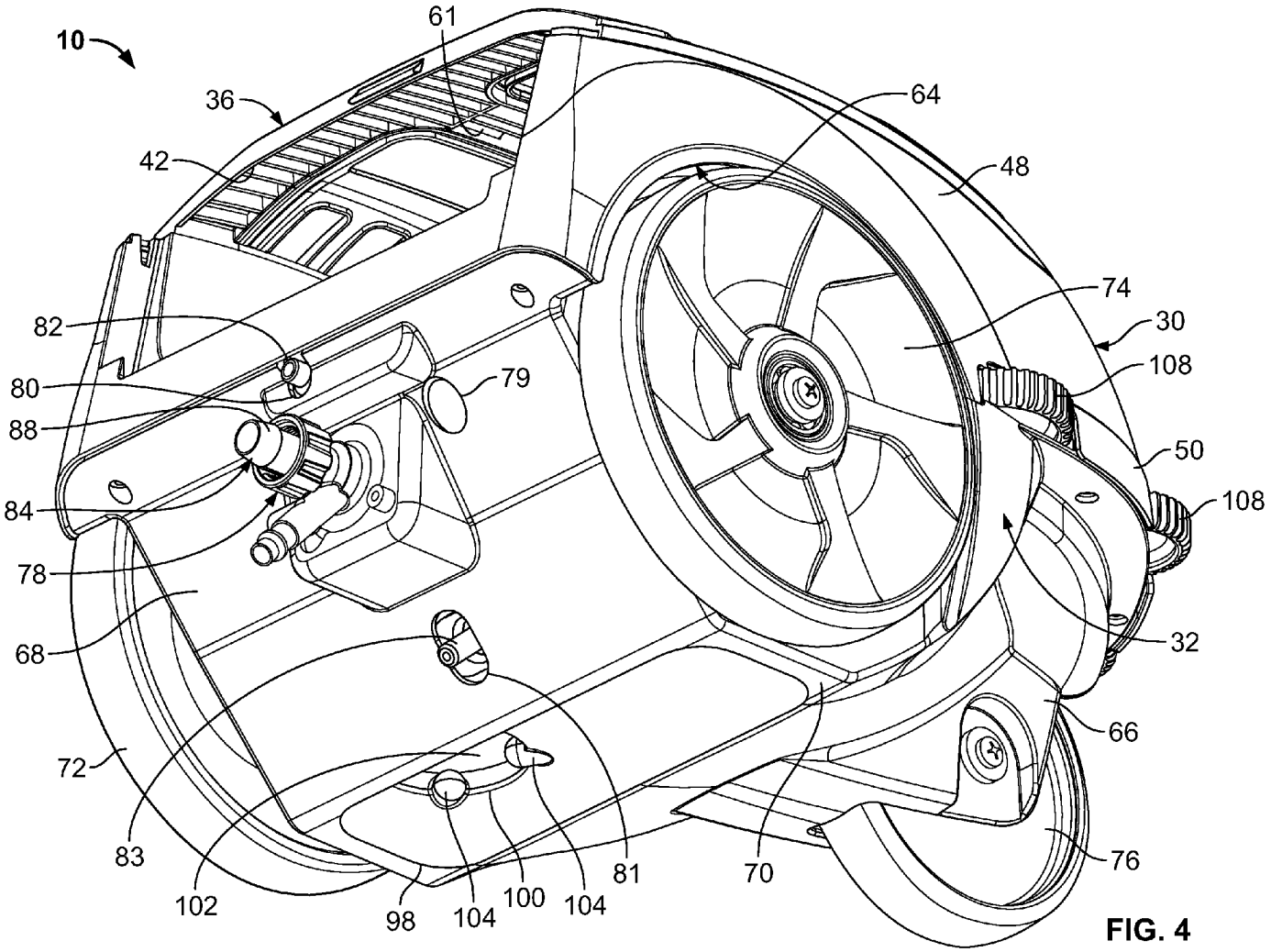
FIG. 4 is a third perspective view of the pool cleaner of the present disclosure.
Figure 10:
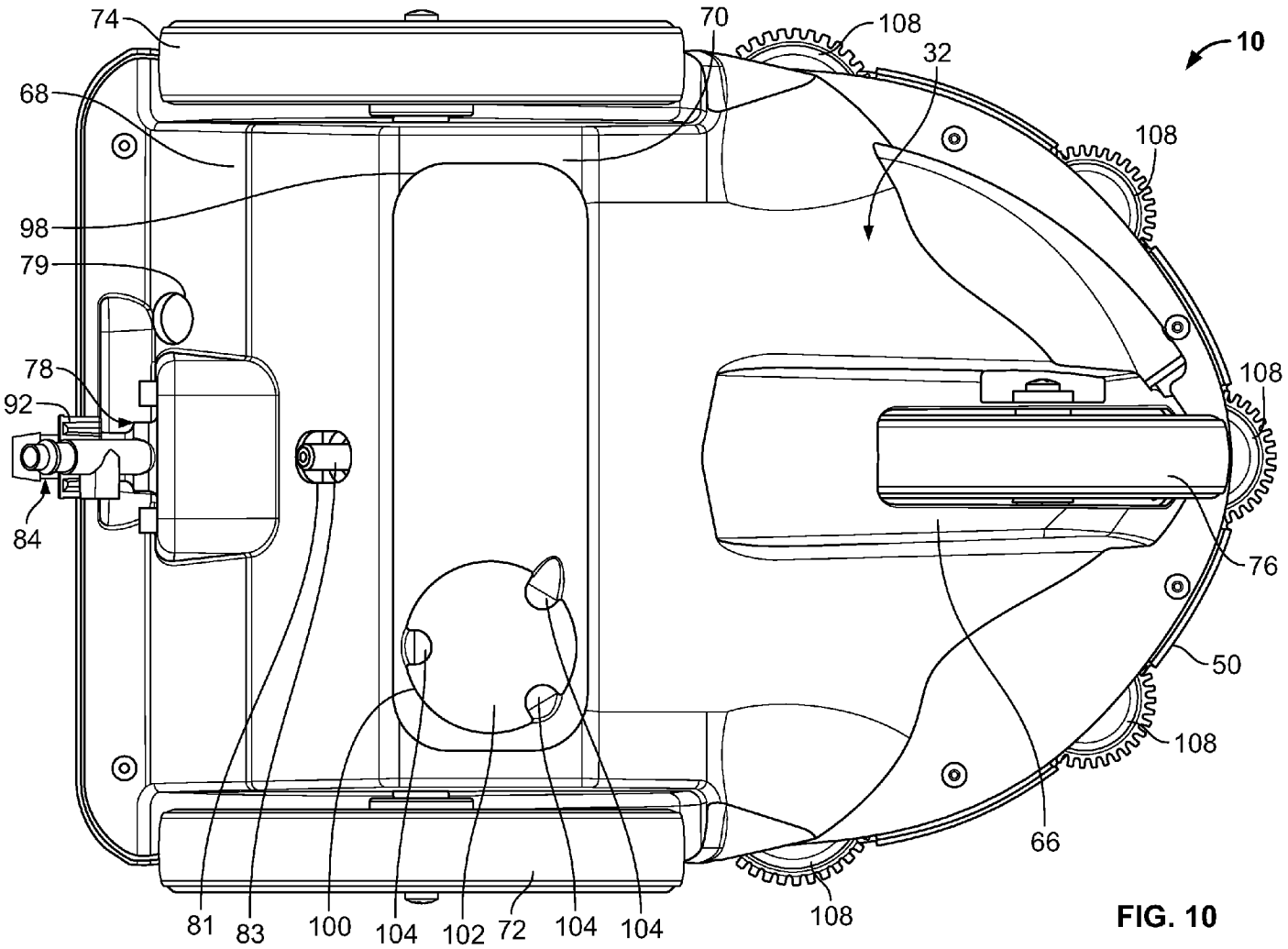
FIG. 10 is a bottom view of the pool cleaner of the present disclosure.
Figure 11:
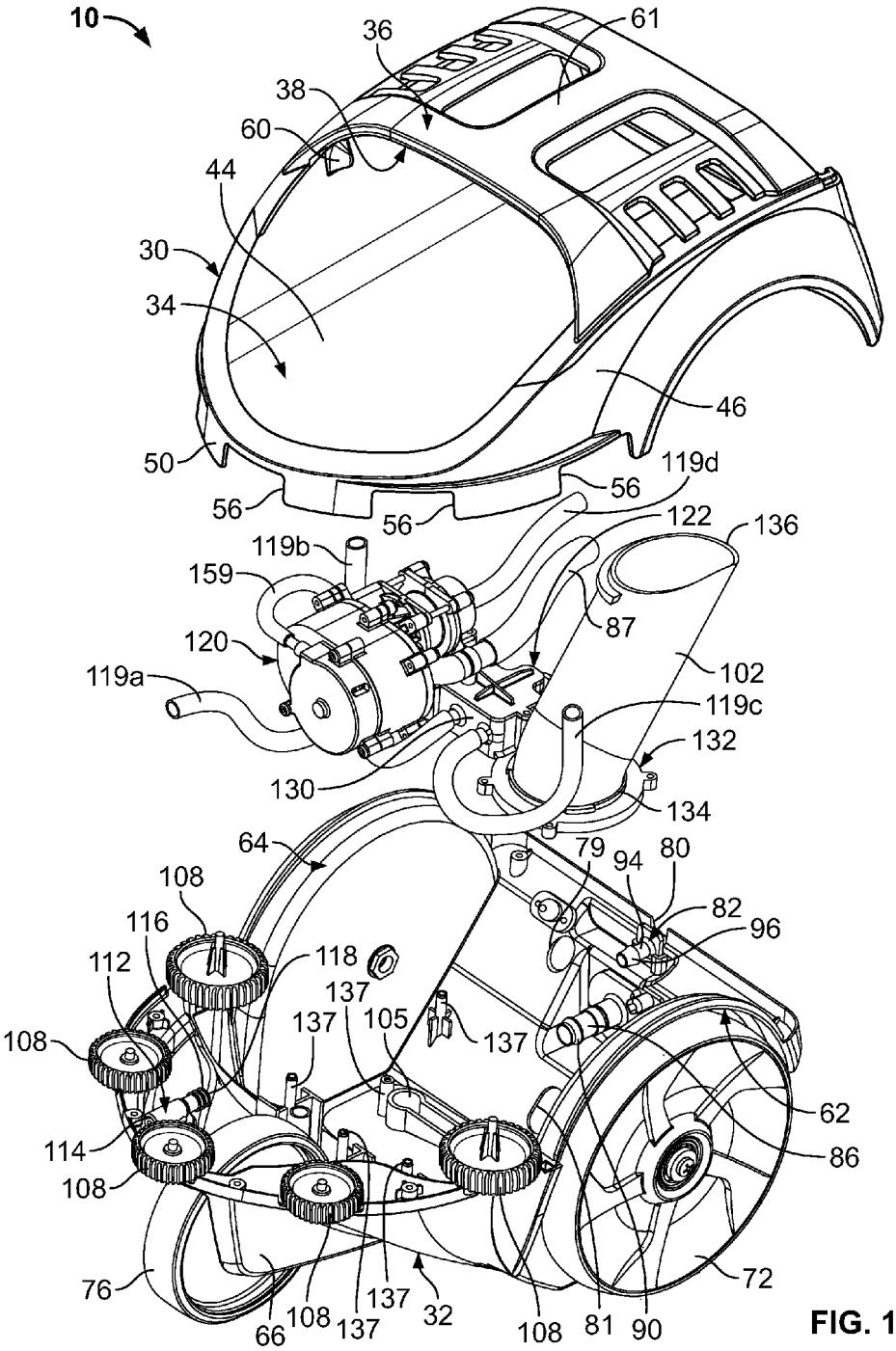
FIG. 11 is an exploded perspective view of the pool cleaner of the present disclosure.

The bottom wall 70 includes a suction head 98 and a suction aperture 100. The suction head 98 is formed as a pyramidal recess or funnel disposed in the bottom wall 70 and extending to the suction aperture 100, which extends through the bottom wall 70. As shown in FIGS. 4 and 10, the suction head 98 may include a rectangular perimeter that extends generally across the width of the bottom wall 70 of the cleaner 10. A suction tube 102 is positioned adjacent the suction aperture 100 and extends from the suction aperture 100 to the debris opening 58 of the top housing 30. A plurality of suction jet nozzles 104 are mounted adjacent the suction aperture 100 and oriented to discharge a high velocity stream of water through the suction tube 102, creating a venture-like suction effect. The high velocity discharge from the suction jet nozzles 104 removes debris from the pool walls 14 when the cleaner 10 is in bottom mode. In such an arrangement, the suction head 98 functions to direct loosened debris into the suction aperture 100, this debris is forced through the suction tube 102 by the suction jet nozzles 104. The plurality of suction jet nozzles 104 may be three nozzles arranged in a triangular orientation, four nozzles arranged in a rectangular orientation, or various other orientations. Furthermore, the plurality of suction jet nozzles 104 may be oriented to direct their respective stream of water parallel to the central axis of the suction tube 102, or may be oriented to direct their respective stream of water at an angle to the central axis of the suction tube 102 to cause a helical flow, which also results in increase performance/efficiency of the cleaner.

The chassis 32 includes a front rim 106 having a plurality of cut-outs receiving diverter wheels 108. The front rim 106 and cut-outs define an upper frontal perimeter of the chassis 32. The plurality of diverter wheels 108 are rotatably mounted to the chassis 32 adjacent the front rim 106 such that the diverter wheels 108 extend through the cut-outs. The diverter wheels 108 function as rotatable bumpers so if the cleaner 10 approaches a pool wall 14 the diverter wheels 108 contact the pool wall 14 instead of the top housing 30 or the chassis 32. When in contact with the pool wall 14, the diverter wheels 108 rotate, allowing the cleaner 10 to be continually driven and moved along, and/or diverted away from, the pool wall 14. Thus, the diverter wheels 108 protect the cleaner 10 from damage due to contact with the pool wall 14. Vice versa, the wheels 108 protect the pool walls from damage due to the cleaner 10, e.g., scuffing, scratching, etc.

The chassis 32 includes a reverse/spin-out thrust jet nozzle housing 110 located at a frontal portion generally adjacent the front wheel housing 66. The jet nozzle housing 110 includes a removed portion 111 providing access to a reverse/spin-out thrust jet nozzle 112. The reverse/spin-out thrust jet nozzle 112 is secured within the jet nozzle housing 110 and includes an outlet 114 and an inlet 116 having a barb 118. The barb 118 facilitates attachment of a hose 119*a* to the inlet 116. Water provided to the inlet 116 is forced out the outlet 114 under pressure causing a jet of pressurized water directed generally forward. This jet of pressurized water causes the cleaner 10 to move in a rearward direction. Alternatively, the reverse/spin-out thrust jet nozzle 112 may be positioned at an angle to the chassis 32 such that it causes an angular movement of the cleaner 10, e.g., a "spin-out," instead of rearward movement of the cleaner 10. In either configuration, the reverse/spin-out thrust jet nozzle 112 functions to occasionally cause the cleaner 10 to move in a reverse motion or spin-out motion so that if it is ever stuck in a corner of the pool 12, or stuck on an obstruction in the pool 12, such as a pool toy or pool ornamentation, it will free itself and continue to clean the pool 12.

Figure 5:
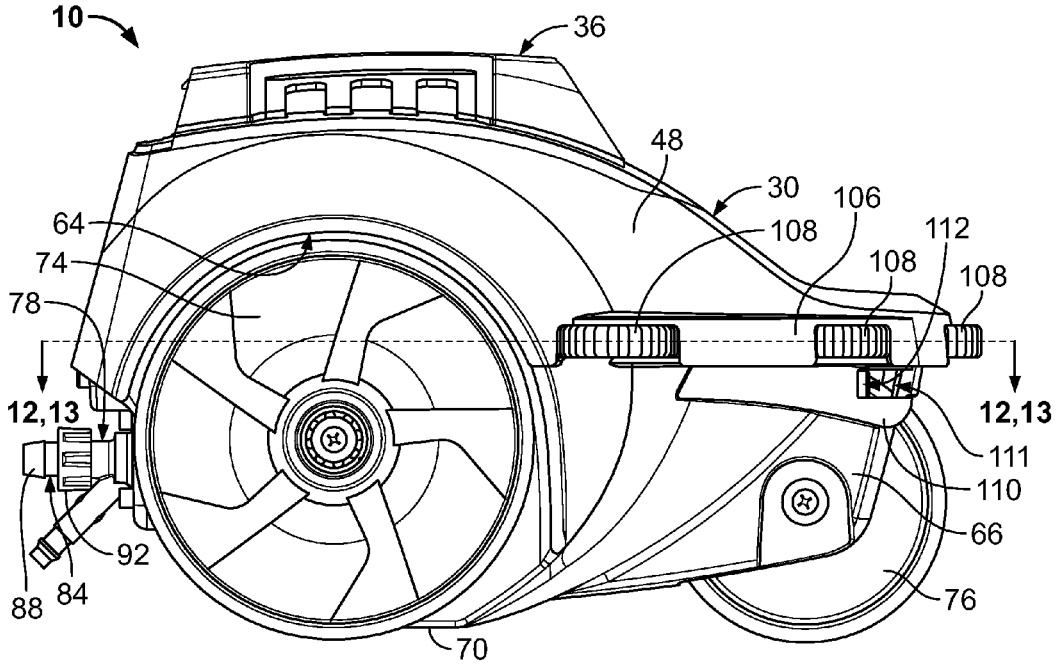
FIG. 5 is a left side view of the pool cleaner of the present disclosure.
Figure 6:
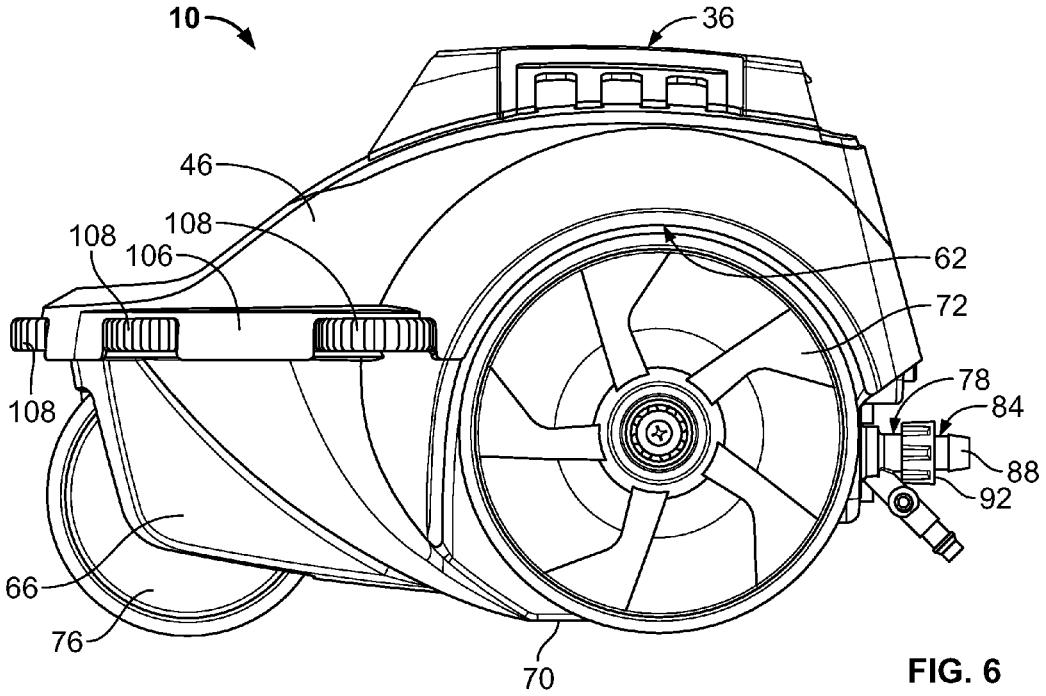
FIG. 6 is a right side view of the pool cleaner of the present disclosure.
Figure 7:
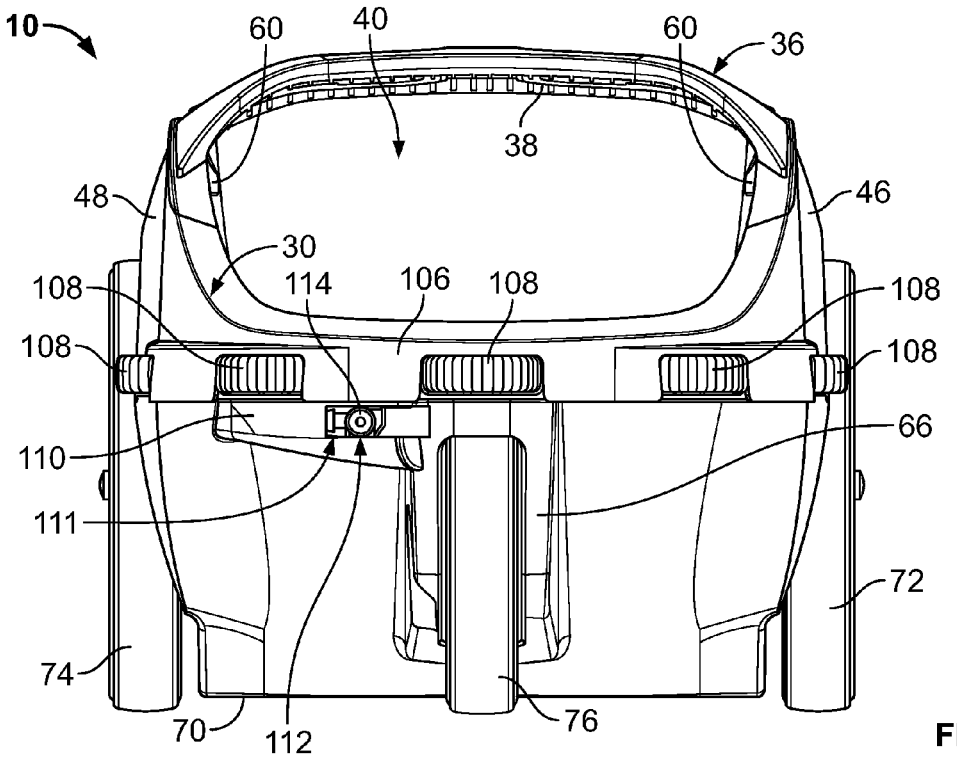
FIG. 7 is a front view of the pool cleaner of the present disclosure.
Figure 8:
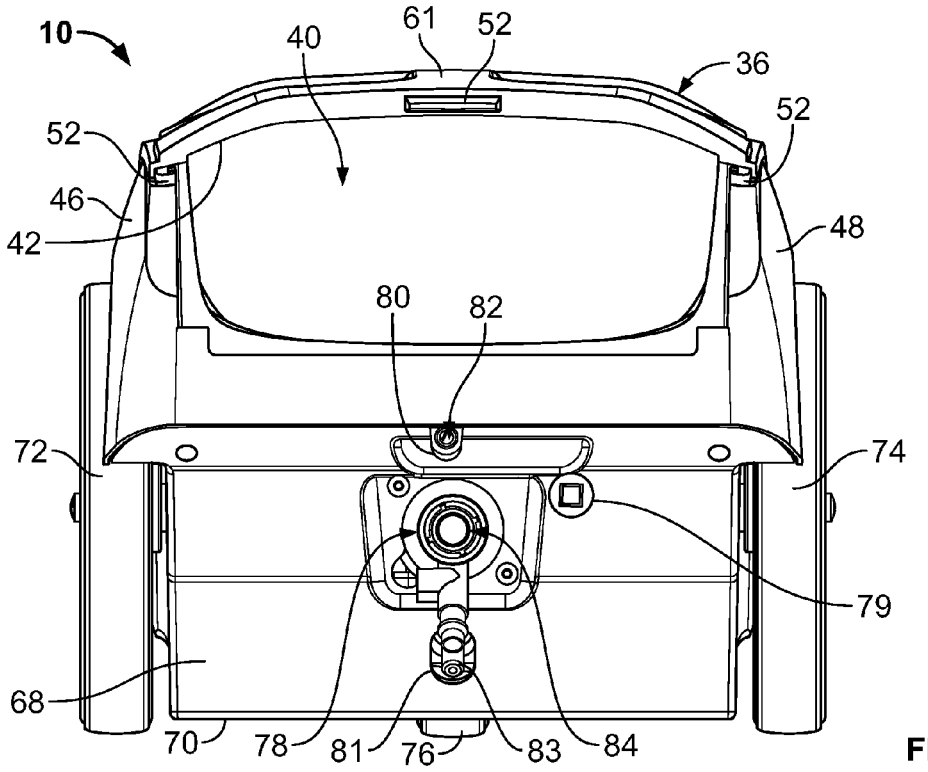
FIG. 8 is a rear view of the pool cleaner of the present disclosure.
Figure 12:
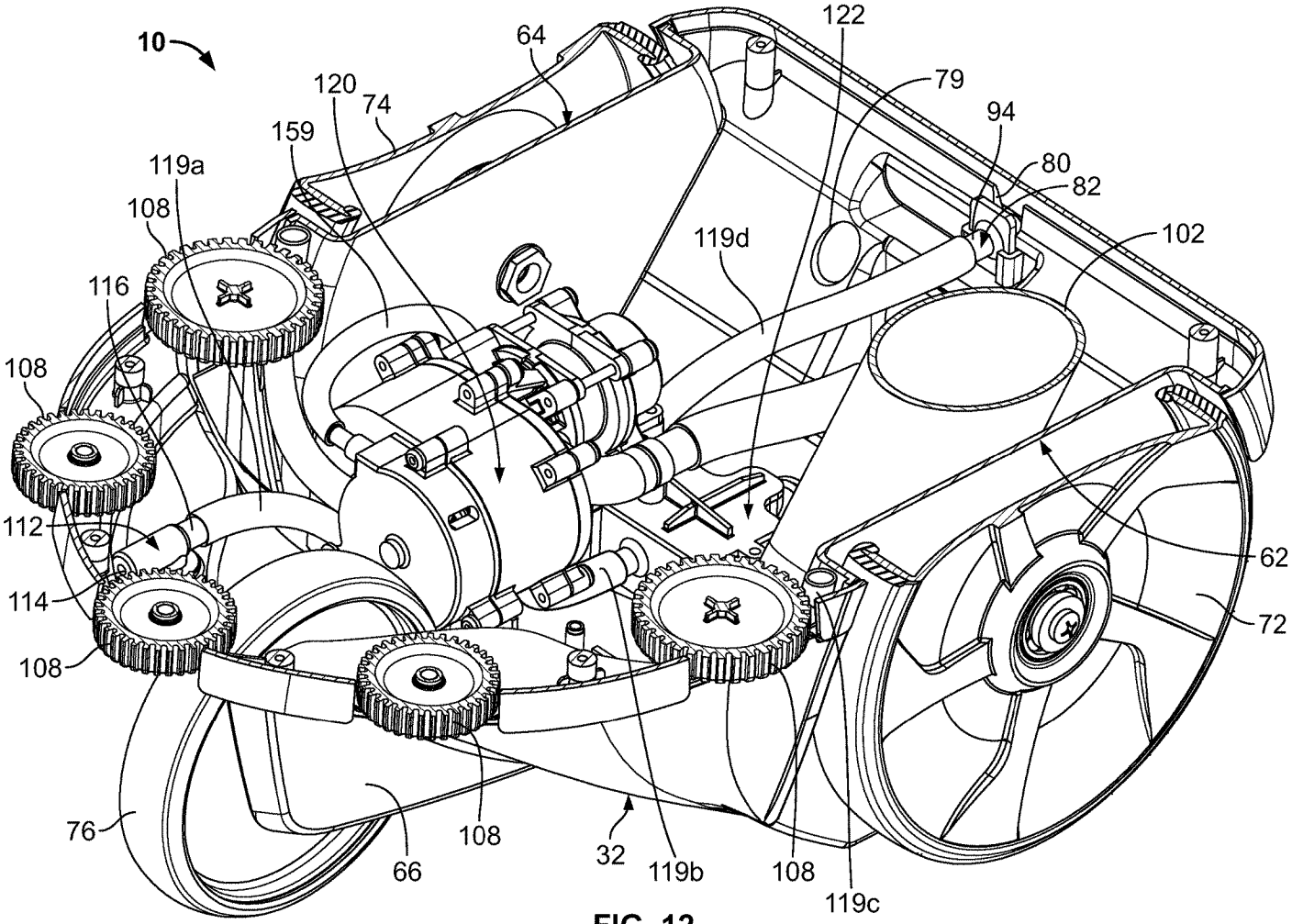
FIG. 12 is a sectional view of the pool cleaner of the present disclosure taken along line 12-12 of FIG. 5.

FIG. 12 is a sectional view of the pool cleaner 10 taken along line 12-12 of FIG. 5. As illustrated in FIG. 12, the chassis 32 forms a housing for a drive assembly 120, a water distribution manifold 122, and the suction tube 102.

FIGS. 14-17 illustrate the drive assembly 120 and the water distribution manifold 122, which are in fluidic communication with one another. The drive assembly 120 includes a timer assembly 124, a back-up/spin-out mode valve assembly 126, and a top/bottom mode valve assembly 128, each discussed in greater detail below. The water distribution manifold 122 includes a manifold body 130 and a jet ring 132. The manifold body 130 includes a plurality of chambers that function to direct water flow amongst the various jet nozzles of the cleaner 10. The suction tube 102 includes a bottom end 134 and a top end 136. The jet ring 132 is connected with the bottom end 134 of the suction tube 102 and includes the plurality of suction jet nozzles 104.

FIGS. 17-27 show the drive assembly 120 in greater detail. Particular reference is made to FIG. 24, which is an exploded view of the drive assembly 120 showing the components of the timer assembly 124, the inlet body 138, the back-up/spin-out mode assembly 126, and the top/bottom mode assembly 128. The timer assembly 124 includes a turbine housing 140, a gear box 142, a Geneva gear lower housing 144, and a Geneva gear upper housing 146. The drive assembly 120 is configured such that the backup/spin mode assembly 126 is adjacent the inlet body 138, the inlet body 138 is adjacent the Geneva gear upper housing 146, the Geneva gear lower housing 144 is adjacent the Geneva gear upper housing 146, the gear box 142 is adjacent the Geneva gear lower housing 144, and the turbine housing 140 is adjacent the gear box 142.

The inlet body 138 includes an inlet nozzle 148 having a barbed end 150. The inlet nozzle 148 provides a flow path from the exterior of the inlet body 138 to the interior. The inlet body 138 defines an annular chamber 152 that surrounds a central hub 154. The inlet nozzle 148 is in communication with the annular chamber 152 such that fluid can flow into the inlet nozzle 148 and into the annular chamber 152. The annular chamber 152 includes a closed top and an open bottom. An outlet nozzle 156 having a barbed end 158 is provided on the inlet body 138 generally opposite the inlet nozzle 148. The outlet nozzle 156 provides a path for water to flow out from the inlet body 138. As such, water flowing into the inlet nozzle 148 flows through the annular chamber 152 and exits the inlet body 138 through the outlet nozzle 156. The inlet body 138 is generally closed at an upper end, e.g., the end adjacent the Geneva gear upper housing 146, and open at a lower end, e.g., the end adjacent the backup/spin-out mode assembly 126.

Figure 26:
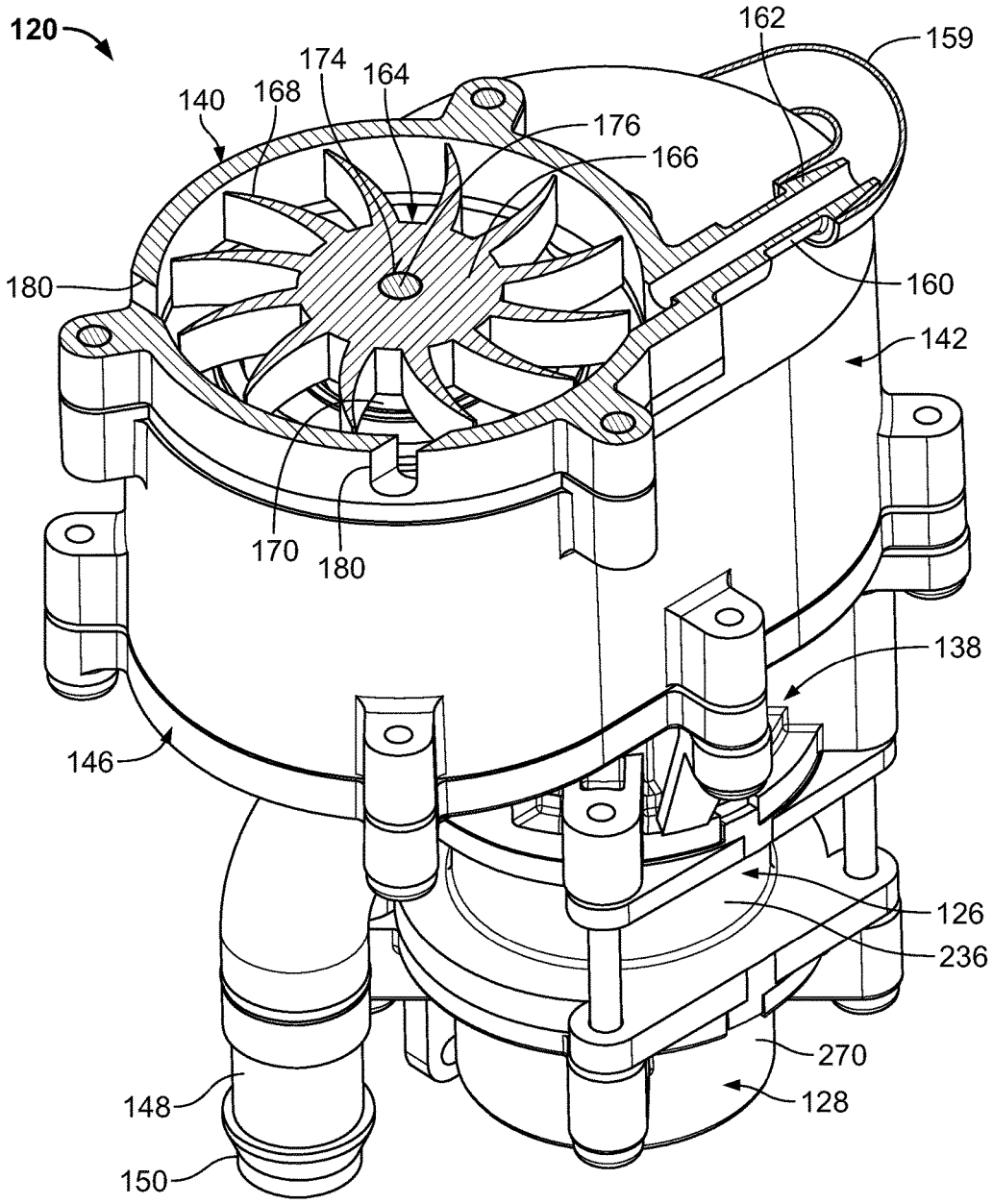
FIG. 26 is a sectional view of the drive assembly of the present disclosure take along line 26-26 of FIG. 20 showing a turbine.

The turbine housing 140 includes an inlet nozzle 160 having a barbed end 162, and a turbine 164. A hose 159 is connected at one end to the barbed end 158 of the inlet body outlet nozzle 156 and at another end to a the barbed end 162 of the turbine housing inlet nozzle 160. Accordingly, water flows out from the inlet body 138 through the outlet nozzle 156 and to the turbine housing inlet nozzle 160 by way of the hose 159. The turbine 164 includes a central hub 166, a plurality of blades 168, a boss 170 extending from the central hub 166 and having an output drive gear 172 mounted thereto, a central aperture 174. The central hub 166, boss 170, and output drive gear 172 are connected for conjoint rotation. Accordingly, rotation of the blades 168 causes rotation of the central hub 166, boss 170, and output drive gear 172. The central aperture 174 extends through the center of the turbine 164, e.g., through the output drive gear 172, the boss 170, and the central hub 166. A first shaft 176 extends through the central aperture 174 and is secured within a shaft housing 178 that is provided in a top of the turbine housing 140. The first shaft 176 extends from the shaft housing 178, through the turbine 164, and into the gear box 142. The turbine housing 140 also includes one or more apertures 180 in a sidewall thereof that allow water to escape the turbine housing 140. When pressurized water enters the turbine housing 140 through the inlet nozzle 160 it places pressure on the turbine blades 168, thus transferring energy to the turbine 164 and causing the turbine 164 to rotate. However, once the energy of the pressurized water is transferred to the turbine 164 it must be removed from the system, otherwise it will impede and place resistance on new pressurized water entering the turbine housing 140. Accordingly, new pressurized water introduced into the turbine housing 140 forces the old water out from the one or more apertures 180. FIG. 26 is a sectional view of the turbine housing 140 taken along line 26-26 of FIG. 20 further detailing and showing the arrangement of the turbine 164 within the turbine housing 140. The turbine housing 140 is positioned on the gear box 142.

Figure 27:
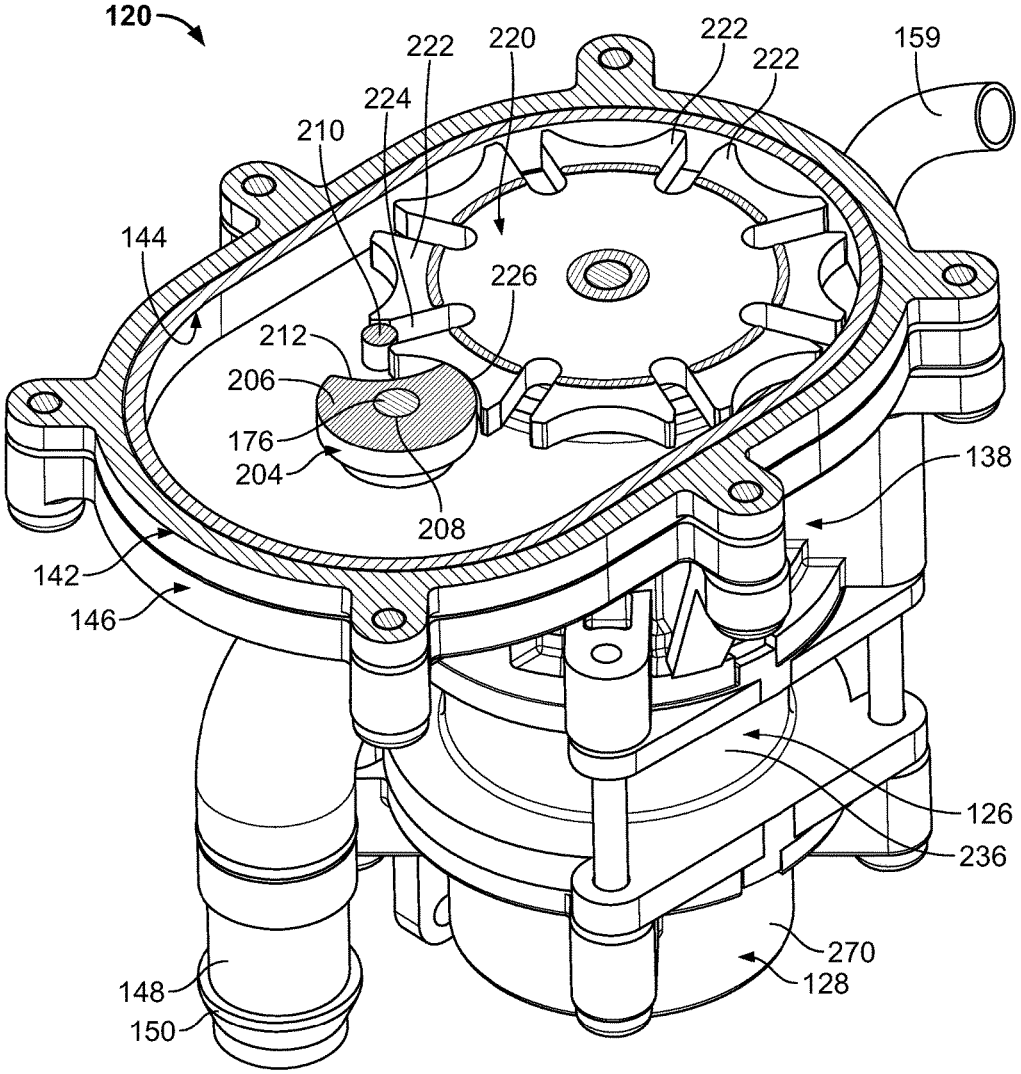
FIG. 27 is a sectional view of the drive assembly of the present disclosure take along line 27-27 of FIG. 20 showing a Geneva gear.

The gear box 142 includes a turbine mounting surface 182 having an aperture 184 extending there through. The turbine housing 140 is positioned on, and covers, the gear box turbine mounting surface 182, such that the turbine 164 is adjacent the turbine mounting surface 182 and the turbine output drive gear 172 extends through the aperture 184 and into the gear box 142. The gear box 142 houses a reduction gear stack 186 that is made up of a plurality of drive gears 188, some of which include a large gear 190 connected and coaxial with a smaller gear 192 (see FIG. 25) for conjoint rotation therewith. The conjoint rotation of the large gear 190 with the smaller gear 192 causes for a reduction in gear ratio. As can bee seen in FIG. 25, which is a sectional view of the drive assembly 120, the gear reduction stack 186 includes two series of coaxial gears 188 that both include a central aperture 194 extending through the gears 188. One of the series gear 186 is coaxial with the turbine 164 such that the first shaft 176 extends through the gears 188, and into a first shaft bottom housing 218 of the Geneva gear upper housing 146, discussed in greater detail below. Thus, the first series of gears 188 rotates about first shaft 176. A second series of gears 188 is positioned to engage the first series of gears 188 and have a second shaft 196 extending through the central aperture 194 thereof. The second shaft 196 is parallel to the first shaft 176 and is secured within a second shaft top housing 198 that is positioned in a top wall of the gear box 142. The second shaft 196 extends through the Geneva gear lower housing 144. The turbine output drive gear 172 engages a large gear 190 of the first gear 188 that rotates about the second shaft 196. The smaller gear 192 of the first gear 188 engages another gear 188 that rotates about the first shaft 176. A series of such gears are positioned within the gear reduction stack 186 with particular gear ratios, and engaged with one another in the above-described fashion, so that rotation of the turbine 164, and subsequent rotation of the turbine output drive gear 172, causes each gear 188 of the gear reduction stack 186 to rotate with each subsequent gear rotating at a different speed. The gear reduction stack 186 includes a final gear stack output gear 200 that rotates about the first shaft 176. The gear stack output gear 200 includes a drive gear 202 and a Geneva drive gear 204 extending from the drive gear 202 for conjoint rotation therewith. The gear stack output drive gear 202 engages and is driven by one of the smaller gears 192 of a gear 188 of the gear stack 186. Accordingly, rotation of the turbine blades 168 causes rotation of the central hub 166, boss 170, and output drive gear 172, which output drive gear 172 causes rotation of the gears 188 of the gear reduction stack 186, and ultimately rotation of the gear stack output gear 200. As shown in FIG. 27, the Geneva drive gear 204 includes a central hub 206, a central aperture 208, and a post 210, which all extend from the drive gear 204, thus having conjoint rotation therewith. The central hub 206 includes a remove section 212. The function of the Geneva drive gear 204 is discussed in greater detail below in connection with FIG. 27.

Referring now to FIG. 27, the Geneva gear lower housing 144 is positioned between the gear box 142 and the Geneva gear upper housing 146. The Geneva gear lower housing 144 includes an aperture 214 that the Geneva drive gear 204 extends through. The Geneva gear upper housing 146 includes the first shaft bottom housing 218 and a Geneva output aperture 230 (see FIG. 25). The Geneva gear lower and upper housings 144, 146 house a Geneva gear 220. The Geneva gear 220 includes a second shaft bottom housing 221, a plurality of cogs 222, a plurality of slots 224 between each cog 222, and a socket 228 (see FIG. 25). The second shaft 196 (see FIG. 25) extends through the Geneva gear lower housing 144 and is secured within the shaft bottom housing 221. The Geneva gear 220 shown in FIG. 27 includes eight cogs 222 separated by eight slots 224. The slots 224 extend radially inward from the periphery of the Geneva gear 220. Each of the cogs 222 include an arcuate portion 226 on the peripheral edge thereof. The socket 228 extends from the Geneva gear 220 and through the upper housing Geneva output aperture 230, which generally have mating geometries so that the Geneva gear socket 228 can rotate within the Geneva output aperture 230, but is restricted from planar translation. The Geneva gear socket 228 generally has a circular outer geometry, for rotation within the Geneva output aperture 230, and a non-circular inner geometry, here square.

Figure 25:
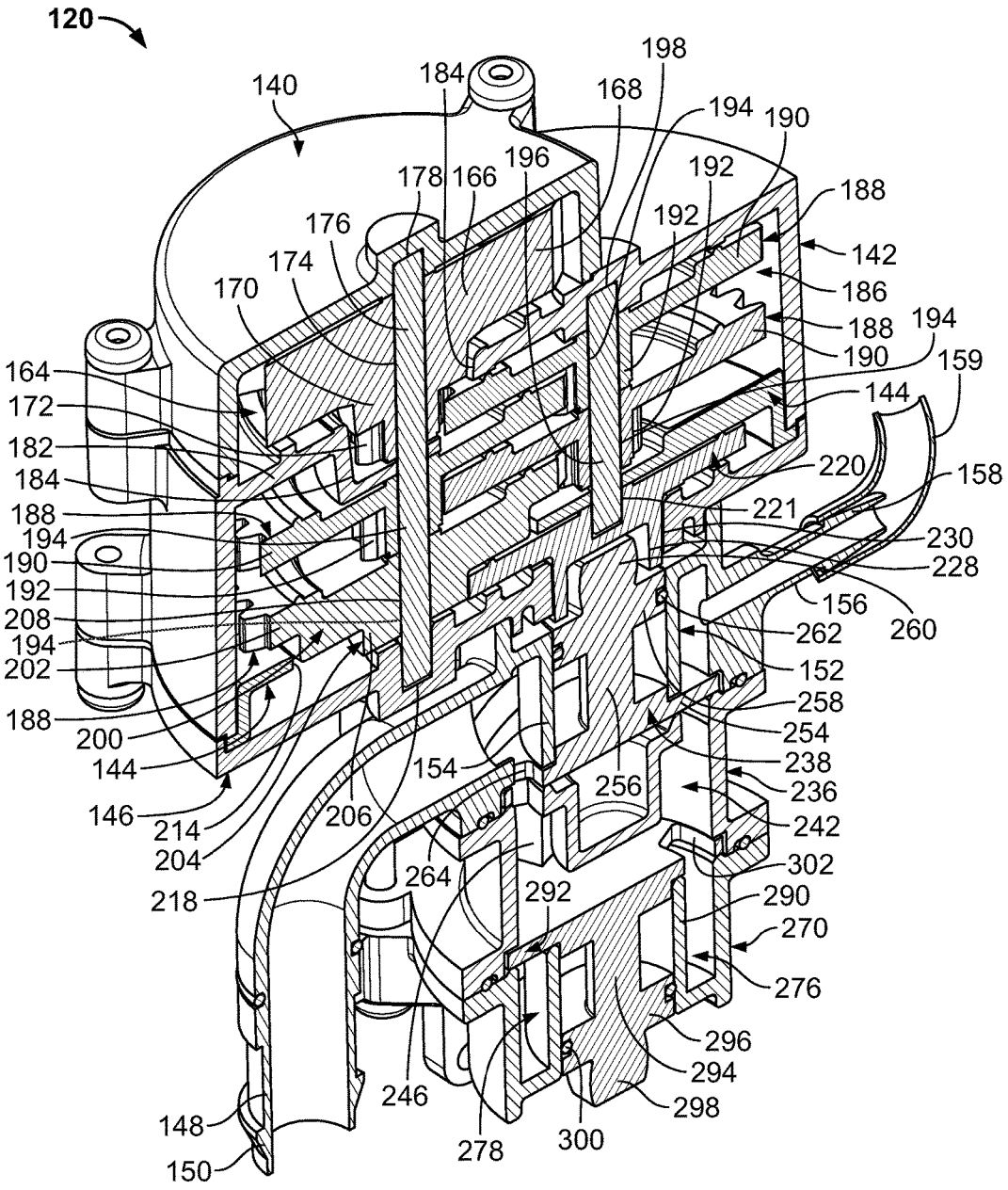
FIG. 25 is a sectional view of the drive assembly of the present disclosure take along line 25-25 of FIG. 22.

In operation, rotation of the drive gear 202 (see FIG. 25) results in rotation of the Geneva drive gear 204 (see FIG. 25). Accordingly, because the Geneva gear central hub 206 and the Geneva gear post 210 are a part of the Geneva drive gear 204, and thus attached to the underside of the drive gear 202, they rotate about the first shaft 176. The Geneva gear post 210 is positioned radially and at a distance from the central hub 206 so that it can engage the Geneva gear 220. Similarly, the Geneva gear 220 is sized so that each of the cogs 222 can be positioned adjacent the Geneva dive gear central hub 206. Additionally, the Geneva gear 220 is sized so that the Geneva gear post 210 can be inserted into the slots 224. When the Geneva drive gear 204 is rotated, the post 210 orbits the central aperture 208, while the central hub 206 rotates adjacent an arced removed portion 226 of an adjacent cog 222. Accordingly, the central hub 206 does not engage the cogs 222. Continued rotation of the Geneva drive gear 204 results in the post 210 making a full orbit about the central aperture 208 until it reaches a point where it intersects a cog slot 224. Further rotation of the post 210 causes the post 210 to enter a slot 224 and engage a side wall of a cog 222, pushing the cog in the rotational direction of the post 210. To facilitate this rotation, the removed portion 212 of the central hub 206 allows any extraneous portions of the cogs 222 that would otherwise contact the central hub 206 to instead move within the removed portion 212. Thus, the central hub 206 does not restrict the Geneva gear 220 from rotating. As the post 210 rotates while engaging the cog 222 it pushes the cog 222 and causes the entire Geneva gear 220 to rotate in an opposite direction than the rotational direction of the post 210. The post 210 does not continually rotate the Geneva gear 220 for the entirety of the rotational cycle of the post 210, but instead acts as an incremental rotation device that "clicks" a cog 222 over one position while it engages the cog 222. As such, the Geneva gear 220 has a series of distinct positions, with the number of distinct positions being based on the number of cogs 222. Here, there are eight cogs 222, so there are eight distinct positions, e.g., each position being at 45°. Therefore, the entire Geneva gear 220 is rotated, or "clicked" over, 45° per rotational cycle of the post 210, as opposed to continuous rotation if this were a standard gear. Accordingly, the Geneva gear 220 does not gradually switch positions, but is instead more quickly "clicked" over to a new position. The Geneva gear 220 can be altered to accommodate different scenarios that could require lesser or greater angular positioning of the Geneva gear 220, for example if it is required for there to be 20° positioning, then the Geneva gear could include eighteen cogs and eighteen slots.

Referring back to FIG. 25, rotation of the Geneva gear 220 causes conjoint rotation of the Geneva gear socket 228 within the upper housing Geneva output aperture 230. The Geneva gear socket 228 rotationally engages a drive head 260 of a reverse/skim-out valve selector 238, which will be discussed in greater detail.

Figure 28:
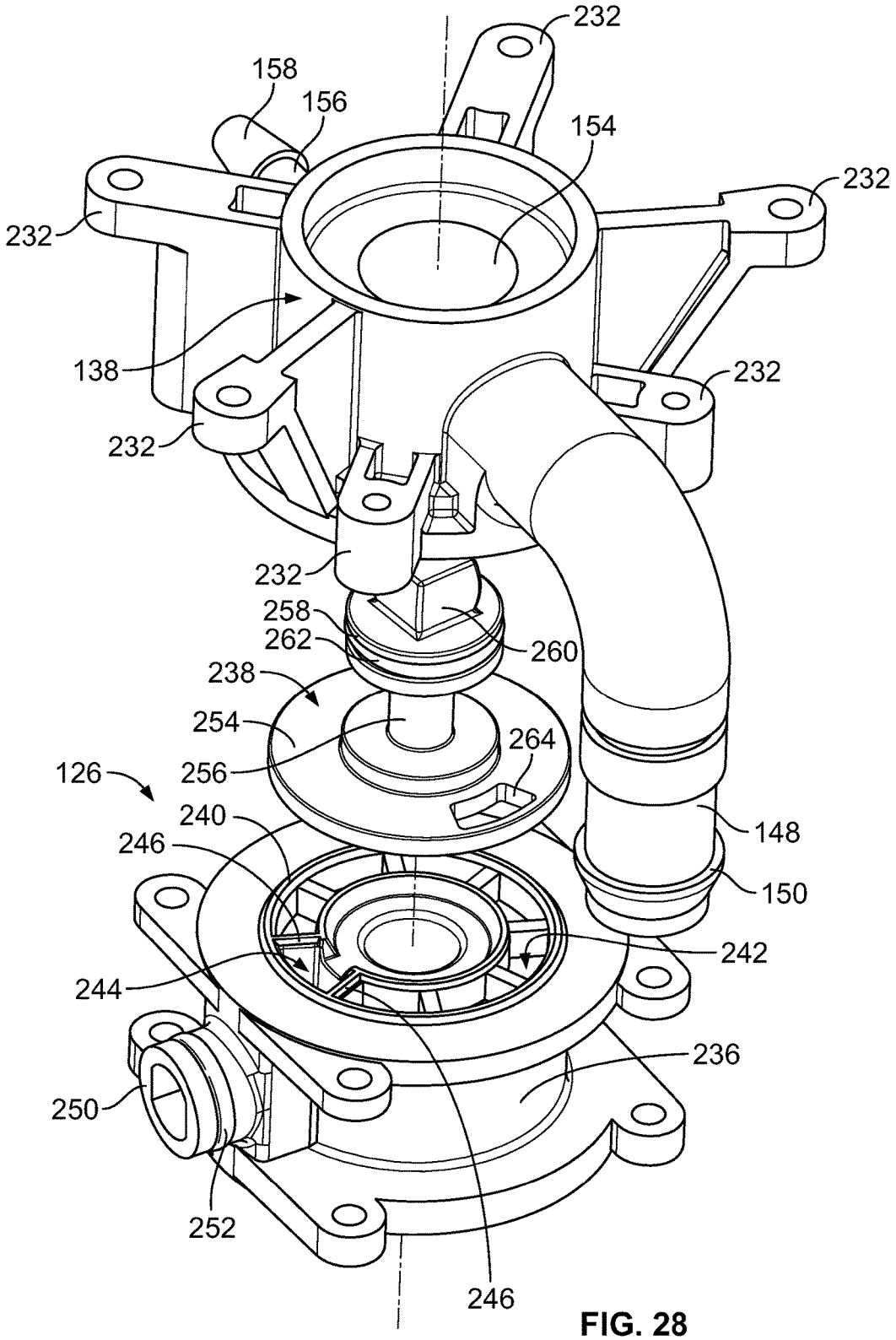
FIG. 28 is an exploded view of the reverse/spin-out mode assembly of the present disclosure.
Figure 29:
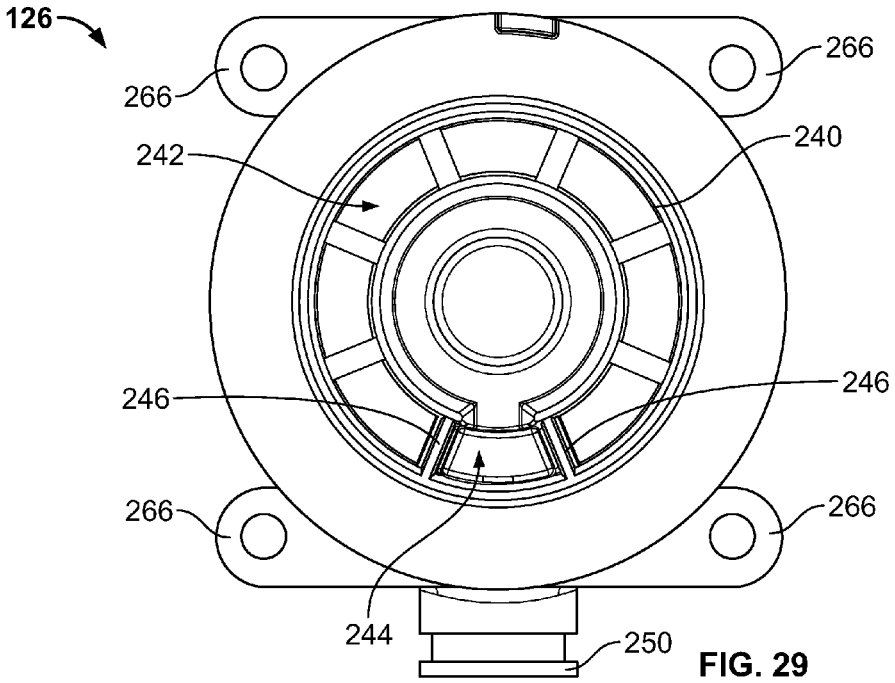
FIG. 29 is a front view of the reverse/spinout mode valve body of the present disclosure.
Figure 30:
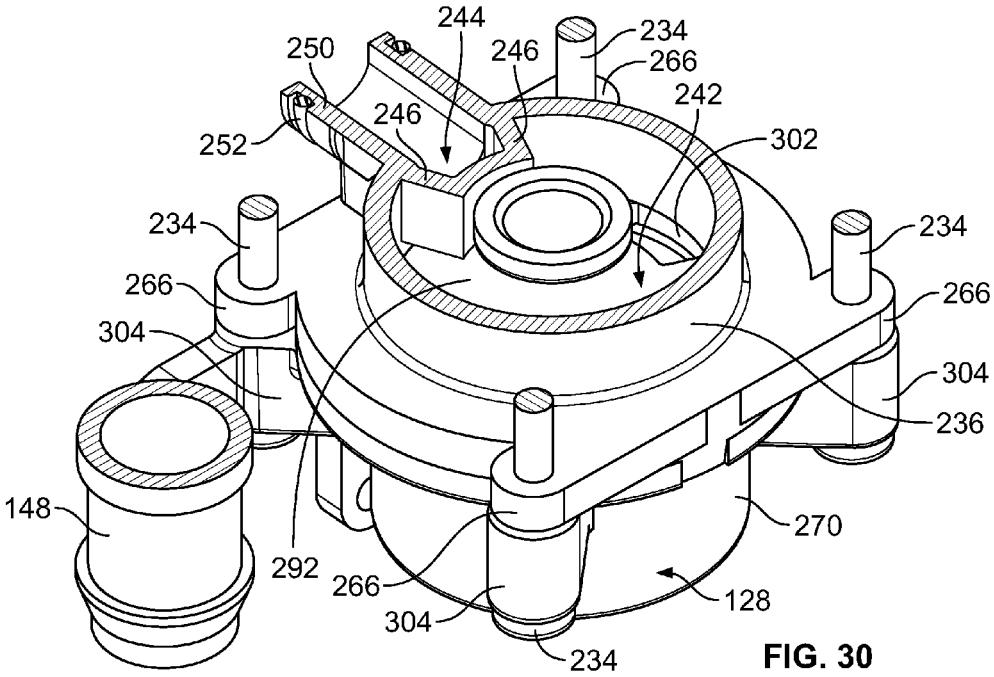
FIG. 30 is a sectional view of the reverse/spin-out mode assembly of the present disclosure take along line 30-30 of FIG. 20 showing the fluid chambers.

FIGS. 28-30 show the reverse/spin-out mode assembly 126 in greater detail. FIG. 28 is an exploded view of the reverse/spin-out mode assembly 126, and the inlet body 138. The reverse/spin-out mode assembly 126 includes a reverse/spin-out mode valve body 236 and a reverse/skim-out mode valve selector 238. The reverse/spin-out mode valve body 236 includes an opening 240, an internal forward drive chamber 242, an internal reverse drive chamber 244, and a plurality of dividers 246 that separate the internal forward drive chamber 242 and the internal reverse drive chamber 244. As can be seen, internal structural support ribs are provided within the chamber 242, as shown in FIG. 28.

The reverse/spin-out mode valve selector 238 includes a valve disk 254, a shaft 256, an enlarged section 258, a drive head 260, and an o-ring 262. The valve disk 254 is generally circular in geometry and sized to match the reverse/spin-out mode valve body opening 240. The valve disk 254 includes a window 264 that is positioned on the outer periphery of the valve disk 254. The window 264 extends through the valve disk 254, and generally spans an angular distance about the circumference equal to a single position of the Geneva gear cog 222. More specifically, in the current example, there are eight cogs 222 at eight distinct positions, e.g., each position being at 45°. Accordingly, the window 264 extends an angular distance of 45° about the circumference of the valve disk 254, which matches the expanse of a single cog 222, and the distance a single cog 222 travels during a single rotational cycle of the Geneva gear 220. The shaft 254 extends from the center of the valve disk 254 to an enlarged section 258. The enlarged section 258 is generally circular in shape and sized to be inserted into, and rotate within, the central hub 154 of the inlet body 138. The enlarged section 258 can include an o-ring 262 about the periphery for creating a seal radially against the central hub 154. The drive head 260 extends from the enlarged section 258 and includes a generally square geometry. Particularly, the drive head 260 is configured to engage the Geneva gear socket 228, such that rotation of the Geneva gear socket 228 rotationally drives the drive head 260. Accordingly, the drive head 260 and the Geneva gear socket 228 include mating geometries. Rotation of the drive head 260 results in rotation of the valve disk 254, and thus the window 264. The window 264 provides a pathway for water to flow through and into either the internal forward drive chamber 242 or the internal reverse drive chamber 244. Specifically, water enters the inlet body 138 at the inlet 148 and flows to the annular chamber 152. When in the annular chamber 152, the water flows in two directions, i.e., out through the outlet 156 and toward the opening 240 of the reverse/spin-out mode valve body 236. However, the water is restricted from entering the opening 240 of the reverse/spin-out mode valve body 236 by the reverse/spin-out valve selector 238. Accordingly, the water must flow through the window 264 of the reverse/spin-out valve selector 238, and into the reverse/spin-out valve body 236 (see FIG. 25).

Figure 20:
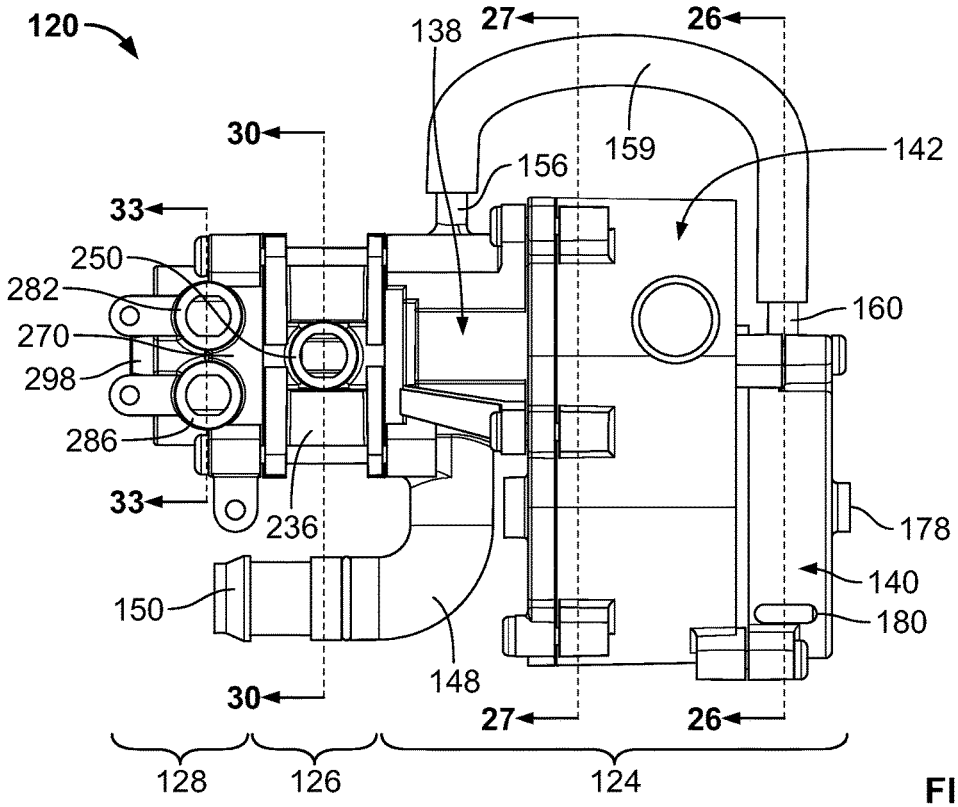
FIG. 20 is a top view of the drive assembly of the present disclosure.
Figure 21:
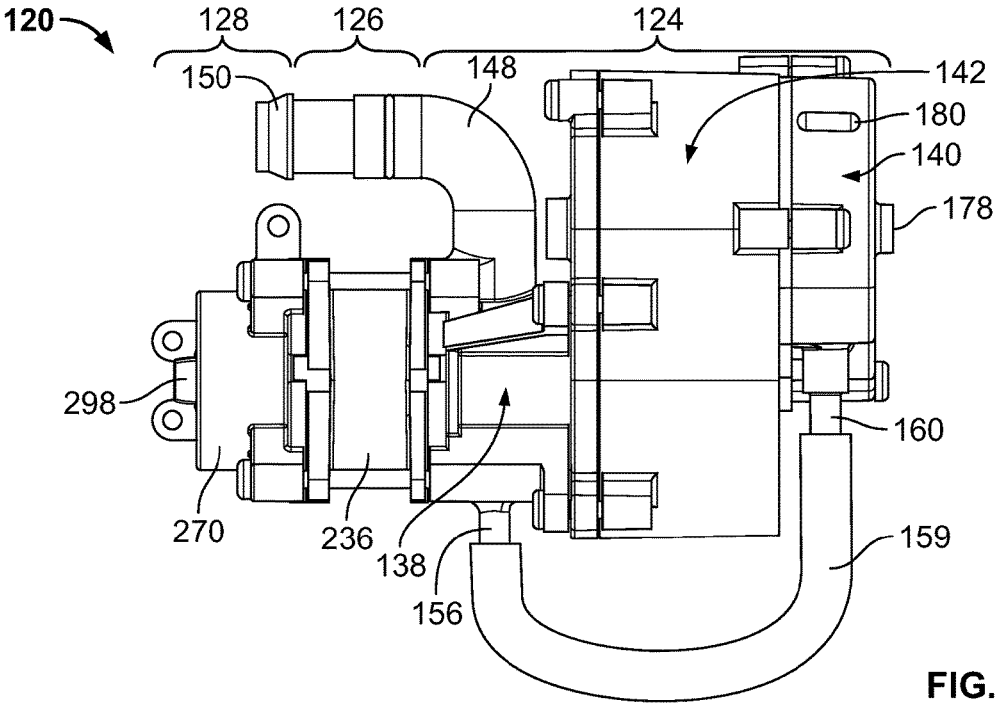
FIG. 21 is a bottom view of the drive assembly of the present disclosure.
Figure 22:
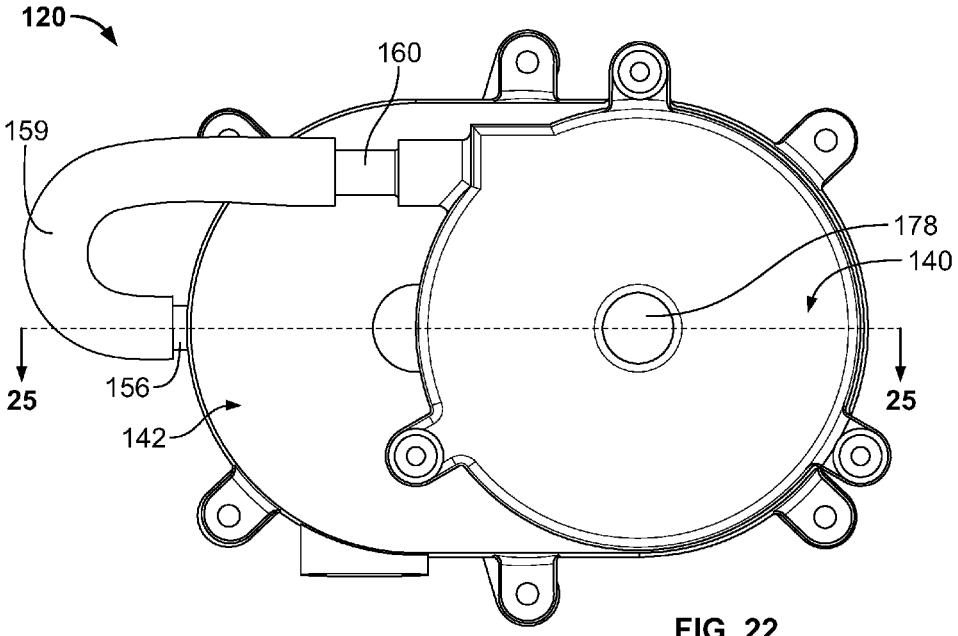
FIG. 22 is a front view of the drive assembly of the present disclosure.
Figure 23:
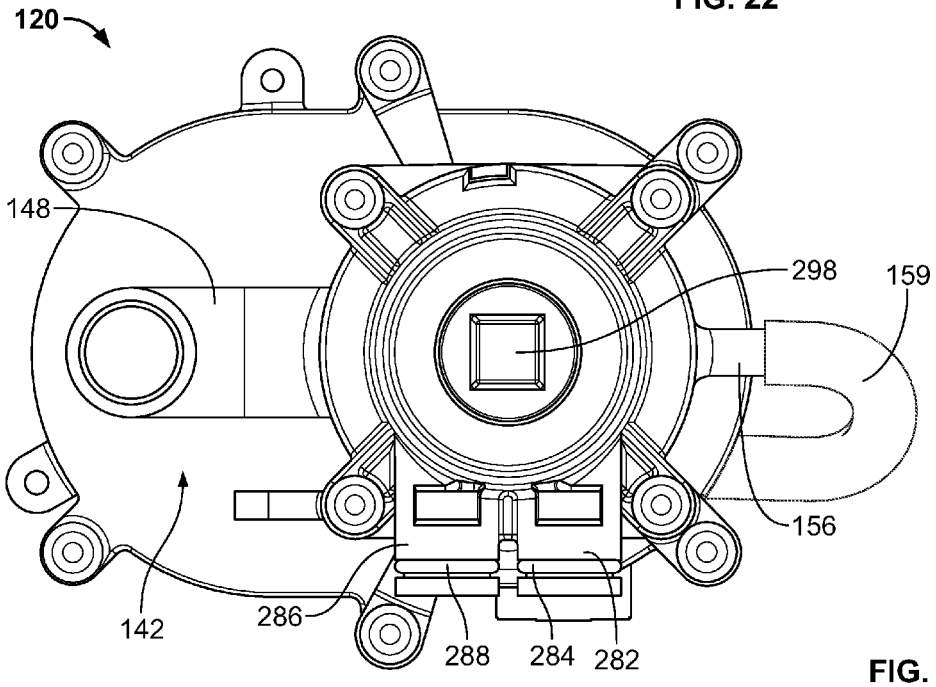
FIG. 23 is a rear view of the drive assembly of the present disclosure.
Figure 24:
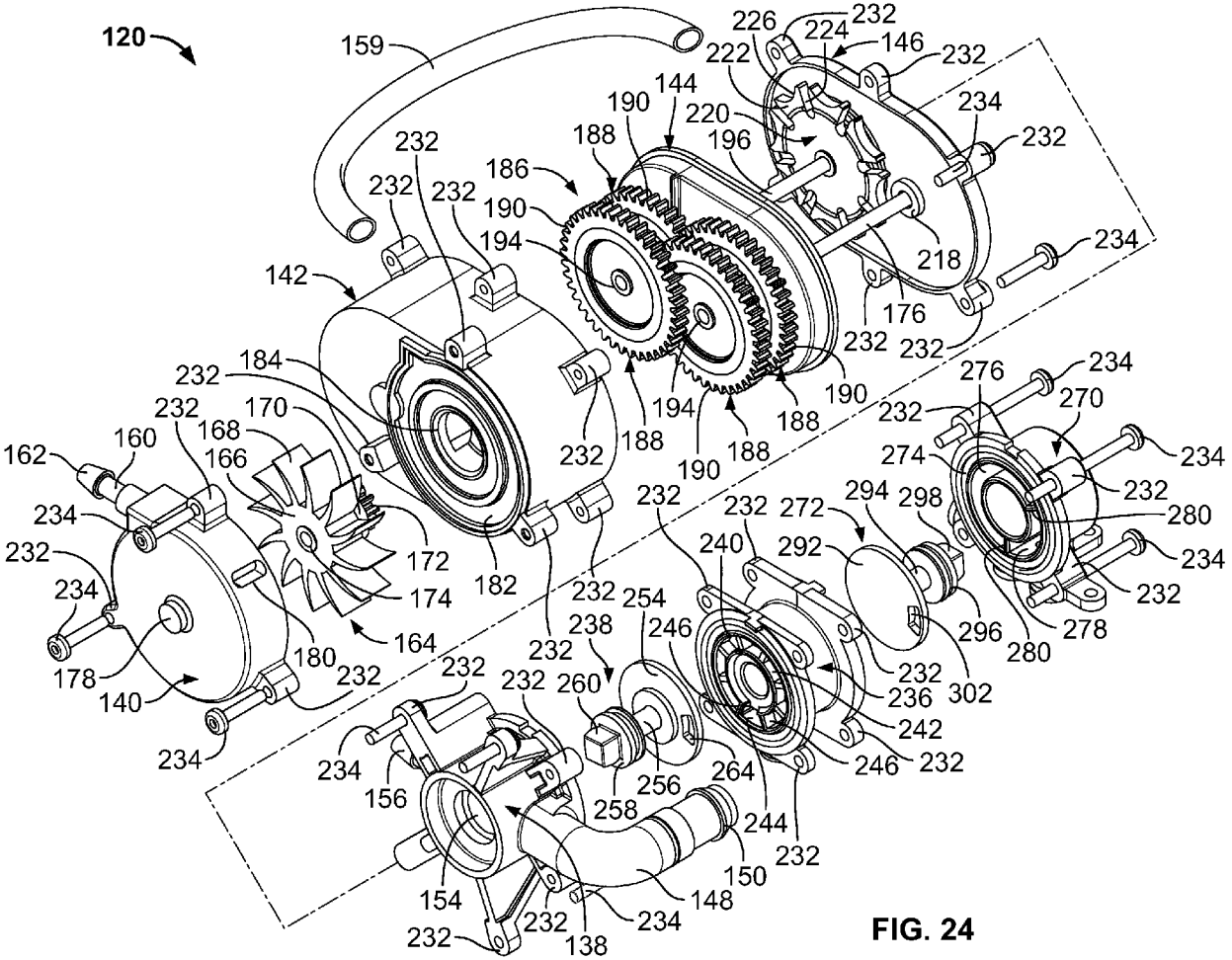
FIG. 24 is an exploded perspective view of the drive assembly of the present disclosure.

FIG. 29 is a top view of the reverse/spin-out mode valve body 236, and FIG. 30 is a sectional view of the reverse/spin-out mode valve body 236 taken along line 30-30 of FIG. 20. The window 264 generally includes eight different positions, which are based on the eight cog 222 positions. One of these positions is adjacent the internal reverse drive chamber 244, and seven of these positions are adjacent the internal forward drive chamber 242. The Geneva gear 220 drivingly rotates the valve disk 254, and the window 264, 45° at a time so that the window 264 switches between the eight different positions for each rotation of the Geneva drive gear 204. As shown in FIG. 30, the internal forward drive chamber 242 encompasses approximately seven of the eight sections, while the internal reverse drive chamber 244 encompasses a single section. Accordingly, the window 264 will be positioned adjacent the internal forward drive chamber 242 for approximately $7/8^{ths}$ of the time, and will be positioned adjacent the internal reverse drive chamber 244 for approximately $1/8^{th}$ of the time. As mentioned previously, the Geneva gear 220 functions to quickly rotate 45° at a time so that the window 264 swiftly rotates from one position to the next, instead of gradually moving from one position to the next. Accordingly, the time spent by the window 264 adjacent both the internal reverse drive chamber 244 and the internal forward drive chamber 242 when the window 264 is switching between these two chambers is minimized.

The internal reverse drive chamber 244 is in fluidic communication with a reverse/spinout outlet port 250 that can include an o-ring 252. The reverse/spinout outlet port 250 is connected with the water distribution manifold 122, and is discussed in greater detail below. The internal forward drive chamber 242 is connected with the open bottom of the reverse/spin-out mode valve body 236 for the water to flow to the top/bottom mode valve body 270. Each of the inlet body 138, turbine housing 140, gear box 142, Geneva gear upper housing 146, reverse/spin-out mode valve body 236, and top/bottom mode valve body 270 can include a plurality of coaxially aligned mounting brackets 232 that allow connection by a plurality of bolts 234.

Figure 31:
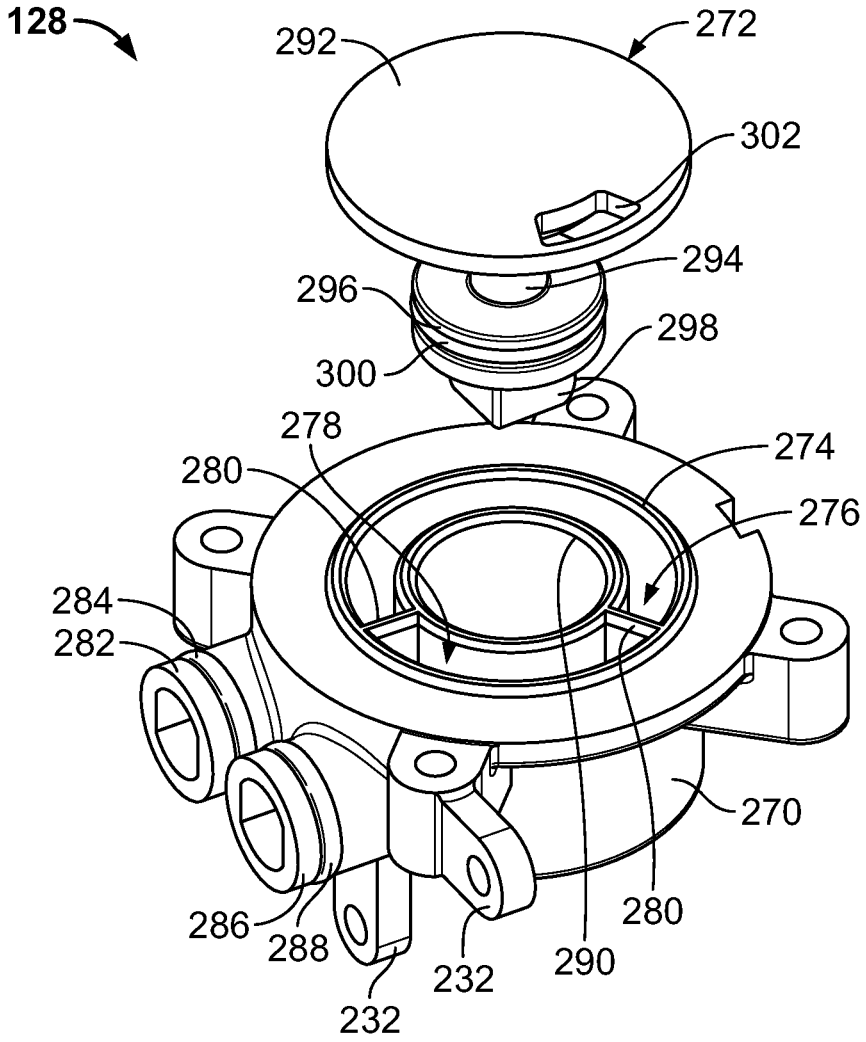
FIG. 31 is an exploded view of the top/bottom mode assembly of the present disclosure.
Figure 32:
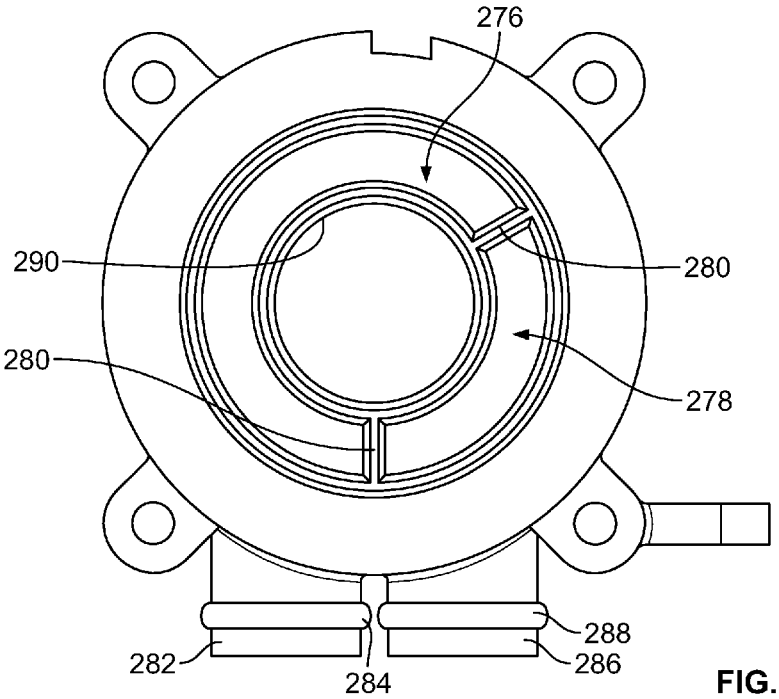
FIG. 32 is a front view of the top/bottom mode valve body of the present disclosure.
Figure 33:
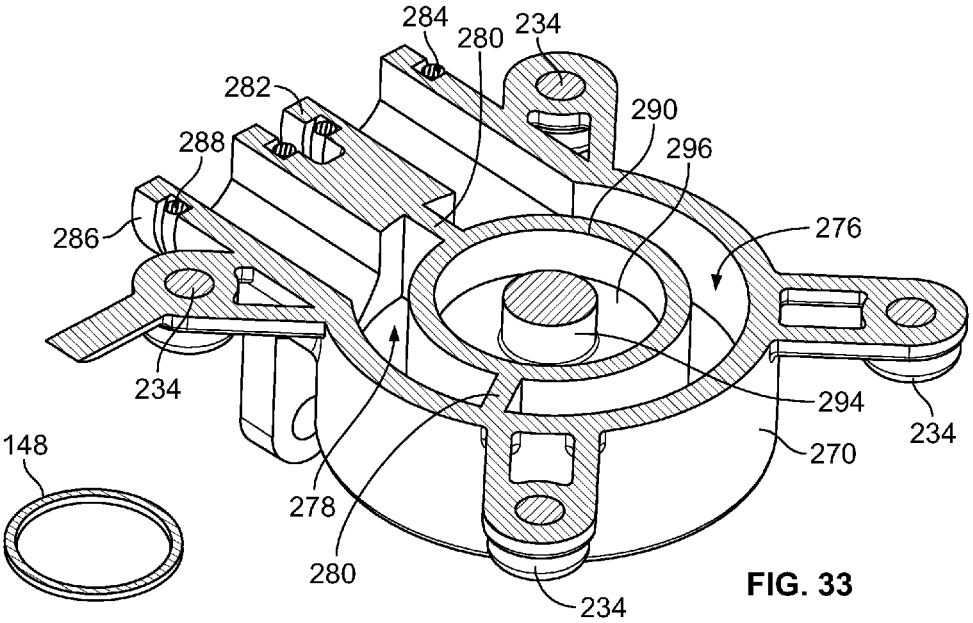
FIG. 33 is a sectional view of the top/bottom mode assembly of the present disclosure take along line 33-33 of FIG. 20 showing the fluid chambers and ports.
Figure 34:
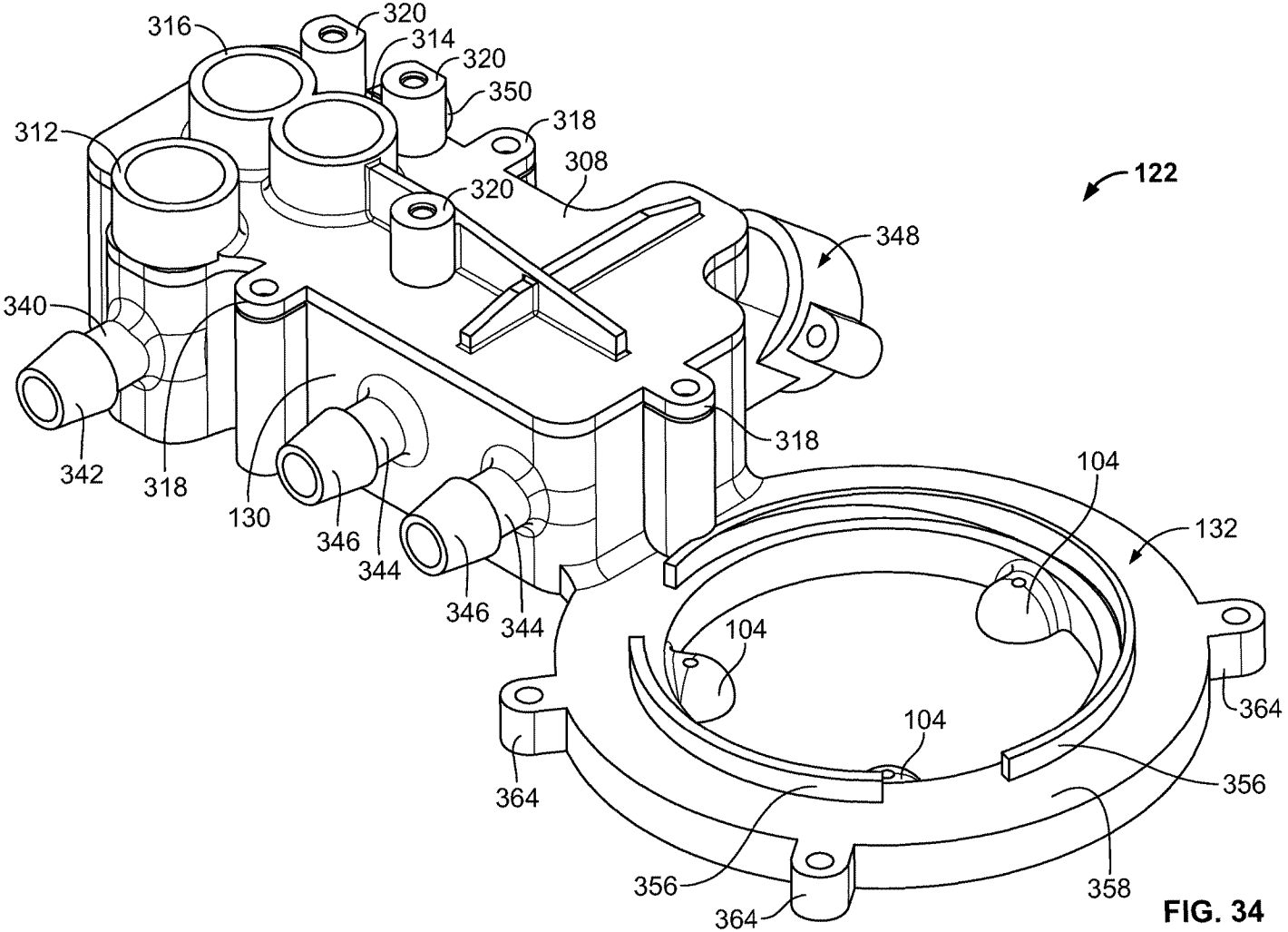
FIG. 34 is a first perspective view of the flow manifold and suction jet ring of the present disclosure.
Figure 35:
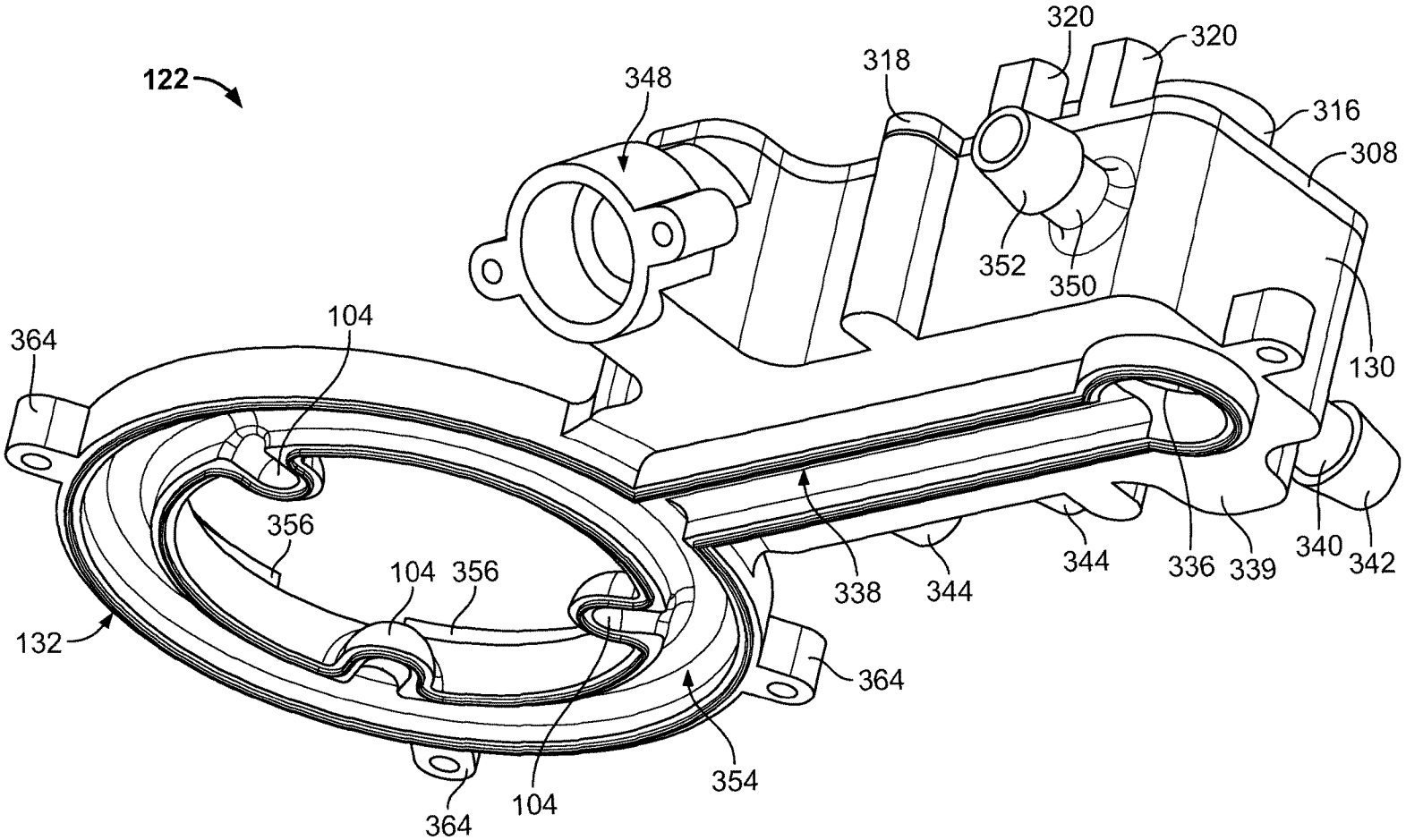
FIG. 35 is a second perspective view of the flow manifold and suction jet ring of the present disclosure.
Figure 36:
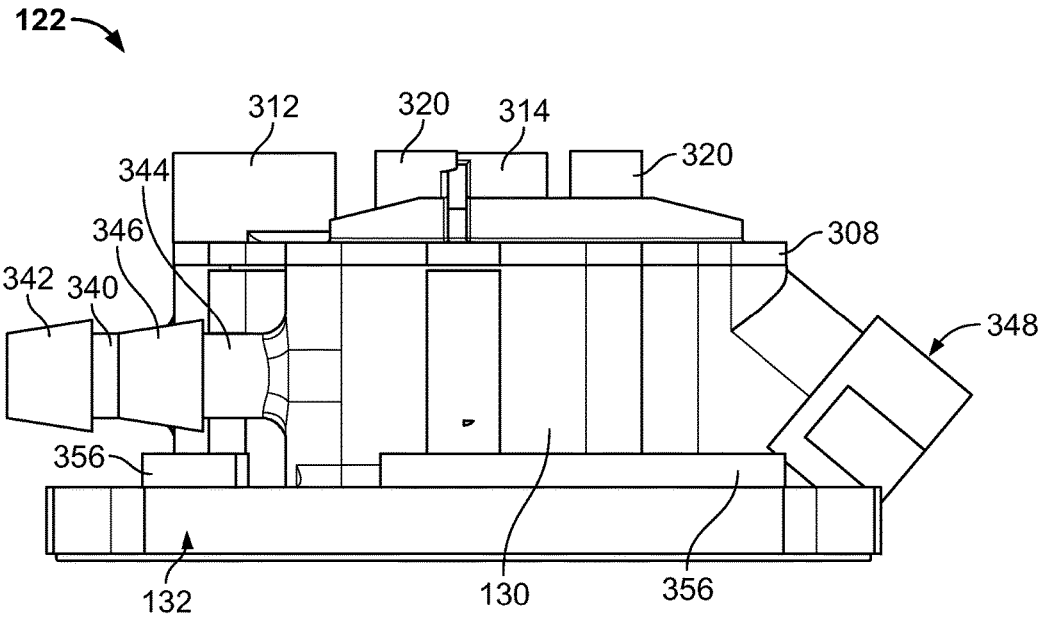
FIG. 36 is a right side view of the flow manifold and suction jet ring of the present disclosure.
Figure 37:
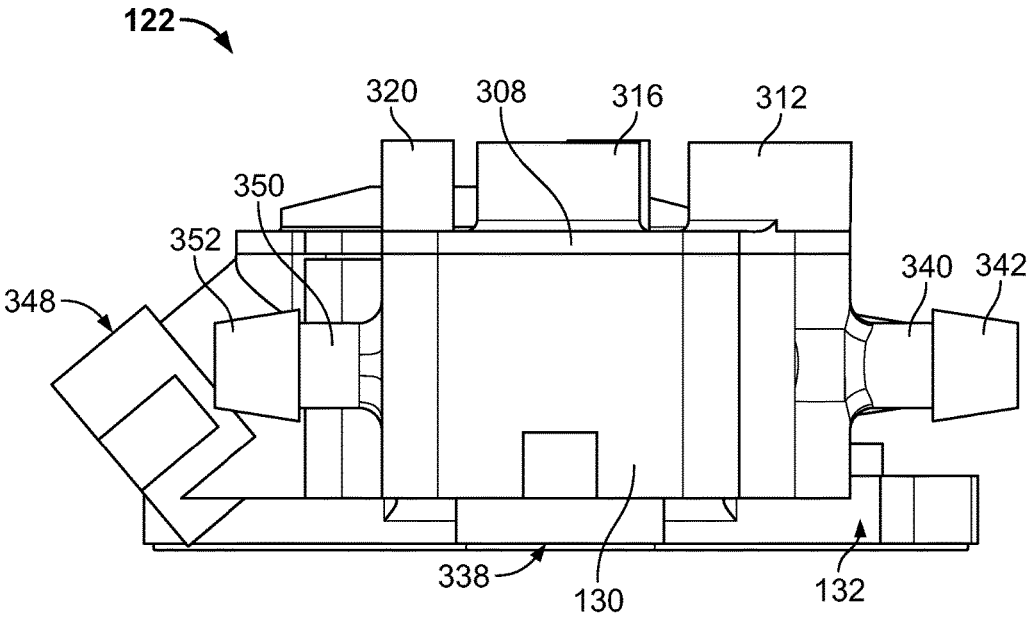
FIG. 37 is a left side view of the flow manifold and suction jet ring of the present disclosure.

FIGS. 31-33 show the top/bottom mode assembly 128 in greater detail. FIG. 31 is an exploded view of the top/bottom mode assembly 128. The top/bottom mode assembly 128 includes a top/bottom mode valve body 270 and a top/bottom mode valve selector 272. The top/bottom mode valve body 270 includes and upper opening 274, an internal bottom mode chamber 276, an internal top mode chamber 278, and a plurality of dividers 280 that separate the internal bottom mode chamber 276 and the internal top mode chamber 278. The top/bottom mode valve body 270 is closed at the bottom. The internal bottom mode chamber 277 is connected, and in fluidic communication, with a bottom mode outlet port 282 that can include an o-ring 284. The internal top mode chamber 278 is connected, and in fluidic communication, with a top mode outlet port 286 that can include an o-ring 288. The top/bottom mode valve body 270 also includes a central hub 290 that is positioned within and is coaxial with the top/bottom mode valve body 270. The central hub 290 is hollow and extends from the upper opening 274 through the bottom of the top/bottom mode valve body 270. The central hub 290 is connected with the dividers 280. The internal bottom mode chamber 276 and the internal top mode chamber 278 extend about the circumference of the central hub 290.

The top/bottom mode valve selector 272 includes a valve disk 292, a shaft 294, an enlarged section 296, an engageable drive head 298, and an o-ring 300 about the enlarged section 296. The drive head 298 is configured to be engaged by a user, such that a tool can be used to engage the head 298 and rotate the top/bottom mode valve selector 272 to select a desired mode of operation. The valve disk 292 is generally circular in geometry and sized to match the top/bottom mode valve body upper opening 270. The valve disk 292 includes a window 302 that is positioned on the outer periphery of the valve disk 292. The window 302 extends through the valve disk 292. The shaft 294 extends from the center of the valve disk 292 to the enlarged section 296. The enlarged section 296 is generally circular in shape and sized to be inserted into, and rotate within, the central hub 290. The enlarged section 296 can include the o-ring 262 about the periphery for creating a seal radially against the central hub 290. The drive head 298 extends from the enlarged section 296, and includes a geometry that facilitates engagement. For example, the drive head 298 can include a square or hexagonal geometry, or alternatively can include a flat slot for engagement with a flat-head screwdriver, or a crossed slot for engagement with a Phillips-head screwdriver. Rotation of the drive head 298 results in rotation of the valve disk 292, and thus the window 302. The window 302 provides a pathway for water to flow through and into either the internal bottom mode chamber 276 or the internal top mode chamber 278. Specifically, water that flows through the internal forward drive chamber 242 of the reverse/spin-out mode valve body 236 can pass through the window 302 to enter the top/bottom mode valve body 270. The top/bottom mode valve body 270 chamber that the water enters, e.g., the internal bottom mode chamber 276 and the internal top mode chamber 278, depends on the positioning of the window 302. That is, when the window 302 is positioned adjacent the internal bottom mode chamber 276, due to engagement of the drive head 298 and rotation of the valve disk 292, water will flow into the internal bottom mode chamber 276. On the other hand, if the window 302 is positioned adjacent the internal top mode chamber 278, water will flow into the internal top mode chamber 276.

FIG. 32 is a top view of the top/bottom mode valve body 128, and FIG. 33 is a sectional view of the top/bottom mode valve body 128 taken along line 33-33 of FIG. 20. As can be seen, the internal bottom mode chamber 276 and the internal top mode chamber 278 are generally divided by the central hub 290 and the plurality of dividers 280. The internal bottom mode chamber 276 is connected with the bottom mode outlet port 282, while the internal top mode chamber 278 is connected with the top mode outlet port 286. Accordingly, water that flows into the internal bottom mode chamber 276 will flow out from the bottom mode outlet port 282, while water that flows into the internal top mode chamber 278 will flow out from the top mode outlet port 286. The bottom mode outlet port 282 and the top mode outlet port 286 are connected with the water distribution manifold 122, which will be discussed in greater detail.

FIGS. 34-43 show the water distribution manifold 122 in greater detail. Specific reference is made to FIGS. 34-35, which are perspective views of the water distribution manifold 122. The water distribution manifold 122 includes a manifold top 308, the manifold body 130, and the jet ring 132. The manifold top 308 includes three inlets, a reverse/spinout inlet 312, a top mode inlet 314, and a bottom mode inlet 316. The manifold top 308 also includes a plurality of mounting tabs 318 for engagement with the manifold body 130, and a plurality of mounting risers 320 for engagement with the mounting brackets 232 of the top/bottom mode valve body 270. The reverse/spinout inlet 312 is generally connected with the reverse/spinout outlet port 250 of the reverse/spinout mode valve body 236, such that the reverse/spinout outlet port 250 is inserted into the reverse/spinout inlet 312 and the o-ring 252 creates a seal radially against a wall of the reverse/spinout inlet 312. The top mode inlet 314 is generally connected with the top mode outlet port 286 of the top/bottom mode valve body 270, such that the top mode outlet port 286 is inserted into the top mode inlet 314 and the o-ring 288 creates a seal radially against a wall of the top mode inlet 314. The bottom mode inlet 316 is generally connected with the bottom mode outlet port 282 of the top/bottom mode valve body 270, such that the bottom mode outlet port 282 is inserted into the bottom mode inlet 316 and the o-ring 284 creates a seal radially against a wall of the bottom mode inlet 316. The manifold top 308 is positioned on top of the manifold body 130.

Figure 38:
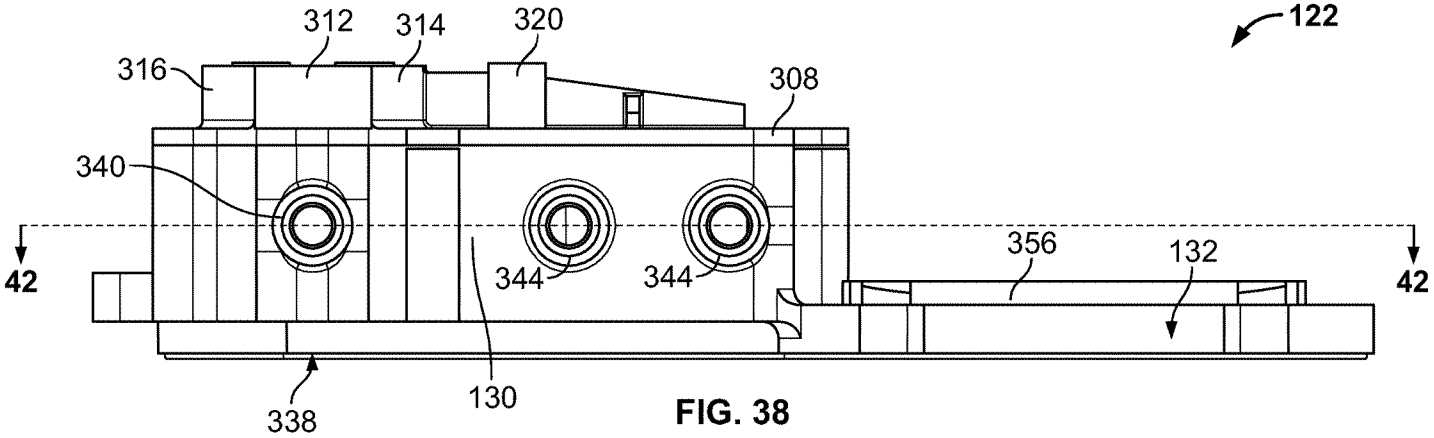
FIG. 38 is a front view of the flow manifold and suction jet ring of the present disclosure.
Figure 39:
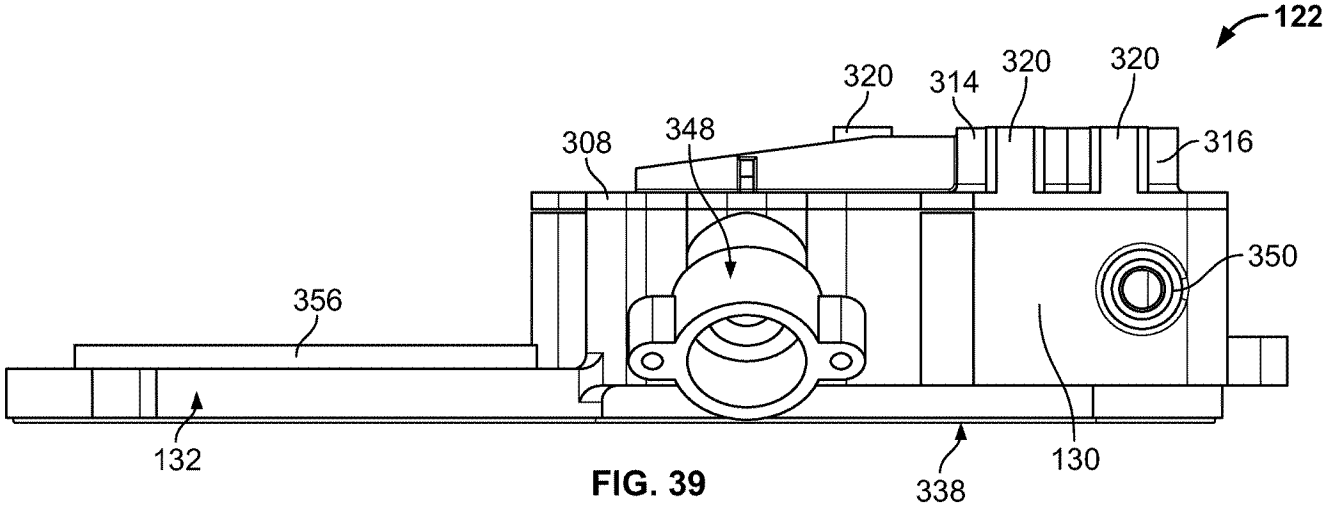
FIG. 39 is a rear view of the flow manifold and suction jet ring of the present disclosure.
Figure 42:
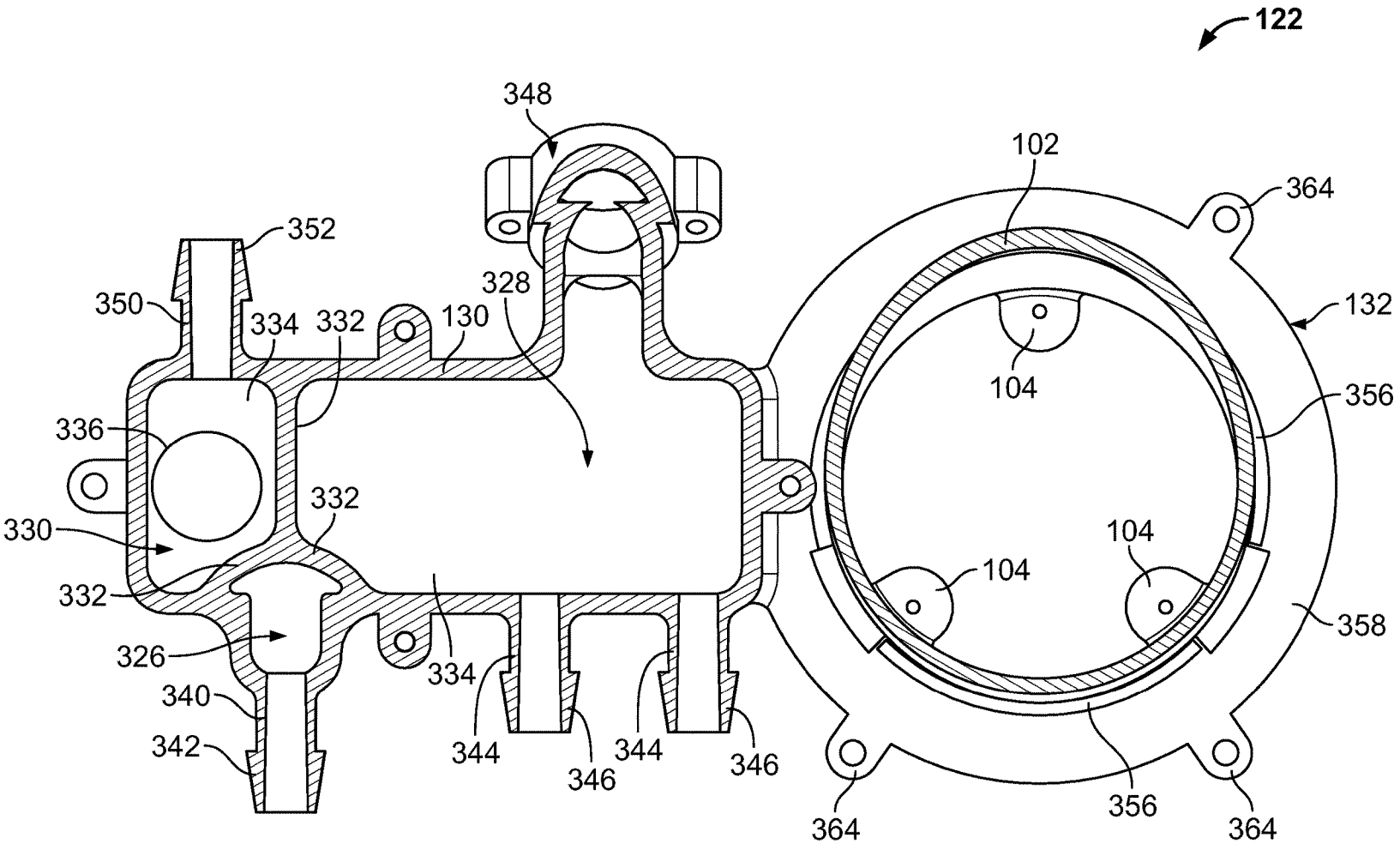
FIG. 42 is a cross-sectional view of the flow manifold and suction jet ring of the present disclosure taken along line 42-42 of FIG. 38.

FIG. 42 is a sectional view of the manifold body 130 taken along section line 42-42 of FIG. 38. The manifold body 130 defines a reverse/spinout mode chamber 326, a top mode chamber 328, and a bottom mode chamber 330. The reverse/spinout mode chamber 326, the top mode chamber 328, and the bottom mode chamber 330 are separated by a plurality of internal divider walls 332. The manifold body 130 includes a bottom wall 334 than includes an aperture 336 extending through a portion of the bottom wall 334 that forms the bottom mode chamber 330. The aperture 336 extends through the bottom wall 334 to a flow channel 338. The flow channel 338 is located on the bottom 339 of the manifold body bottom wall 334 and sealed with the channel 105 that is located on the bottom wall 70 of the chassis 32. Accordingly, a fluid-tight pathway is formed between the flow channel 338 and the chassis bottom wall channel 105. A gasket may be provided between the flow channel 338 and the chassis bottom wall channel 105 to facilitate formation of a seal.

The chassis body 130 also includes a reverse/spinout outlet 340 having a barbed end 342, two top mode skimmer outlets 344 each having a barbed end 346, a top mode jet nozzle housing 348, and a bottom mode outlet 350 having a barbed end 352. The reverse/spinout outlet 340 is in fluidic communication with the reverse/spinout mode chamber 326. Accordingly, water that flows into the reverse/spinout mode chamber 326 flows out from the reverse/spinout outlet 340. A first hose 119*a* (see FIG. 11) is connected to the reverse/spinout outlet 340 at one end, and to the reverse/spin-out thrust jet nozzle inlet 116 (see FIG. 11) at the other end. The barbed end 342 facilities attachment of the first hose 119*a* to the reverse/spinout outlet 340 while the inlet barb 118 facilitates attachment of the first hose 119*a* to the inlet 116. Water provided from the reverse/spinout outlet 340 to the inlet 116 is forced out the outlet 114 under pressure causing a jet of pressurized water directed generally forward. This jet of pressurized water causes the cleaner 10 to move in a rearward direction. Alternatively, the reverse/spin-out thrust jet nozzle 112 may be positioned at an angle to the chassis 32 such that it causes an angular movement of the cleaner 10, e.g., a "spin-out," instead of rearward movement of the cleaner 10. In either configuration, the reverse/spin-out thrust jet nozzle 112 functions to occasionally cause the cleaner 10 to move in a reverse motion or spin-out motion so that if it is ever stuck in a corner of the pool 12, or stuck on an obstruction in the pool 12, such as a pool toy or pool ornamentation, it will free itself and continue to clean the pool 12.

Figure 13:
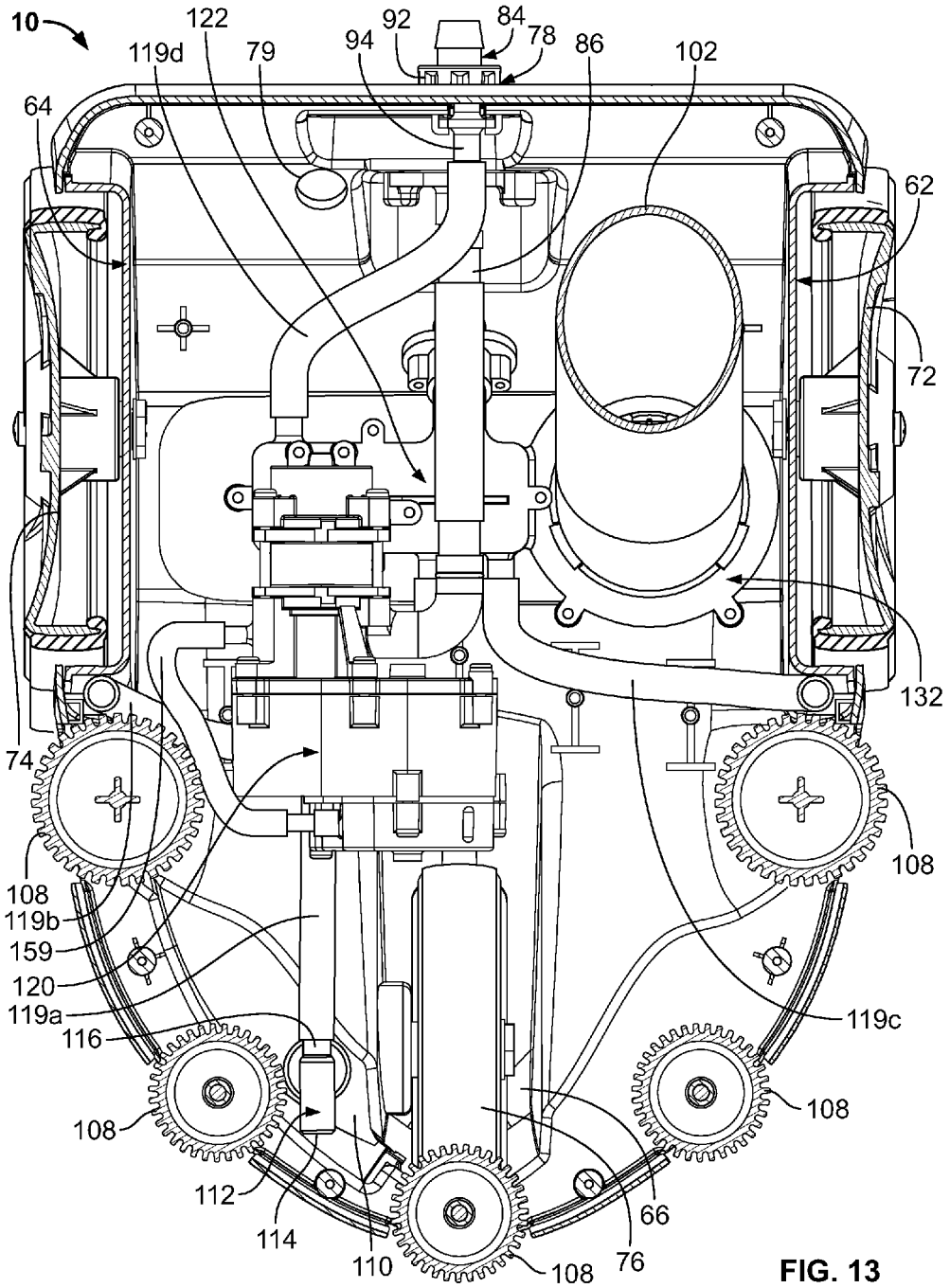
FIG. 13 is a cross-sectional view of the pool cleaner of the present disclosure taken along line 13-13 of FIG. 5.
Figure 14:
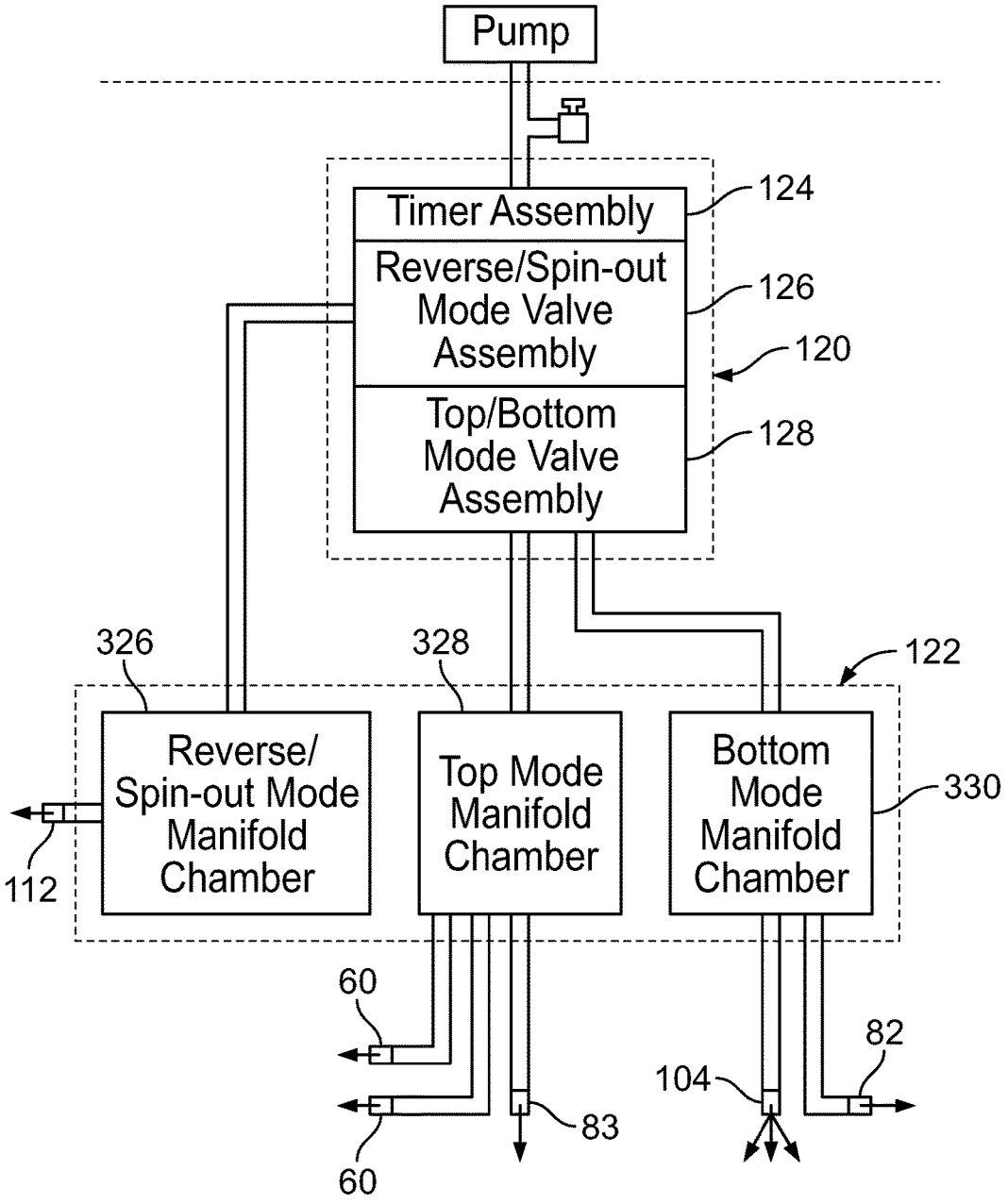
FIG. 14 is a schematic diagram of the water distribution and timing system of the pool cleaner of the present disclosure.
Figure 15:
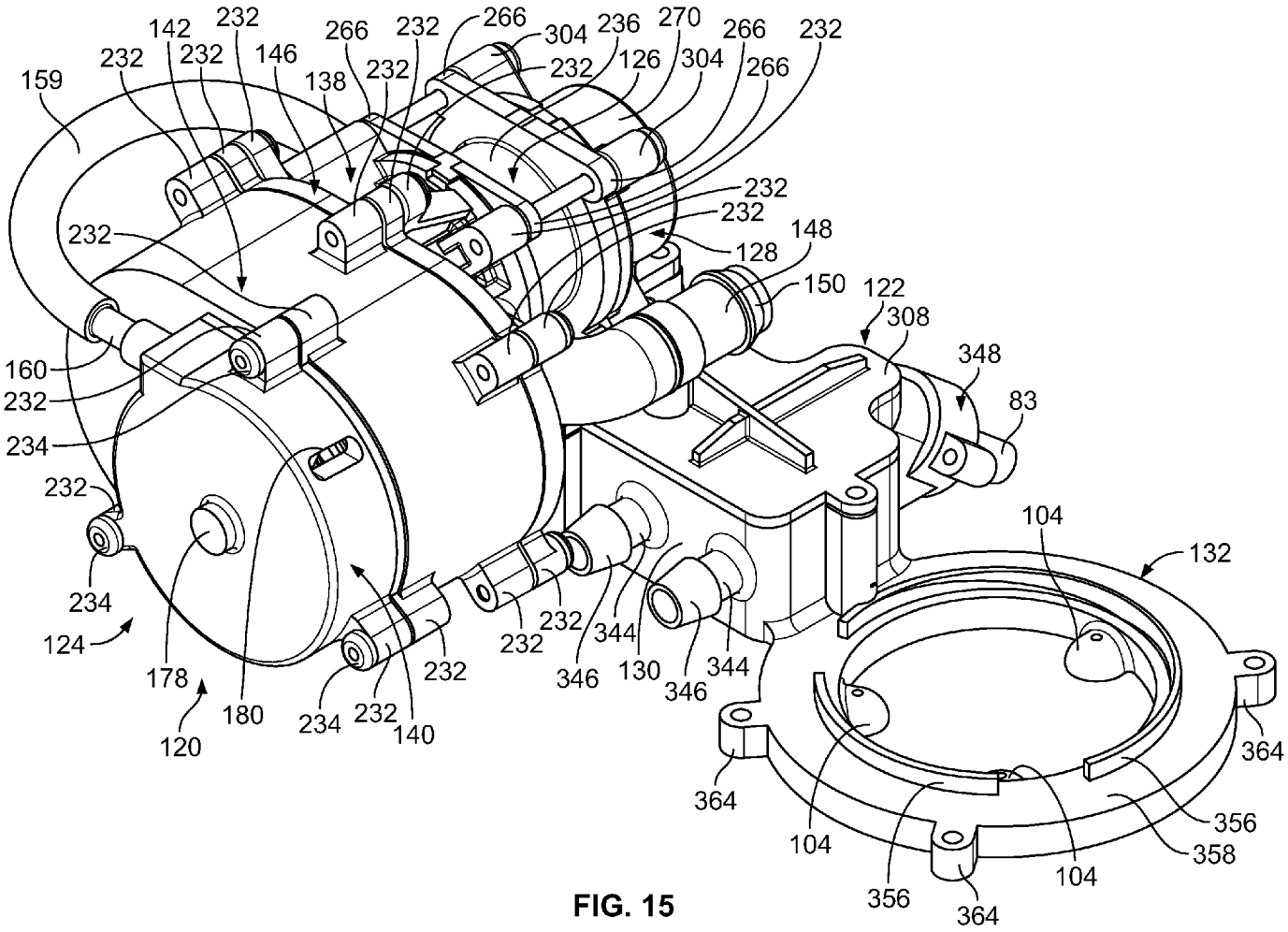
FIG. 15 is a first perspective view of the drive assembly and flow manifold of the pool cleaner of the present disclosure.
Figure 16:
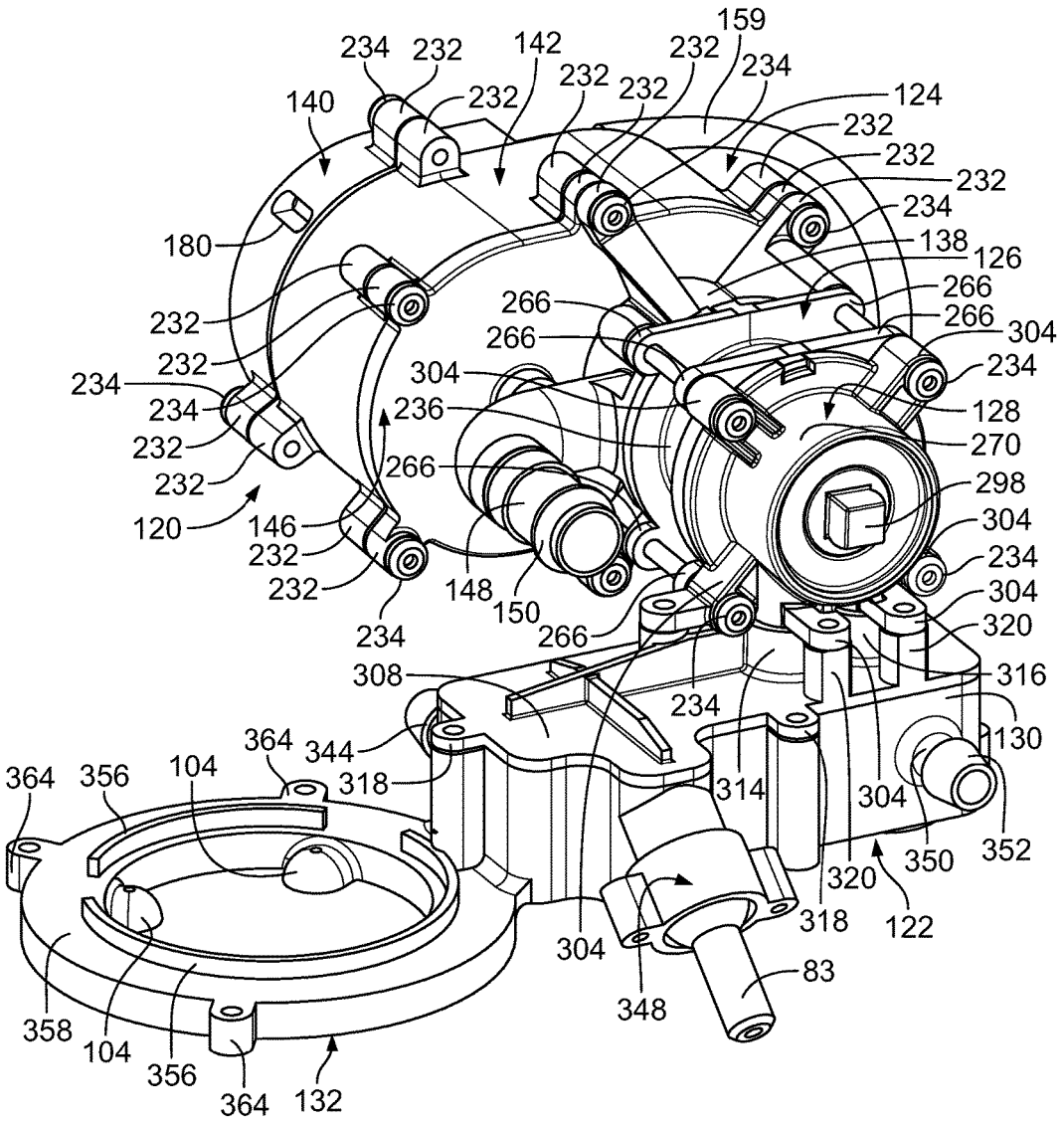
FIG. 16 is a second perspective view of the drive assembly and flow manifold of the pool cleaner of the present disclosure.
Figure 17:
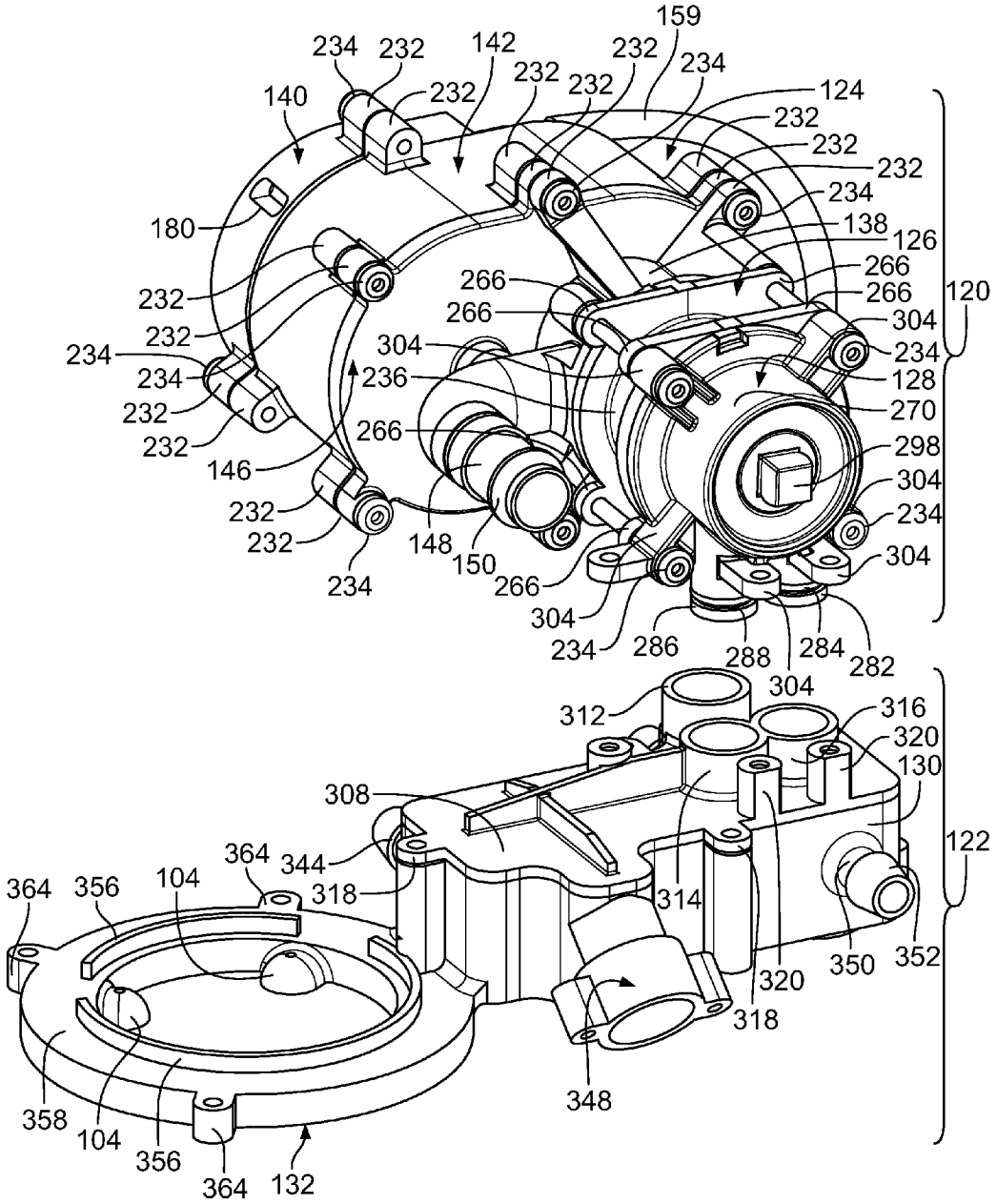
FIG. 17 is an exploded perspective view of the drive assembly and flow manifold of the pool cleaner of the present disclosure.
Figure 18:
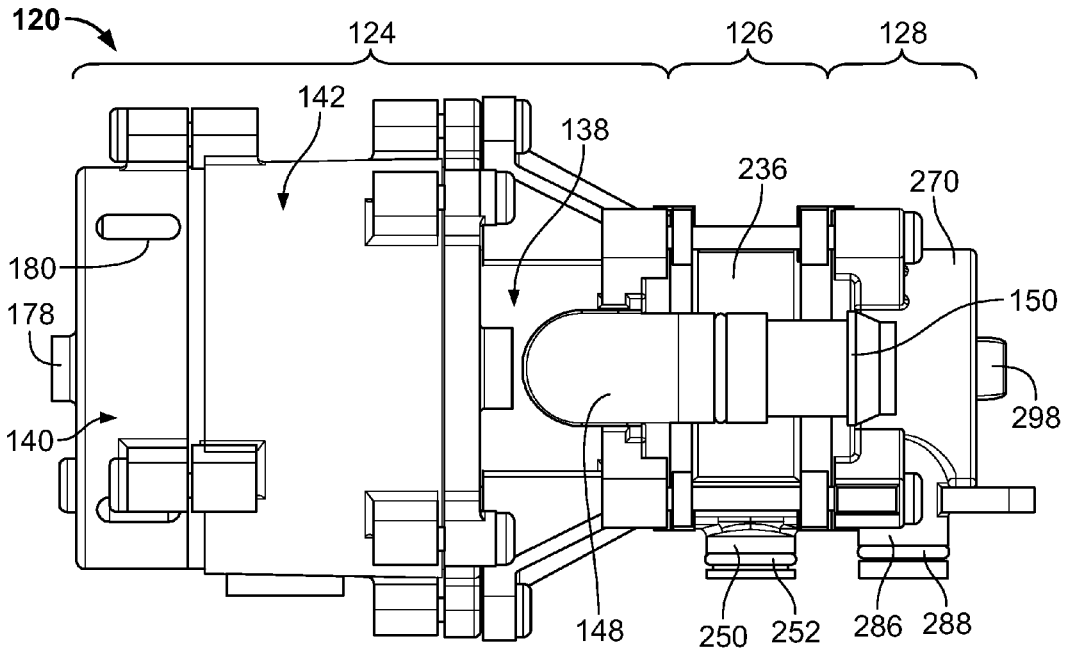
FIG. 18 is a right side view of the drive assembly of the present disclosure.
Figure 19:
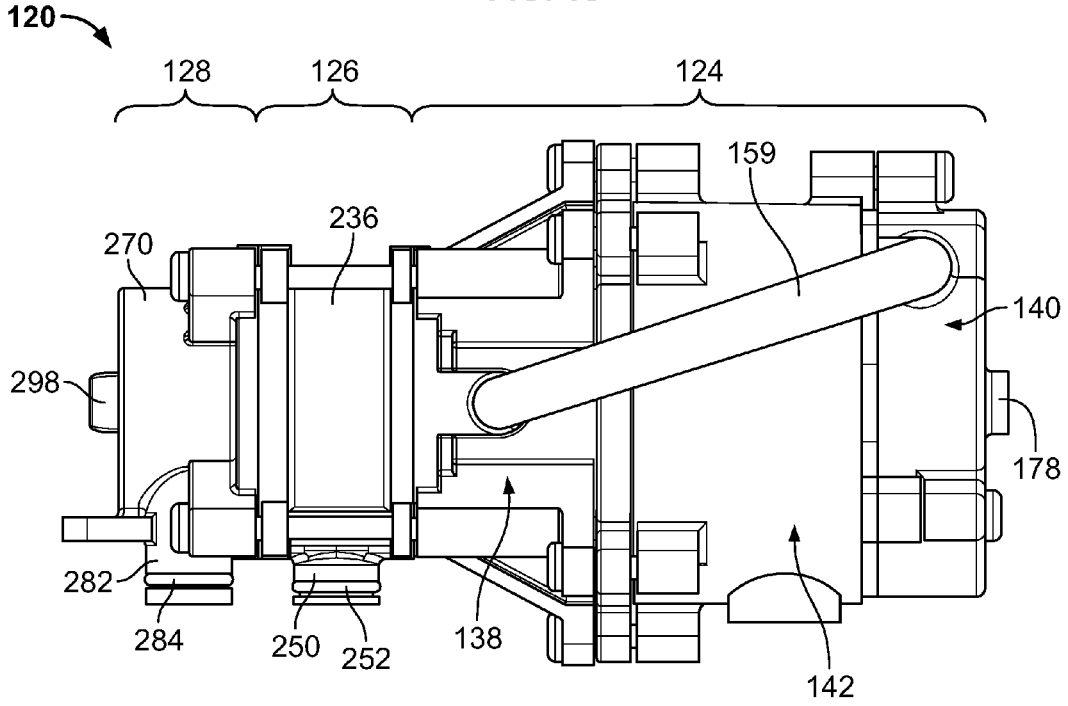
FIG. 19 is a left side view of the drive assembly of the present disclosure.

The top mode skimmer outlets 344 and the top mode jet nozzle housing 348 are in fluidic communication with the top mode chamber 328. The top mode jet nozzle housing 348 houses the skim mode jet nozzle 83. Accordingly, water that flows into the top mode chamber 328 flows out from the top mode skimmer outlets 344, and the top mode jet nozzle 83. A second hose 119*b* (see FIG. 13) is connected to one of the top mode skimmer outlets 344 at one end, and a third hose

119*c* (see FIG. 13) is connected to the other top mode skimmer outlet 344 at one end. The barbed ends 346 facilitate attachment of the second and third hoses 119*b*, 119*c* to the top mode skimmer outlets 344. The second and third hoses 119*b*, 119*c* are each respectively connected at their second end to one of the plurality of skimmer/debris retention jets 60, such that the skimmer/debris retention jets 60 spray pressurized water when water is provided to them by way of the top mode skimmer outlets 344. The skimmer/debris retention jets 60 function to force water and any debris that may be in the channel 40 rearward into the debris bag 54. Furthermore, the jetting of water rearward causes a venturi-like effect causing water that is more forward than the skimmer/debris retention jets 60 to be pulled rearward into the debris bag 54. Thus, the skimmer/debris retention jets 60 perform a skimming operation whereby debris is pulled and forced into the debris bag 54. Further, the skimmer/debris retention jets 60 prevent debris that is in the debris bag 54 from exiting. Additionally, water provided from the top mode chamber 328 to the top mode jet nozzle 83 is forced out the top mode jet nozzle 83 under pressure, causing a jet of pressurized water directed generally rearward and downward. This jet of pressurized water propels the cleaner 10 toward the pool water line 16 for skimming of the pool water line 16. When the cleaner 10 is skimming the pool water line 16, the top mode jet nozzle 83 propels the cleaner 10 forward along the pool water line 16.

Figure 40:
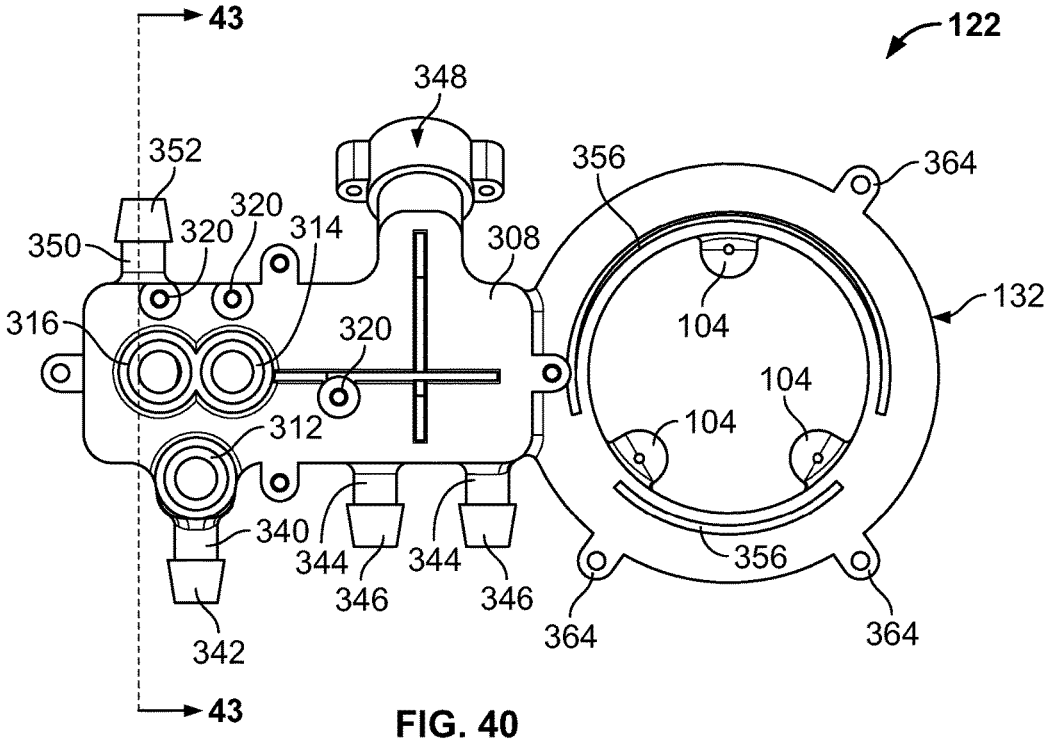
FIG. 40 is a top view of the flow manifold and suction jet ring of the present disclosure.
Figure 41:
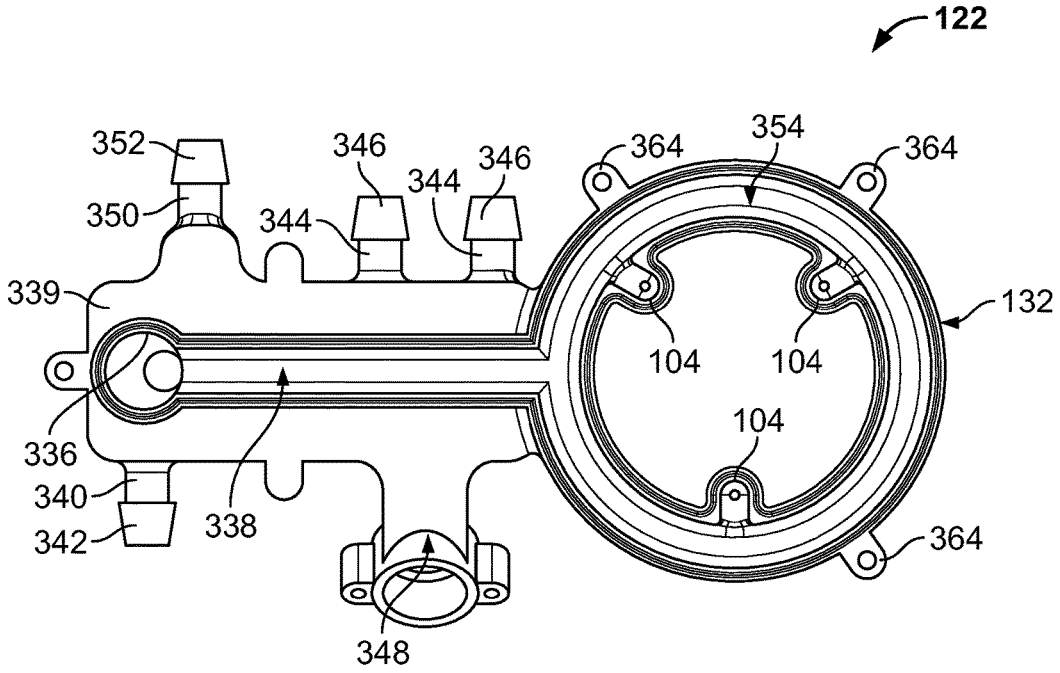
FIG. 41 is a bottom view of the flow manifold and suction jet ring of the present disclosure.
Figure 43:
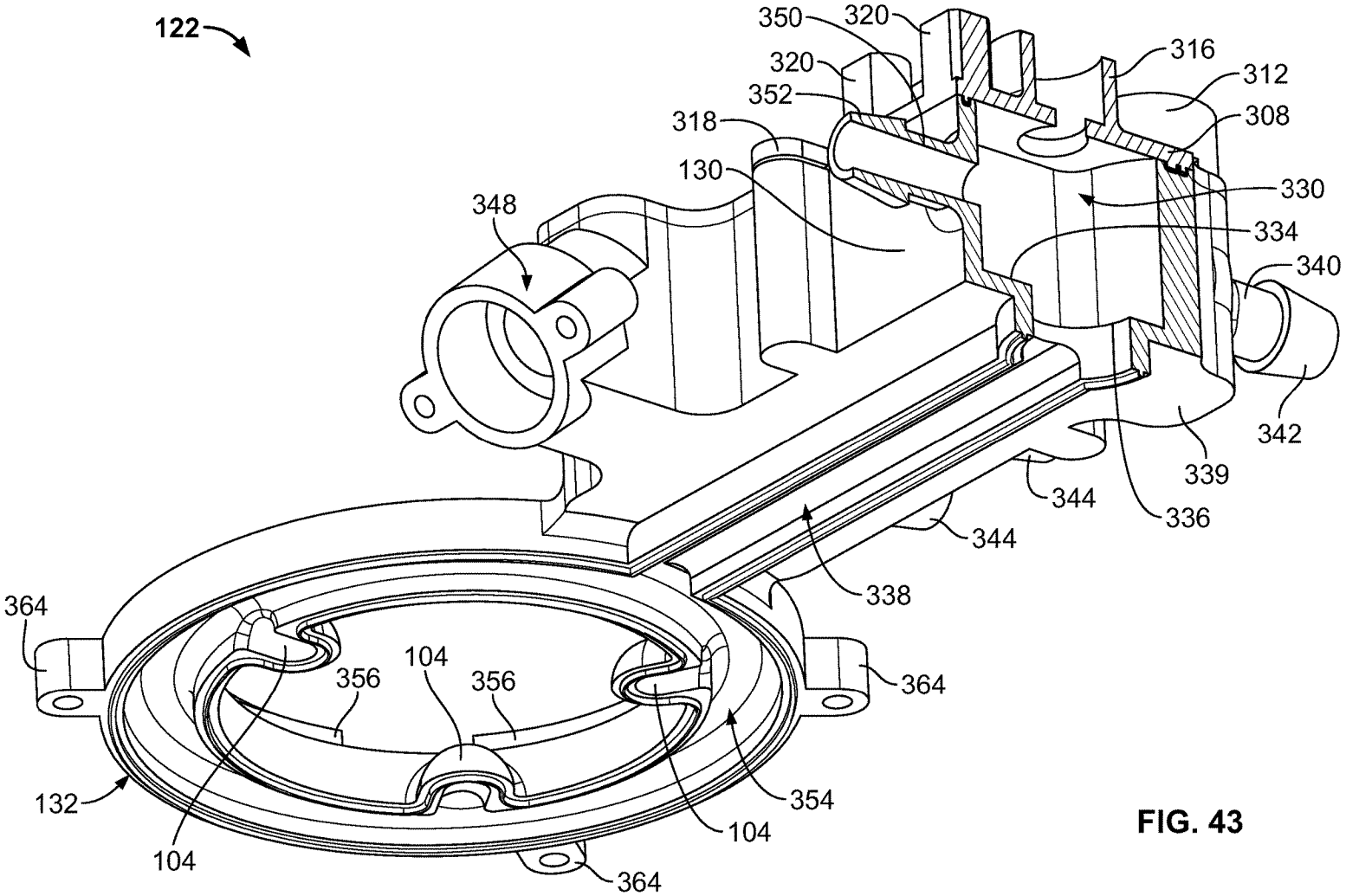
FIG. 43 is a sectional view of the flow manifold and suction jet ring of the present disclosure taken along line 43-43 of FIG. 40 showing the bottom mode flow path.

FIG. 43 is a sectional view of the manifold body 130 taken along line 43-43 of FIG. 40 showing the bottom mode chamber 330 in greater detail. The bottom mode outlet 350 is in fluidic communication with the bottom mode chamber 330. Additionally, as mentioned above, the bottom mode chamber 330 is in fluidic communication with the flow channel 338 through the aperture 336. The flow channel 338 extends across the bottom 339 of the manifold body 130 and to the jet ring 132. Accordingly, water that flows into the bottom mode chamber 330 flows out from the bottom mode outlet 350, and through the aperture 336. One end of a fourth hose 119*d* (see FIG. 13) is connected to the bottom mode outlet 350, and the second end is connected to the internal nozzle 94 of the forward thrust jet nozzle 82. The barbed end 352 and the internal nozzle barb 96 facilitate attachment of the fourth hose 119*b* to the bottom mode outlet 350 and the forward thrust jet nozzle 82, respectively. The fourth hose 119*d* provides water from the bottom mode outlet 350 to the forward thrust jet nozzle 82, such that the forward thrust jet nozzle 82 sprays pressurized water when water is provided thereto. The pressurized water is forced through the forward thrust jet nozzle 82 and out the forward thrust jet nozzle 82 under pressure, causing a jet of pressurized water directed generally rearward. This jet of pressurized water propels the cleaner 10 across the pool wall 14, e.g., the bottom of the pool, so that the cleaner 10 can clean the pool wall 14. In this regard, water that flows through the bottom mode chamber 330 also flows across the flow channel 338 and to the jet ring 132.

The jet ring 132 defines an annular flow channel 354 and includes a plurality of protrusions 356 extending from a top surface 358 of the jet ring 132. The bottom end 134 of the suction tube 102 can be positioned on the top surface 358 of the jet ring 132. The plurality of protrusions 356 can be inserted into the bottom end 134 of the suction tube 102, such that the protrusions 356 secure the suction tube 102 to the jet ring 132 and restrict the suction tube 102 from detaching from the jet ring 132. Accordingly, when the water distribution manifold 122 is secured within the chassis 32, the suction tube 102 extends from the jet ring 132 to the debris opening 58 of the top housing body 34. The annular flow channel 354 is in fluidic communication with the flow channel 338 and is sealed with the channel 105 that is located on the bottom wall 70 of the chassis 32. Accordingly, a fluid tight pathway is formed between the annular flow channel 354, the flow channel 338, and the chassis bottom wall channel 105. A gasket may be provided between the annular flow channel 354 and the flow channel 338, and the chassis bottom wall channel 105 to facilitate formation of a seal.

Figure 9:
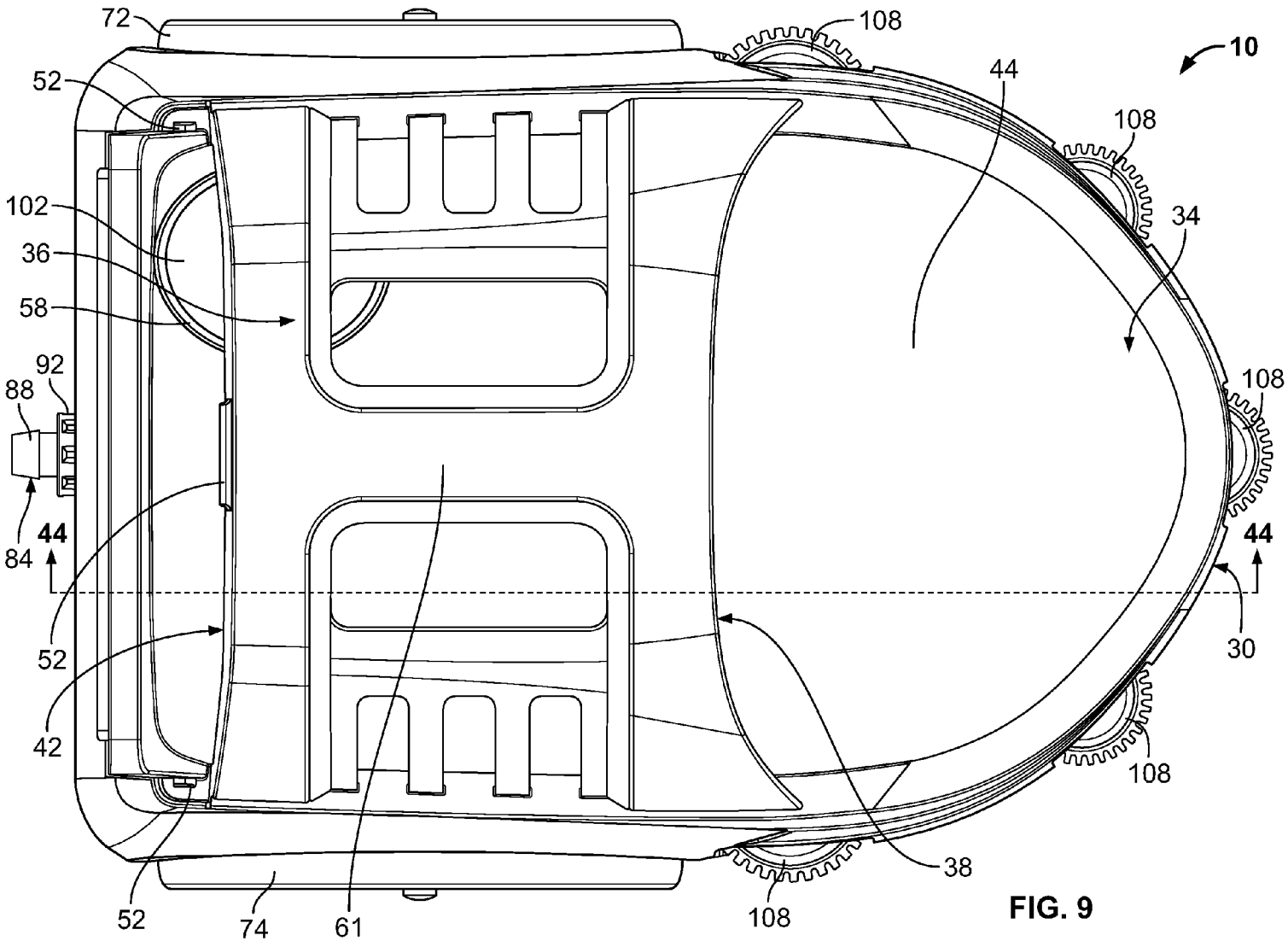
FIG. 9 is a top view of the pool cleaner of the present disclosure.
Figure 44:
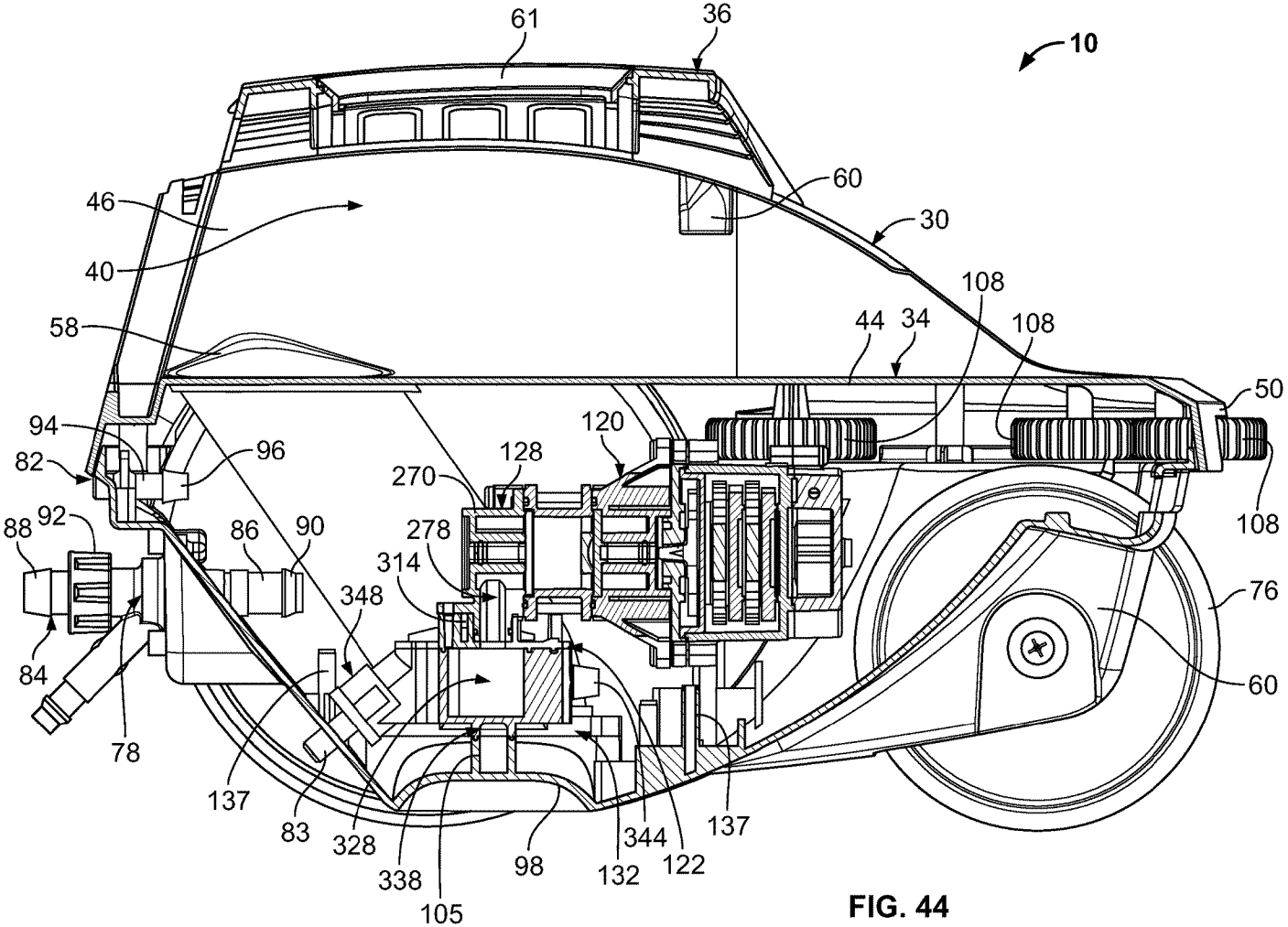
FIG. 44 is a cross-sectional view of the pool cleaner of the present disclosure taken along line 44-44 of FIG. 9.

FIG. 44 is a sectional view taken along line 44-44 of FIG. 9 showing the flow channel 338 connected with the channel 105 of the bottom wall 70. The jet ring 132 is positioned within the chassis 32 adjacent the suction aperture 100, and includes the plurality of suction jet nozzles 104 that are in fluidic communication with the annular flow channel 354 and positioned to discharge water through the suction tube 102. Accordingly, the suction jet nozzles 104 spray pressurized water when water is provided to them by way of the flow channel 338 and the annular flow channel 354. The suction jet nozzles 104 discharge pressurized water upward through the suction tube 102 toward the debris opening 58, forcing any loose debris through the suction aperture 100, across the suction tube 102, out the debris opening 58, and into the debris bag 54. Furthermore, the jetting of water upward through the suction tube 102 causes a venturi-like suction effect causing the suction head 98 to loosen debris from the pool walls 14 and direct the loosened debris into the suction aperture 100. This debris is forced through the suction tube 102 by the suction jet nozzles 104.

Figure 45:
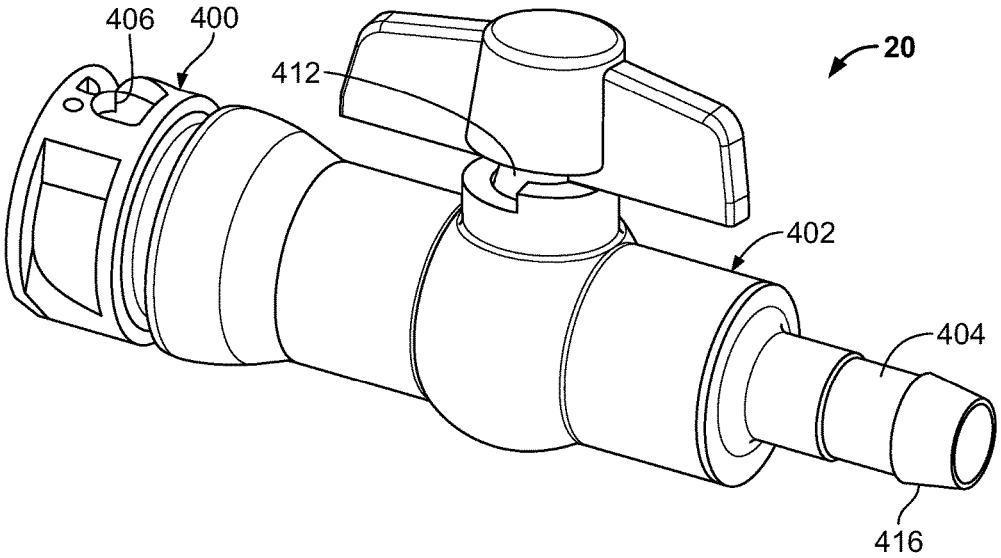
FIG. 45 is a perspective view of a hose connection of the present disclosure.
Figure 46:
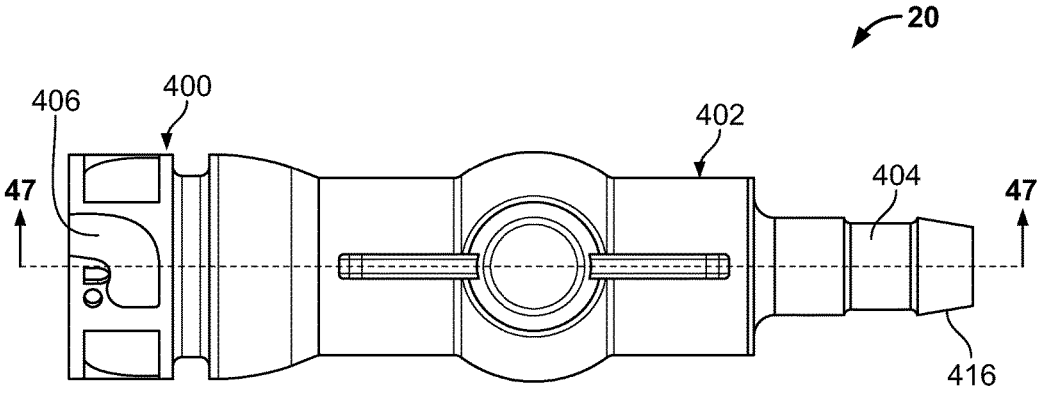
FIG. 46 is a top view of a hose connection of the present disclosure.
Figure 47:
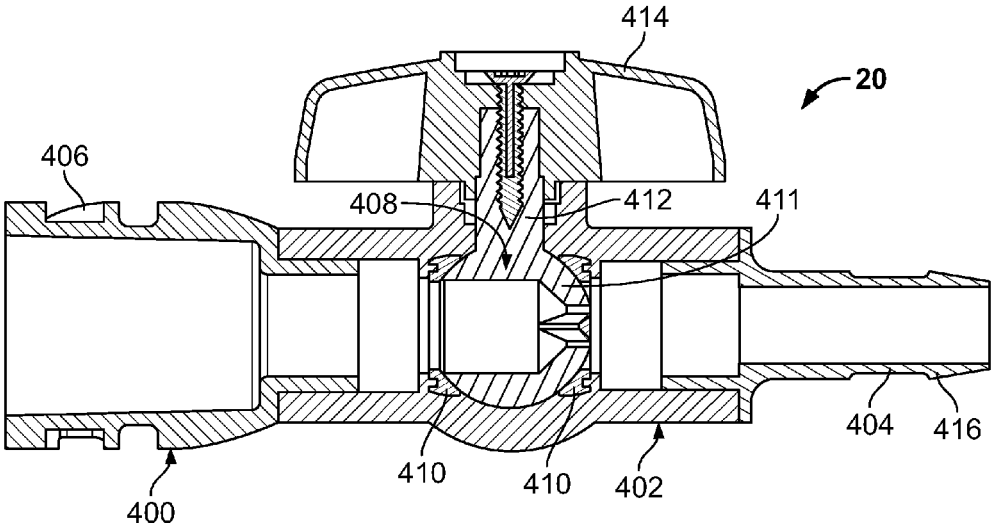
FIG. 47 is a sectional view of the hose connection of the present disclosure taken along line 47-47 of FIG. 46.

FIGS. 45-47 show the hose connection 20 in greater detail. The hose connection 20 includes a connector portion 400, a body 402, and a nozzle 404. The connector portion 400 includes a radially protruding inclined track 406 to engage a mating member of a hose, e.g., segmented hose 22, for mounting with a caming action. This engagement can be characterized as a bayonet mount. FIG. 47 is a sectional view taken along line 47-47 of FIG. 46, showing the hose connection 20 in greater detail. The body 402 includes a rotatable ball valve 408, and a plurality of seals 410. The rotatable ball valve 408 includes a ball 411 positioned within the body 402. The seals 410 extend circumferentially about the ball 411, and are positioned between the ball 411 and an internal wall of the body 402. Accordingly, the seals 410 create a seal radially against the body 402. A stem 412 extends from the ball 411 and through the body 402, where it is attached with a handle 414. Rotation of the handle 414, results in rotation of the ball 411 within the body 410. When in a first position, water can flow through the ball 411. When in a second position, water is sealed off from flowing through the ball 411. Accordingly, the hose connection 20 can be used to control flow therethrough. The nozzle 404 includes a barb 416 that facilitates attachment of a hose to the nozzle 404.

Figure 48:
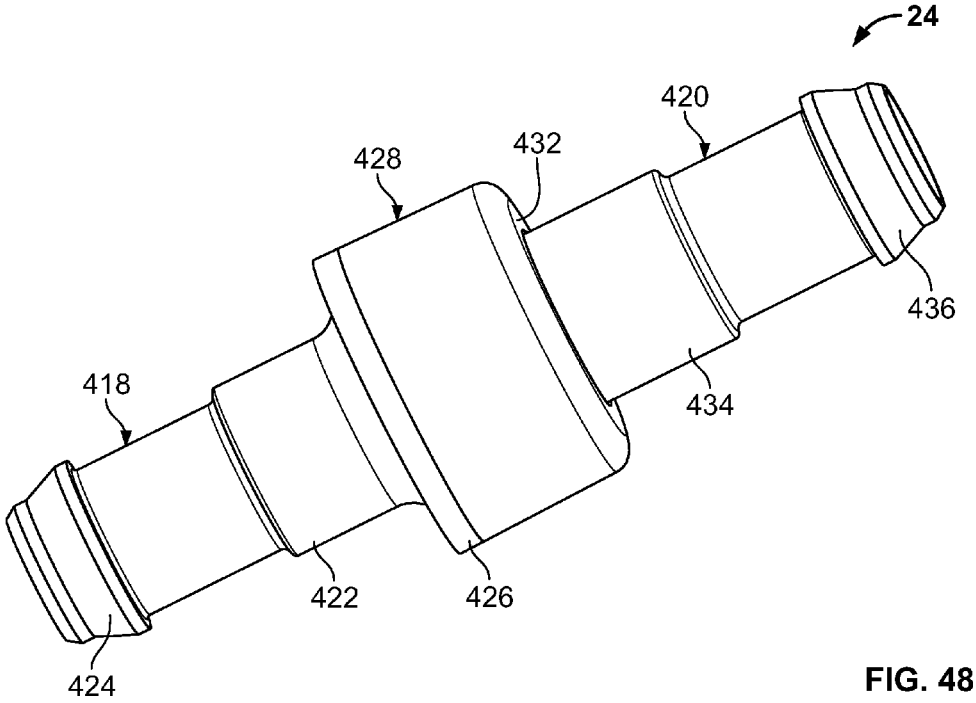
FIG. 48 is a perspective view of a hose swivel of the present disclosure.
Figure 49:
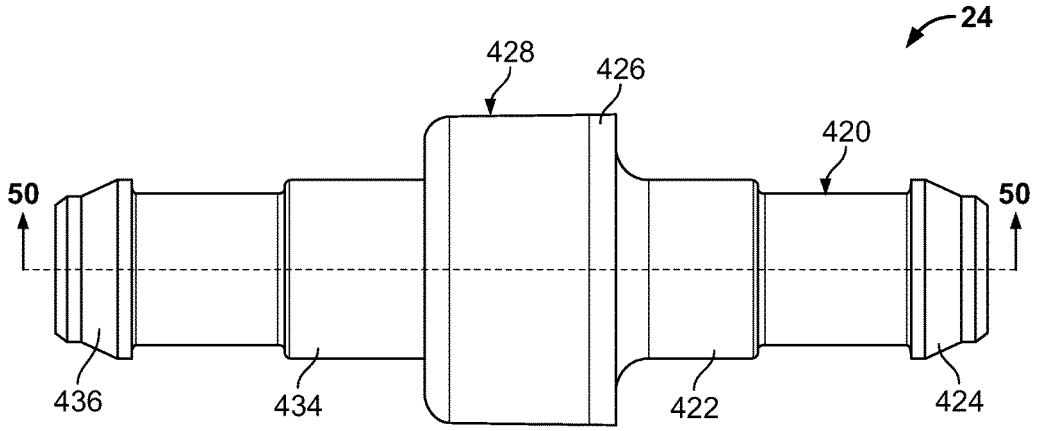
FIG. 49 is a top view of the hose swivel of the present disclosure.
Figure 50:
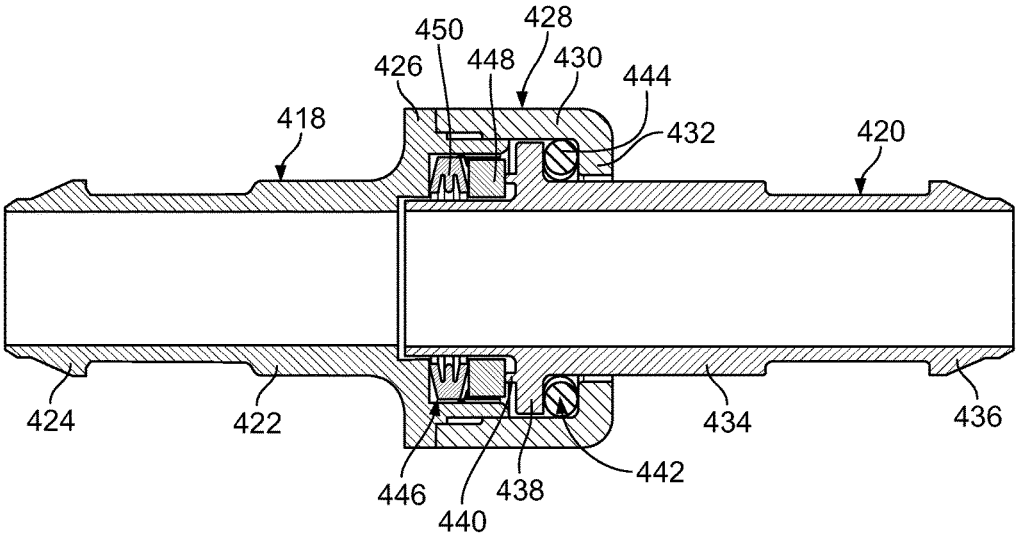
FIG. 50 is a cross-sectional view of the hose swivel of the present disclosure taken along line 50-50 of FIG. 49.

FIGS. 48-50 show the swivel 24 in greater detail. The swivel includes a first body 418 and a second body 420. The first body 418 includes a tubular section 422 having a barb 424 and a radial extension 426. A locking ring 428 extends from the radial extension and includes an annular wall 430 and an inwardly extending shoulder 432. The second body 420 includes a tubular portion 434 having a barb 436 and a radial shoulder 438. The radial shoulder 438 includes an annular protrusion 440. The radial shoulder 438 of the second body 420 is positioned within the annular wall 430 of the first section locking ring 438, such that a first chamber 442 is formed between the first section locking ring 438, and the inwardly extending shoulder 432. A plurality of bearing balls 444, which could be acetal balls, can be positioned within the first chamber 442. A second chamber 446 is formed between the radial extension 426 of the first body 418, the annular wall 430, and the radial shoulder 438. An annular sealing washer 448 and an annular seal 450 may be positioned and compressed within the second chamber 446, with the annular protrusion 440 contacting the annular sealing washer 448. Accordingly, the first and second bodies 418, 420 can rotate with respect to one another, such that the bearing balls 444 facilitate rotation, and the annular sealing washer 448 and the annular seal 450 seal the first and second bodies 418, 420 from leakage. Accordingly, water can flow through the first and second bodies 418, 420.

Figure 51:
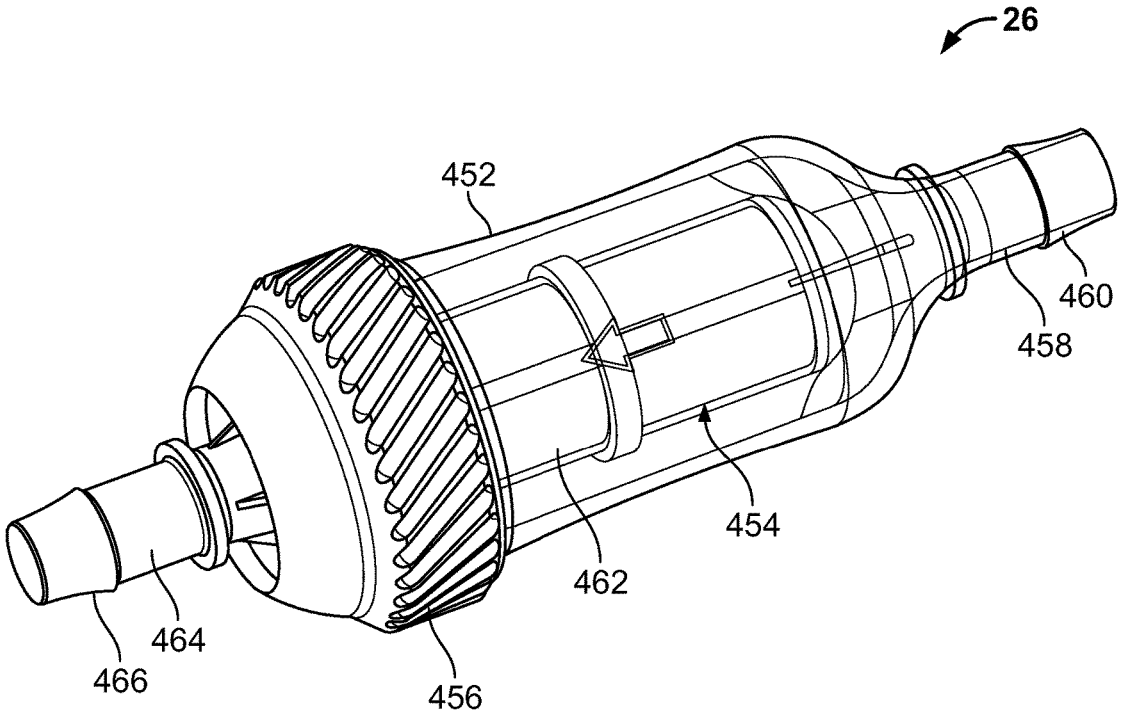
FIG. 51 is a perspective view of a filter of the present disclosure.

FIG. 51 is a perspective view of a filter 26. The filter 26 includes a body 452, a filter assembly 454 partially positioned within the body 452, and a nut 456. The body includes a nozzle 458 having a barb 460. The filter assembly 454 includes a filter 462 and a nozzle 464 having a barb 466. The nut 456 secures the filter assembly 454 with the body 452. Accordingly, water can flow into the body nozzle 458, into the body 452, through the filter 462 where it is filtered, and out the filter nozzle 464.

Operation of the cleaner 10 is summarized as follows. In operation, the pump 18 provides pressurized water through the segmented hose 22, any connected swivels 24, filters 26, and floats 28, and to the cleaner 10. The segmented hose 22 is connected to the inlet port external nozzle 84. The barb 88 facilitates attachment of the segmented hose 22 to the inlet port external nozzle 84. Additionally, the nut 92 can be utilized to secure the segmented hose 22 to the inlet port external nozzle 84 in embodiments where the segmented hose 22 includes a threaded end for engagement with the nut 92. The pressurized water flows through the inlet port 78 of the cleaner 10 and out through the inlet port external nozzle 86, where it flows through the hose 87 and to the drive assembly inlet 148. The pressurized water flows through the drive assembly inlet 148 and into the inlet body 138. When in the inlet body 138, the water diverges into two flows. A first flow flows to the outlet 156 and a second flow flows through the reverse/skim-out mode valve disk window 264.

The first flow flows out of the outlet 156, through the hose 159 and to the turbine housing inlet 160. The first flow enters the turbine housing 140 through the inlet 160, and places a force on the turbine blades 168. This force causes the turbine 164 to rotate about the first shaft 176. The first flow then exits the turbine housing 140 through the apertures 180. Rotation of the turbine 164 causes the output drive gear 172 to drive the reduction gear stack 186, resulting in rotation of the plurality of drive gears 188. The plurality of drive gears 188 engage one another, with one of the drive gears 188 engaging, and rotationally driving, the gear stack output gear 200. Rotation of the gear stack output gear 200 causes rotation of the Geneva drive gear 204, including rotation of the post 210 about the first shaft 176. The post 210 continually orbits the first shaft 176 while water drivingly engages the turbine 164. During each rotation, the post 210 slides into a slot 224 of the Geneva gear 220, and "pushes" an adjacent cog 222. This engagement, e.g., the post 210 "pushing" the cog 222, results in sequential rotation of the Geneva gear 220, wherein, for example, the Geneva gear 220 rotates 45° for each orbit of the post 210. Rotation of the Geneva gear 220 results in the Geneva gear socket 228 engaging and rotating the reverse/spin-out valve selector drive head 260, thus rotationally driving the reverse/spin-out valve selector 238 and associated valve disk window 264. Accordingly, Geneva gear 220 causes the valve disk window 264 to move between different positions adjacent the internal forward drive chamber 242, and adjacent the internal reverse drive chamber 244. While the first flow is causing the Geneva gear 220 to rotate the valve disk 254, the second flow flows through the valve disk window 264 and into the reverse/spin-out mode valve body 236 chamber that it is adjacent to at that moment. For example, when the valve disk window 264 is adjacent the internal forward drive chamber 242, into the internal forward drive chamber 242. However, when the valve disk window 264 is adjacent the internal reverse drive chamber 244, the second flow flows into the internal reverse drive chamber 244. Thus, the Geneva gear 220 continuously and automatically determines which chamber the second flow of water flows into.

When the pressurized water of the second flow flows into the internal reverse drive chamber 244, it flows out of the internal reverse drive chamber 244 through the outlet port 250, into the reverse/spinout inlet 312 of the water distribution manifold 122, into the reverse/spinout mode chamber 326, out through the reverse/spinout outlet 340, through the first hose 119*a*, and to the reverse/spin-out thrust jet nozzle 112, where it is discharged. Alternatively, when the pressurized water of the second flow flows into the internal forward drive chamber 242, it flows through the valve disk window 302 of the top/bottom mode valve selector 272. The valve disk window 302 is rotatable by a user by inserting a tool through the top/bottom mode adjustment aperture 79 extending through the cleaner rear wall 68 and rotationally engaging the drive head 298. Accordingly, the valve disk window 302 can be positioned adjacent the internal bottom mode chamber 276 or the internal top mode chamber 278.

When the valve disk window 302 is positioned adjacent the internal top mode chamber 278, the pressurized water of the second flow flows into the internal top mode chamber 278, out of the internal top mode chamber 278 through the top mode outlet port 286, into the top mode inlet 314 of the water distribution manifold 122, into the top mode chamber 328, and out through the top mode skimmer outlets 344 and the top mode jet nozzle 83. The portion of the flow that exits through the top mode skimmer outlets 344 flows through the respective second and third hose 119*b*, 119*c* and to the respective skimmer/debris retention jet 60 where it is discharged.

When the valve disk window 302 is positioned adjacent the internal bottom mode chamber 276, the pressurized water of the second flow flows into the internal bottom mode chamber 276, out of the internal bottom mode chamber 276 through the bottom mode outlet port 282, into the bottom mode inlet 316 of the water distribution manifold 122, into the bottom mode chamber 330, and out through the bottom mode outlet 350 and the aperture 336. The flow portion that flows through the bottom mode outlet 350 flows through the fourth hose 119*d* and to the forward thrust jet nozzle 82 where it is discharged. The flow portion that flows through the aperture 336, flows across the flow channel 338, into the annular flow channel 354, and is discharged through the plurality of vacuum jet nozzles 104.

Figure 52:
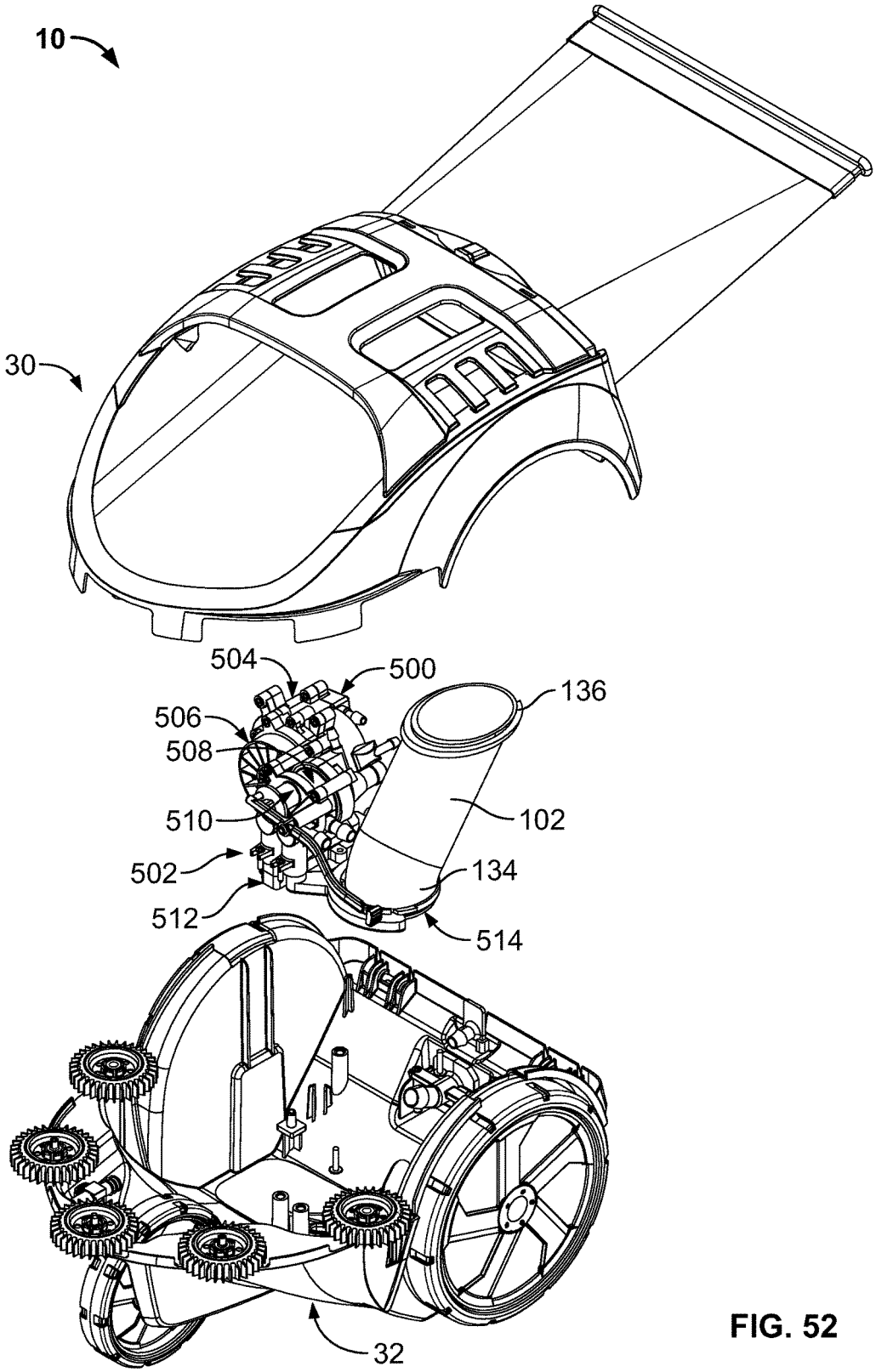
FIG. 52 is an exploded perspective view of the pool cleaner of the present disclosure showing another embodiment of the drive assembly.
Figure 53:
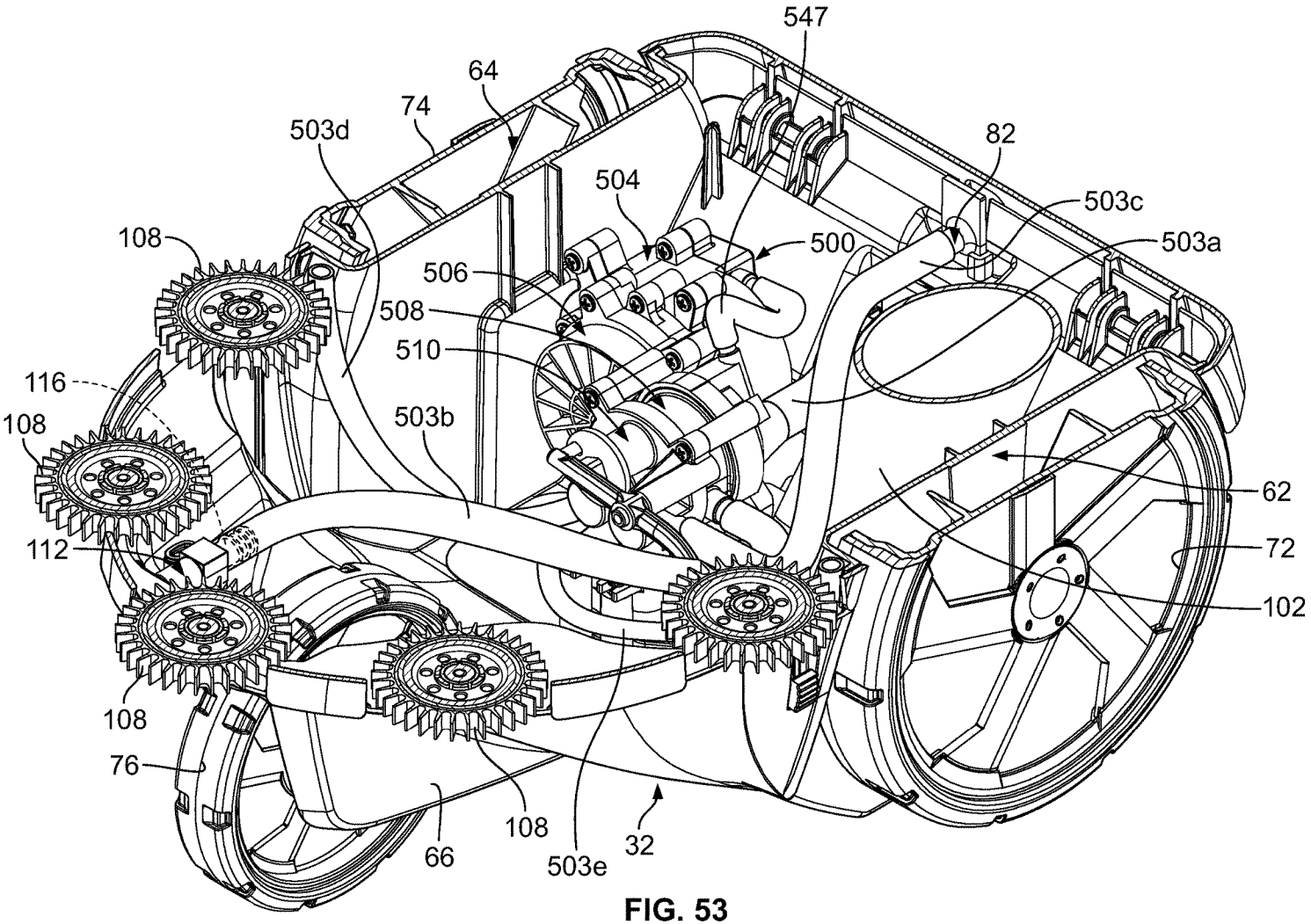
FIGS. 53-54 are partial sectional views of the pool cleaner of the present disclosure, illustrating the drive assembly of FIG. 52.

FIGS. 52-78 show another embodiment of the drive mechanism of the pool cleaner 10. Particularly, the pool cleaner 10 of FIGS. 52-78 includes a drive assembly 500 and water distribution manifold 502 for providing water to the various nozzles. The drive assembly 500 is connected with an inlet tube 503*a*, reverse/spin-out tube 503*b*, and bottom mode tube 503*c*, while the water distribution manifold 502 is connected with first and second skimmer tubes 503*d*, 503*e*, each of which are discussed in greater detail below. FIG. 52 is an exploded perspective view of the pool cleaner 10 of the present disclosure including the drive assembly 500. FIG. 53 is a sectional view of the pool cleaner 10 taken along line 53-53 of FIG. 5 showing the drive assembly 500. As illustrated in FIG. 53, the chassis 32 forms a housing for the drive assembly 500, the water distribution manifold 502, and the suction tube 102. The pool cleaner 10 of FIGS. 52-78 is similar in structure as described in connection with FIGS. 1-44, however, the drive assembly 500 and the water distribution manifold 502 replace the drive assembly 120 and the water distribution manifold 122 of FIGS. 1-44.

FIGS. 55-58 illustrate the drive assembly 500 and the water distribution manifold 502, which are in fluidic communication with one another. The drive assembly 500 includes a timer assembly 504, a reverse/spin-out mode cam assembly 506, a reverse/spin-out mode valve assembly 508, and a top/bottom mode valve assembly 510, each discussed in greater detail below. The water distribution manifold 502 includes a top mode manifold body 512 and a jet ring 514. The manifold body 512 includes a plurality of chambers that function to direct water flow amongst the various jet nozzles of the cleaner 10. The suction tube 102 includes a bottom end 134 and a top end 136. The jet ring 514 is connected with the bottom end 134 of the suction tube 102 and includes a plurality of suction jet nozzles 720.

FIGS. 55-75 show the drive assembly 500 in greater detail. Particular reference is made to FIG. 65, which is an exploded view of the drive assembly 500 showing the components of the timer assembly 504, the reverse/spin-out mode cam assembly 506, the reverse/spin-out mode valve assembly 508, and the top/bottom mode valve assembly 510. The timer assembly 504 includes a turbine housing 518, a gear box 520, a gear box upper housing 522, and a socket housing 524. The reverse/spin-out mode cam assembly 506 includes a cam upper housing 526 and a cam plate 596. The reverse/spin-out mode valve assembly 508 includes an inlet body 516, a cam lower housing 528, a reverse/spin-out mode valve body 529, and a reverse/spinout seal 624. The drive assembly 500 is configured such that the inlet body 516 is connected with the cam lower housing 528, the reverse/spin-out mode valve body 529, and the reverse/spin-out seal 624 to form the reverse/spin-out mode valve assembly 508, with the top/bottom mode valve assembly 510 being adjacent to the reverse/spin-out mode assembly 508, the cam lower housing 528 adjacent the cam upper housing 526, the timer cover 524 adjacent the cam upper housing 526, the gear box 520 is adjacent the timer cover 524, and the turbine housing 518 is adjacent the gear box 520. The inlet body 516 includes an inlet nozzle 530 having a barbed end 532. The inlet nozzle 530 provides a flow path from the exterior of the inlet body 516 to the interior. The inlet nozzle 530 is connectable with the inlet tube 503*a*, which is connectable with the internal nozzle 86, such that water can flow to the cleaner 10 and through the inlet tube 503*a* to the inlet body 516. The inlet body 516 defines an internal chamber 534. The inlet nozzle 530 is in communication with the internal chamber 534 such that fluid can flow into the inlet nozzle 530 and into the internal chamber 534. The inlet body 516 further includes a top opening 536 that is adjacent cam lower housing 528, which will be discussed in greater detail below. An outlet nozzle 538 having a barbed end 540 is provided on the inlet body 516. The outlet nozzle 538 provides one path for water to flow out from the inlet body 516. As such, water flowing into the inlet nozzle 530 flows into the interior chamber 534 and into the outlet nozzle 538. Accordingly, a portion of the water exits the inlet body 516 through the outlet nozzle 538. The inlet body 516 is generally closed at an upper end, e.g., the end adjacent the cam lower housing 528, but for the opening 536, and is open at a lower end, e.g., the end adjacent the reverse/spin-out mode valve assembly 508.

Figure 67:
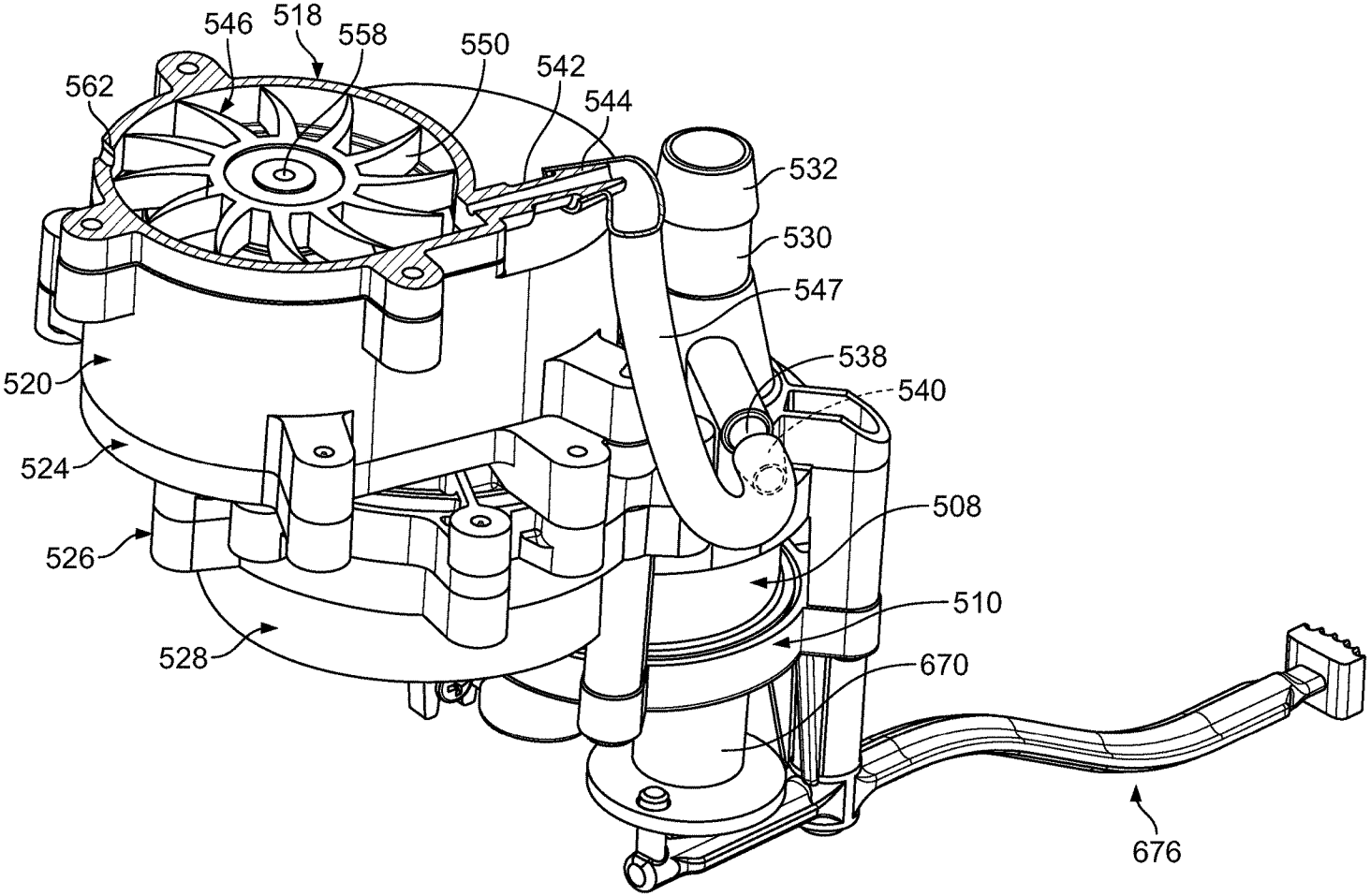
FIG. 67 is a sectional view of the drive assembly taken along line 67-67 of FIG. 61 and showing a turbine.

FIG. 67 is a sectional view of the turbine housing 518 showing the components thereof in greater detail. The turbine housing 518 includes an inlet nozzle 542 having a barbed end 544, and a turbine 546. A hose 547 is connected at one end to the barbed end 540 of the inlet body outlet nozzle 538 and at another end to a the barbed end 544 of the turbine housing inlet nozzle 542. Accordingly, water flows out from the inlet body 516 through the outlet nozzle 538 and to the turbine housing inlet nozzle 542 by way of the hose 547. The turbine 546 includes a central hub 548, a plurality of blades 550, a boss 552 extending from the central hub 548 and having an output drive gear 554 mounted thereto, and a central aperture 556. The central hub 548, boss 552, and output drive gear 554 are connected for conjoint rotation. Accordingly, rotation of the blades 550 causes rotation of the central hub 548, boss 552, and output drive gear 554. The central aperture 556 extends through the center of the turbine 546, e.g., through the output drive gear 554, the boss 552, and the central hub 548.

A first shaft 558 extends through the central aperture 556 and is secured within a shaft housing 560 that is provided in a top of the turbine housing 518. The first shaft 558 extends from the shaft housing 560, through the turbine 546, and into the gear box 520. The turbine housing 518 also includes one or more apertures 562 in a sidewall thereof that allow water to escape the turbine housing 518. When pressurized water enters the turbine housing 518 through the inlet nozzle 542 it places pressure on the turbine blades 550, thus transferring energy to the turbine 546 and causing the turbine 546 to rotate. However, once the energy of the pressurized water is transferred to the turbine 546 it must be removed from the system, otherwise it will impede and place resistance on new pressurized water entering the turbine housing 518. Accordingly, new pressurized water introduced into the turbine housing 518 forces the old water out from the one or more apertures 562. FIG. 67 is a sectional view of the turbine housing 518 taken along line 67-67 of FIG. 61 further detailing and showing the arrangement of the turbine 546 within the turbine housing 518. The turbine housing 518 is positioned on the gear box 520.

The gear box 520 includes a turbine mounting surface 564 having an aperture 566 extending there through. The turbine housing 518 is positioned on, and covers, the gear box turbine mounting surface 564, such that the turbine 546 is adjacent the turbine mounting surface 564 and the turbine output drive gear 554 extends through the aperture 566 and into the gear box 520. The gear box 520 houses a reduction gear stack 568 that is made up of a first and second gear stack 570*a*, 570*b*, each gear stack 570*a*, 570*b* including a plurality of large gears 572 connected and coaxial with a smaller gear 574 (see FIG. 66) for conjoint rotation therewith. The conjoint rotation of the large gear 572 with the smaller gear 574 causes for a reduction in gear ratio. As can bee seen in FIG. 66, which is a sectional view of the drive assembly 500, the first and second coaxial gear stack 570*a*, 570*b* each include a central aperture 576. The first gear stack 570*a* is coaxial with the turbine 546 such that the first shaft 558 extends through the gears 572, 574 of the gear stack 570*a*, and into the timer cover 524 where it is secured. Thus, the first gear stack 570*a* rotates about the first shaft 558. The first gear stack 570*a* includes a final gear stack output gear 582 as the bottom most gear of the stack 570*a*. The final gear stack output gear 582 includes a small drive gear 584. The second gear stack 570*b* is positioned such that the gears 572, 574 that make up the second gear stack 570*b* engage the gears 572, 574 that make up the first gear stack 570*a*. Additionally, the second gear stack 570*b* has a second shaft 578 extending through the central aperture 576 thereof. The second shaft 578 is parallel to the first shaft 558 and is secured within a second shaft top housing 580 that is positioned in a top wall of the gear box 520. The small gear 574 of the second gear stack 570*b* engages a large gear 572 of the first gear stack 570*a* that rotates about the first shaft 558. Similarly, a conjoint small gear 574 of the first gear stack 570*a* engages a large gear 572 of the second gear stack 570*b* that rotates about the second shaft 578. A series of such gears are positioned within the gear reduction stack 568 with particular gear ratios, and engaged with one another in the above-described fashion, so that rotation of the turbine 546, and subsequent rotation of the turbine output drive gear 554, causes each gear 572, 574 of the gear stacks 570*a*, 570*b* to rotate with each subsequent gear rotating at a different rotational speed. The second gear stack 570*b* includes an output drive gear 586 as the bottom most gear. The output drive gear 586 includes a large drive gear 588 and a socket 590 extending from the large drive gear 588 for conjoint rotation therewith. The large drive gear 588 engages the small drive gear 584 of the final gear stack output gear 582. The output drive gear 586 engages and is driven by the small drive gear 584 of the final gear stack output gear 582. Accordingly, rotation of the turbine blades 550 causes rotation of the boss 552, and output drive gear 554, which output drive gear 554 causes rotation of the gears 572, 574 of the gear reduction stack 568, and ultimately rotation of the output drive gear 586.

Figure 66:
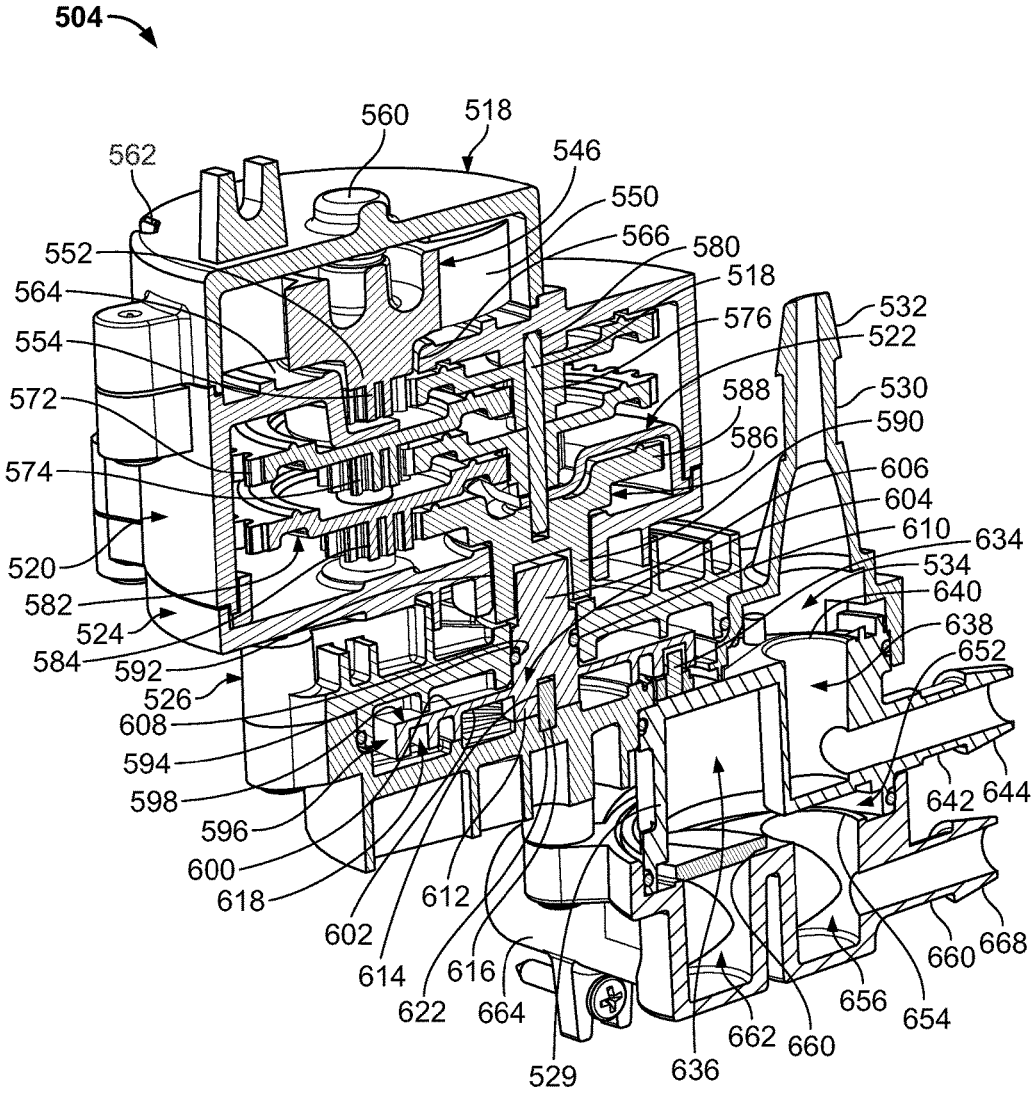
FIG. 66 is a sectional view of the drive assembly taken long line 66-66 of FIG. 64.

As shown in FIG. 66, the output drive gear 586 is positioned between the gear box upper housing 522 and the timer cover 524. The timer cover 524 engages the gear box 520 creating a sealed compartment that contains the reduction gear stack 568, including the cam drive gear 586. The timer cover 524 includes a socket aperture 592 that receives the output drive gear socket 590. Accordingly, the socket 590 is accessible from the exterior of the timer cover 524.

Figure 68:
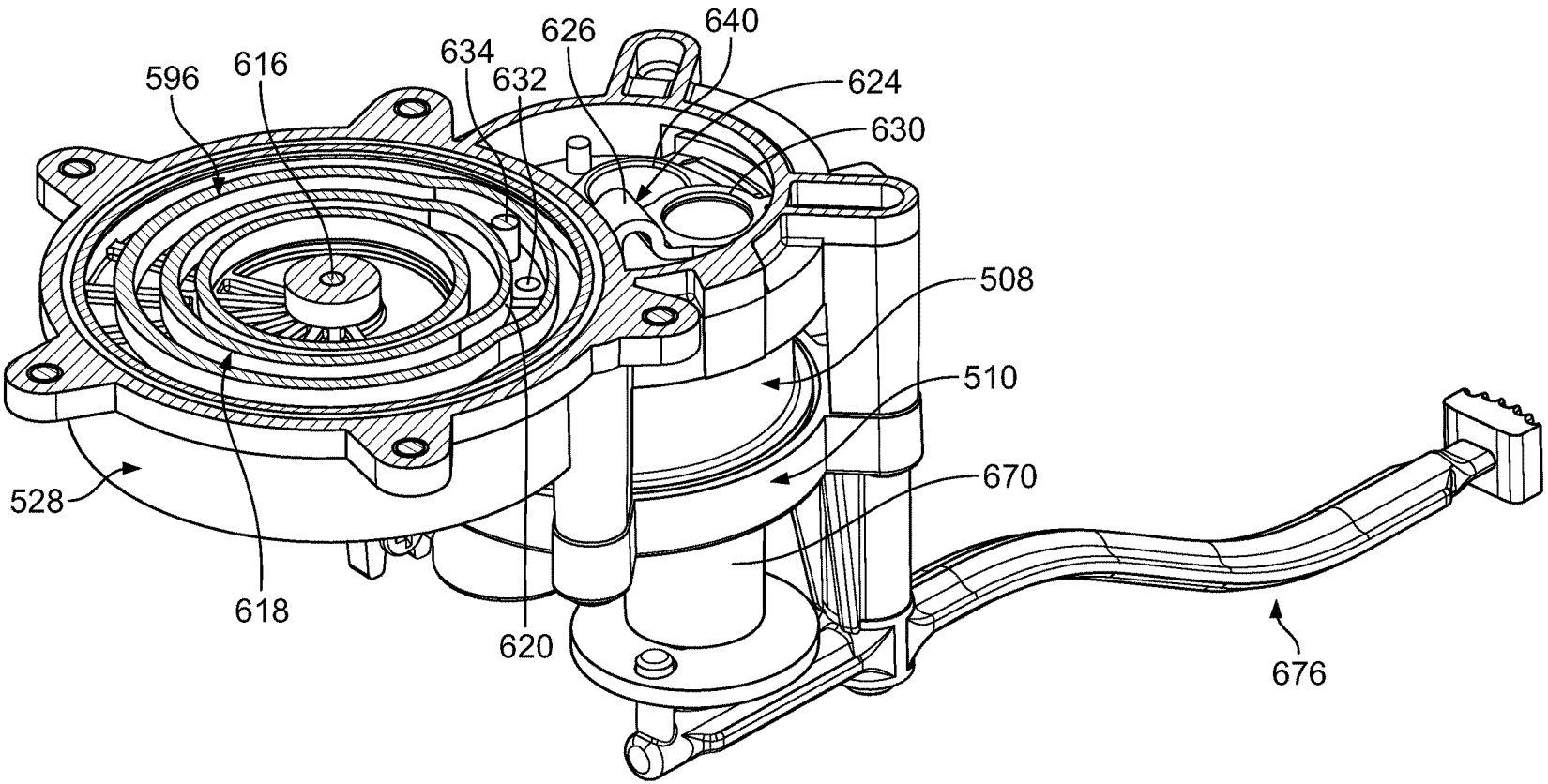
FIG. 68 is a sectional view of the drive assembly taken along line 68-68 of FIG. 61 and showing a cam track in a reverse/spin-out position.

Positioned adjacent to the timer cover 524 is the cam upper housing 526, which is also positioned adjacent to the cam lower housing 528. Accordingly, the cam upper housing 526 is between the timer cover 524 and the cam lower housing 528. The cam upper housing 526 includes a central aperture 594. The cam plate 596 is positioned between the cam upper housing 526 and the cam lower housing 528. The cam plate 596 includes a body 598 having a bottom side 600 and a top side 602. A shaft 604 extends from the center of the top side 602 of the body 598. The shaft 604 includes a shaped head 606 at the end thereof, and a circumferential notch 608. The circumferential notch 608 includes an o-ring positioned therein. The shaft 604 extends from the body cam 598 and through the cam upper housing 526, which generally have mating geometries so that the shaft 604 can rotate. The shaped head 606 engages the socket 590 of the output drive gear 586, which generally have mating geometries so that they can rotate conjointly. That is, the socket 590 and the shaped head 606 have matching geometries such that rotation of the socket 590 will drivingly rotate the shaped head 606, and thus the entirety of the cam plate 596. A central hub 612 extends from the center of the bottom side 600 of the body 598. The central hub 612 includes an aperture 614 with a post 616 positioned therein. The post 616 is secured in the aperture 614 at one end, and in an aperture 622 of the cam lower housing 528 at another end, such that the cam plate 596 can rotate about the post 616. The bottom side 600 of the cam body 598 further includes a cam track 618 that encircles the central hub 612. The cam track 618 is generally circular shaped with a uniform radius, except for a radially extended portion 620 that has a greater radius. FIG. 68 is a sectional view of the cam plate 596, showing elements thereof in greater detail, e.g., the cam track 618 and the radially extended portion 620.

Figure 69:
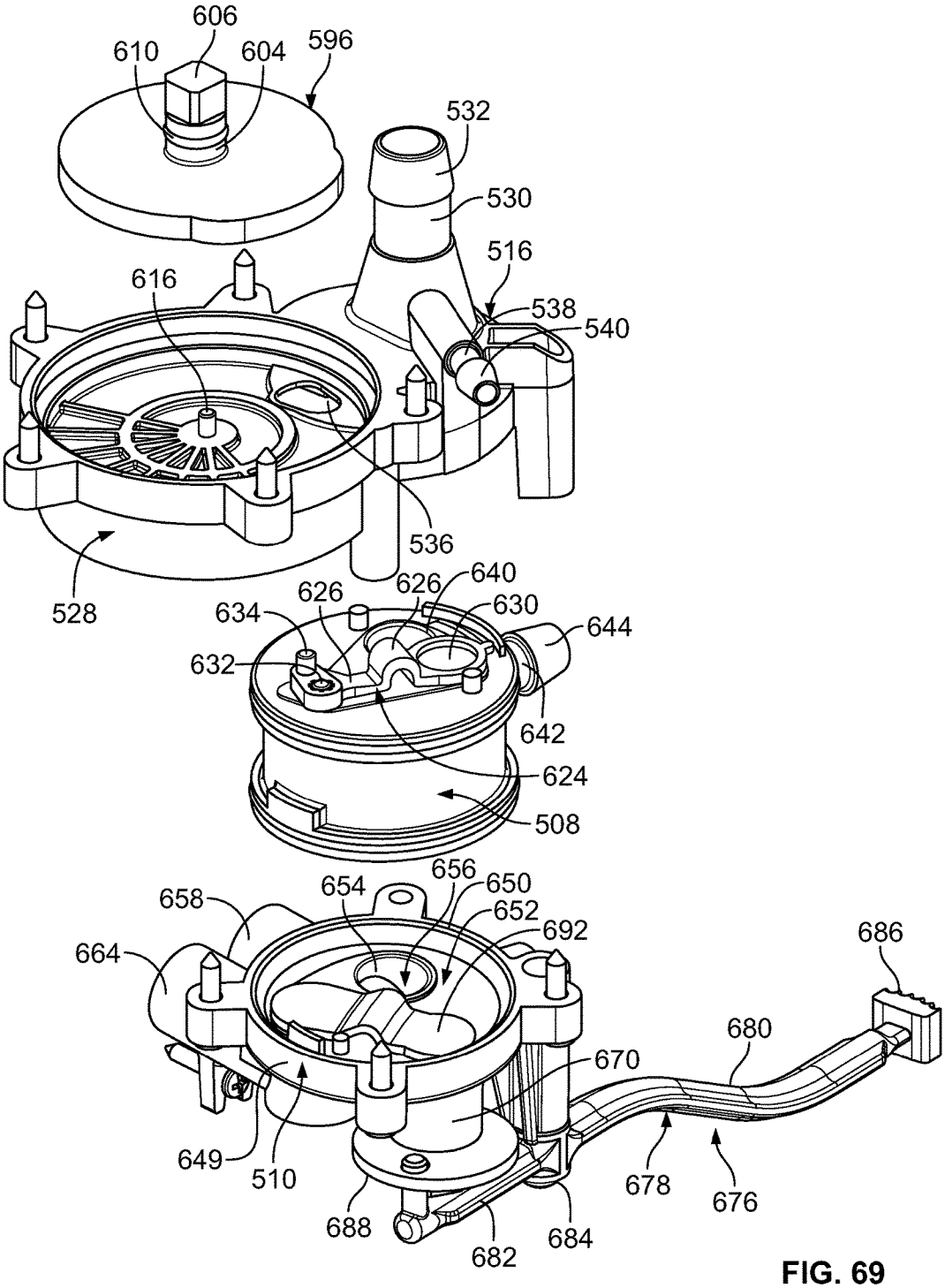
FIGS. 69-70 are exploded views of the reverse/spin-out mode cam assembly, the reverse/spin-out mode valve assembly, and the top/bottom mode valve assembly of the drive assembly of present disclosure.

The cam track 618 is configured to operate a rotatable reverse/spin-out seal 624, which the majority of is positioned in the inlet body 516. The rotatable reverse/spin-out seal 624 is shown in detail in FIGS. 68 and 69. FIG. 69 is a top exploded view of the reverse/spin-out mode cam assembly 506, the reverse/spin-out mode valve assembly 508, and the top/bottom mode valve assembly 510. The rotatable reverse/spin-out seal 624 includes an body 626, an arched portion 628, a sealing member 630, a stationary post 632, and a cam track post 634. The stationary post 632 is secured to a top surface of the reverse/spin-out mode valve assembly 508 such that the reverse/spin-out seal 624 can rotate about the stationary post 632. The reverse/spin-out seal 624 is positioned on a top surface of the reverse/spin-out mode valve assembly 508, and within the internal chamber 534 of the inlet body 516 such that the cam track post 634 extends through the opening 536 of the inlet body 516 and extends into the cam track 518.

In operation, rotation of the output drive gear 586 (see FIG. 66) results in rotation of the cam plate 596 by way of the engagement between, and mating geometries of, the socket 590 and the shaped head 606. The cam track post 634 of the reverse/spin-out seal 626 is positioned within the cam track 618 such that they are in engagement. Thus, as the cam plate 596 rotates, the cam track post 634 rides in the cam track 618. As described above, the cam track 618 includes a majority portion having a first radius and a radially extended portion 620 that has a greater radius. As the cam plate 596 rotates, the cam track post 634 will transition between the majority portion and the radially extended portion 620. When the cam track post 634 transitions into the radially extended portion 620 of the cam track 618, the cam track 618 pushes the cam track post 634 radially outward, which causes the reverse/spin-out seal 624 to rotate clockwise about the stationary post 632 and into a reverse/spin-out position. Similarly, when the cam track post 634 transitions into the majority portion of the cam track 618, e.g., out from the radially extended portion 620 and into the lesser radius portion, the cam track 618 pulls the post 624 radially inward, which causes the reverse/spin-out seal 624 to rotate counterclockwise about the stationary post 632 and into a forward position. Discussion of the reverse/spin-out position and the forward position is provided below.

Figure 70:
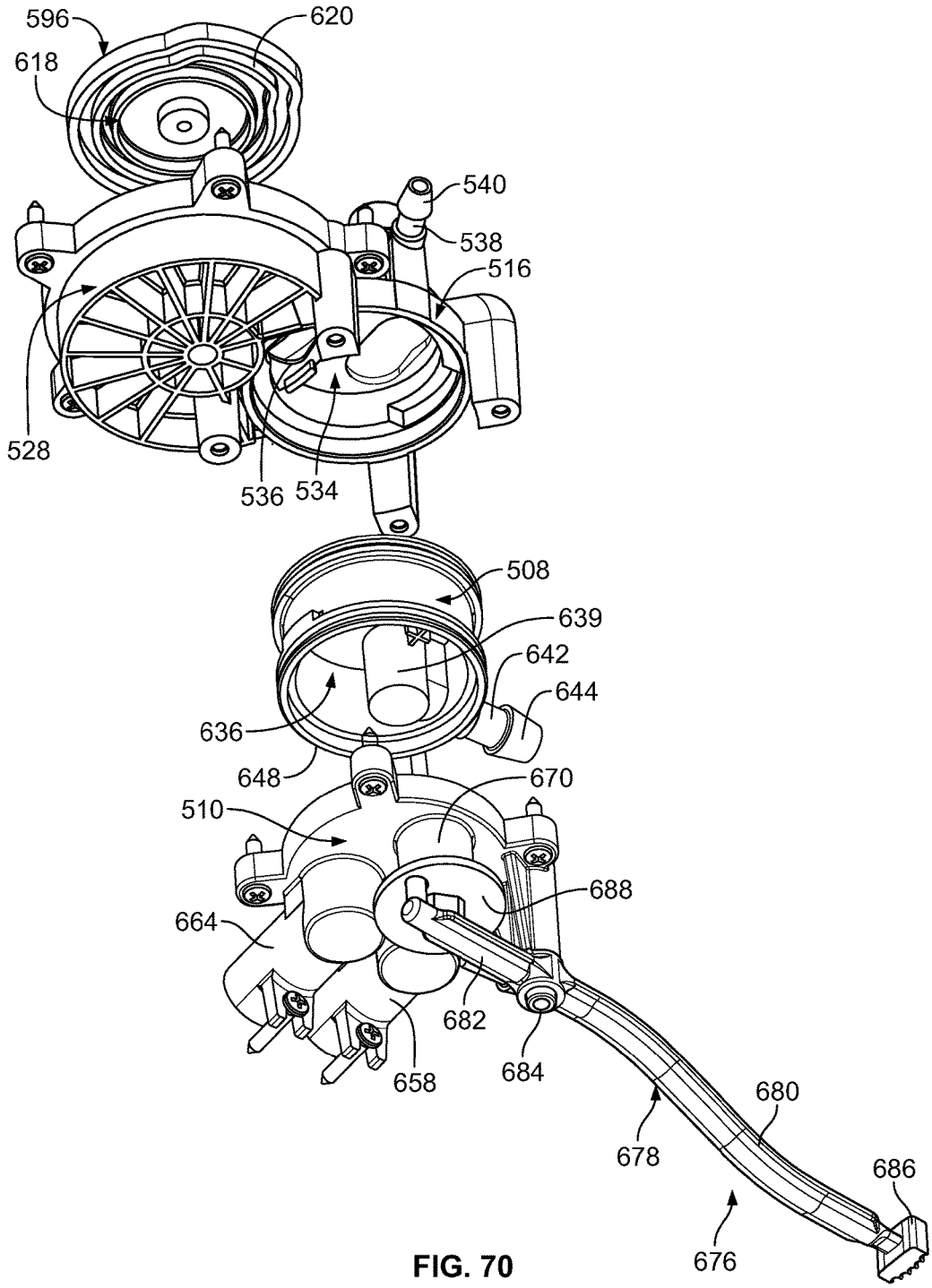
Figure 71:
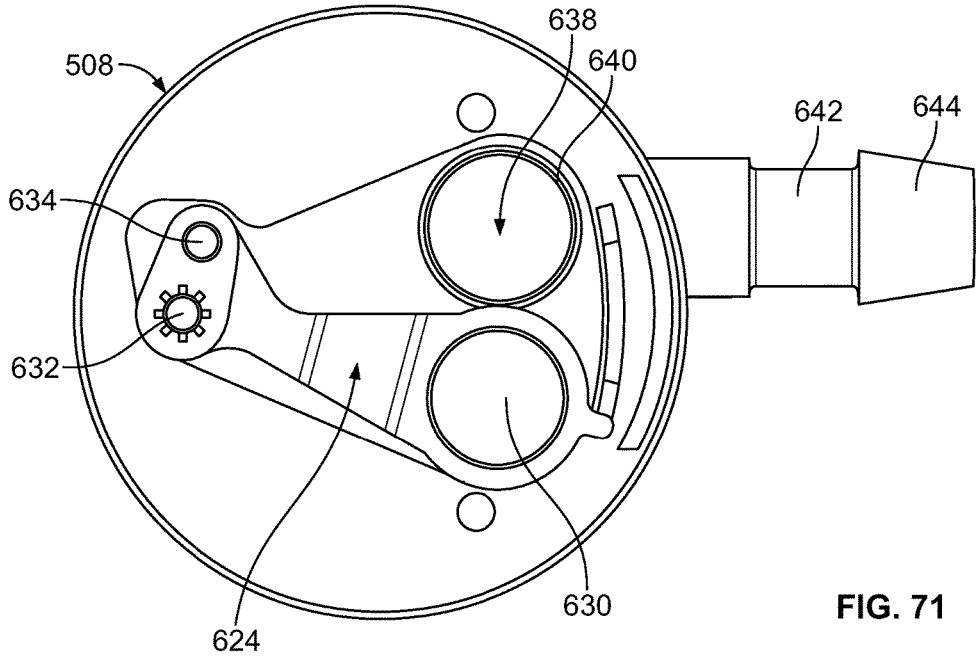
FIGS. 71-73 are front, rear, and sectional views, respectively, of the reverse/spinout mode valve body of the drive assembly of the present disclosure.
Figure 72:
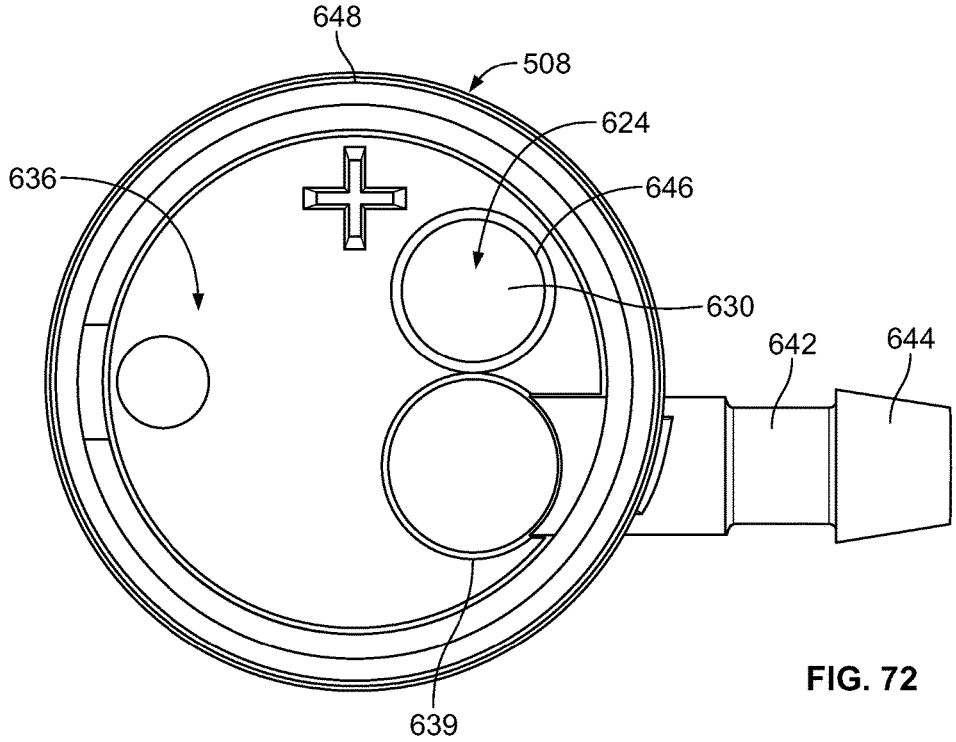
Figure 73:
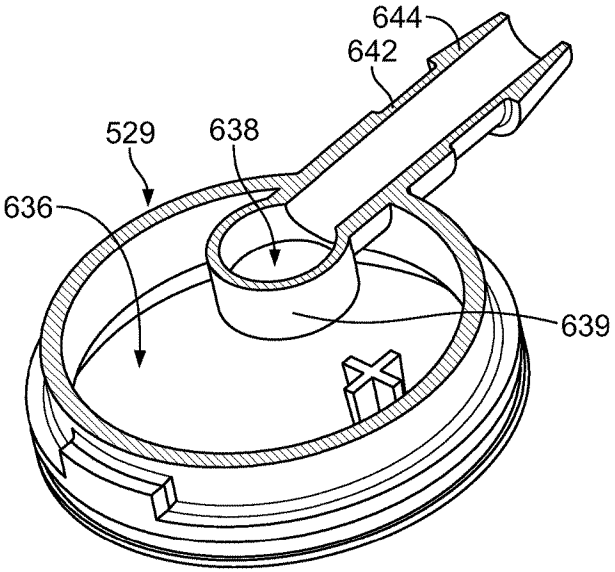

FIGS. 69-73 show the reverse/spin-out mode valve assembly 508 in greater detail. FIG. 69 is a top exploded view of the reverse/spin-out mode cam assembly 506, the reverse/spin-out mode valve assembly 508, and the top/bottom mode valve assembly 510, while FIG. 70 is a bottom exploded view of the same. The reverse/spin-out mode valve assembly 508 is positioned adjacent the inlet body 516 and generally defines a forward chamber 636 and a reverse/spin-out chamber 638 separated from the forward chamber 636 and defined by a chamber wall 639 (see FIG. 70). The reverse/spin-out mode valve assembly 508 includes a reverse/spin-out chamber opening 640 and a reverse/spin-out chamber nozzle 642 having a barbed end 644. The reverse/spin-out chamber 638 is in fluidic communication with the reverse/spin-out chamber opening 640 and the reverse/spin-out chamber nozzle 642, such that fluid can flow through the reverse/spin-out opening 640, into the reverse/spin-out chamber 638 and out the reverse/spin-out chamber nozzle 642 without entering the forward chamber 636. The reverse/spin-out valve assembly 508 further includes a forward chamber opening 646 (see FIG. 72) and an open end 648, such that the forward chamber opening 646, forward chamber 636, and the open end 648 are in fluidic communication. Accordingly, fluid flows into the forward chamber opening 646, through the forward chamber 646, and out the open end 648. FIG. 73 is a cross-sectional view of the reverse/spin-out mode valve assembly 508 showing the forward chamber 636 and the reverse/spin-out chamber 638 in greater detail.

Figure 74:
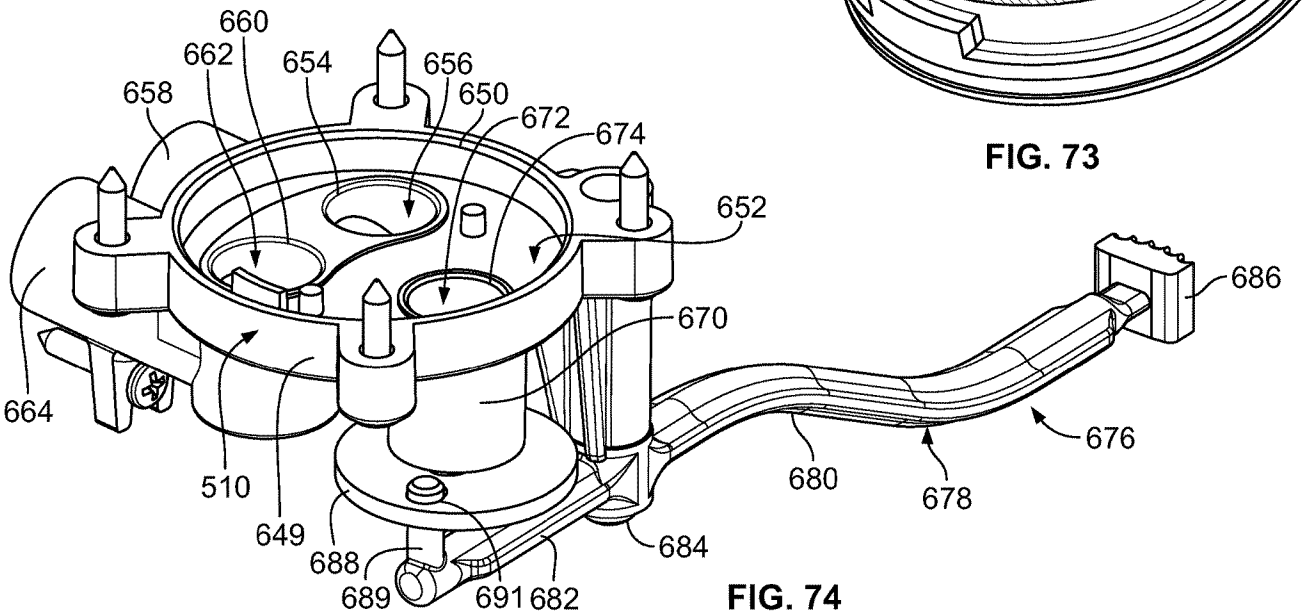
FIGS. 74-75 are exploded perspective and sectional views, respectively, of the top/bottom mode valve assembly of the drive assembly of present disclosure.
Figure 75:
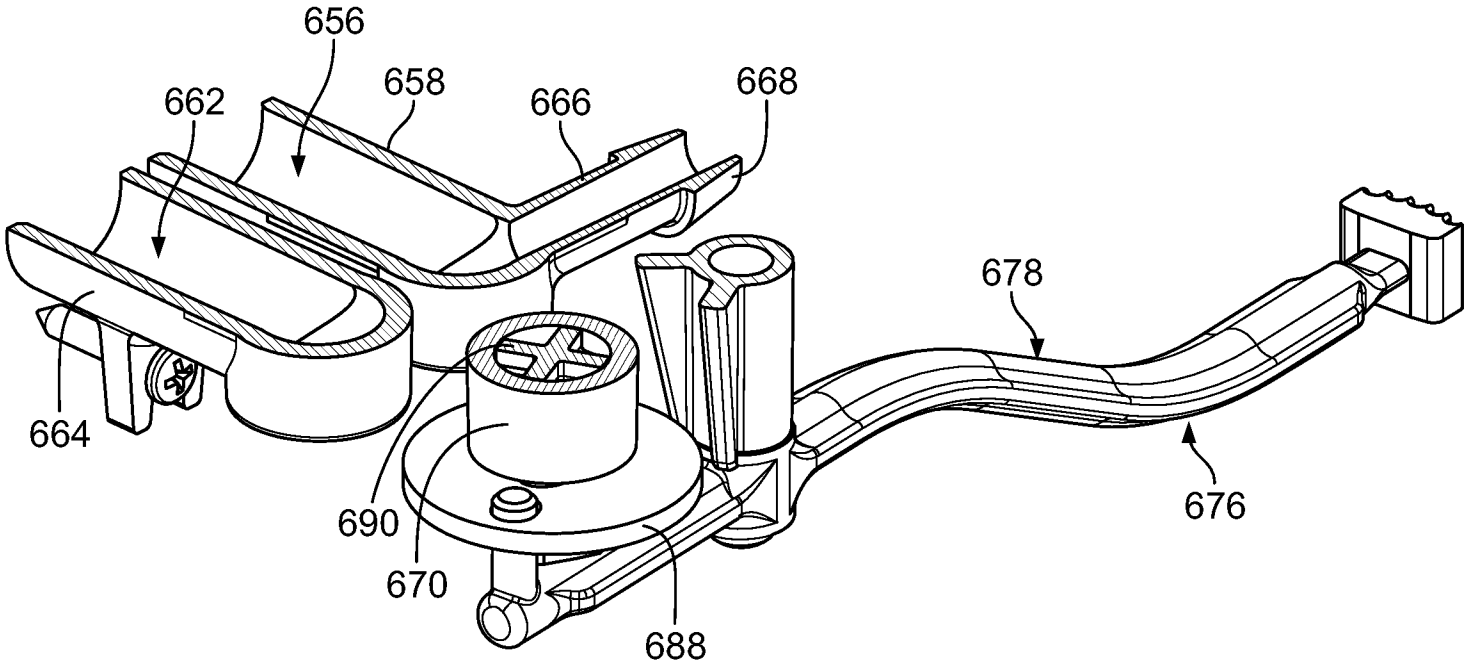

FIGS. 69-70 and 74-75 show the top/bottom mode valve assembly 510 in greater detail. FIGS. 69-70 are top and bottom perspective view, respectively, showing the top/bottom mode valve assembly 510. The top/bottom mode valve assembly 510 includes a body 649 and a sealing plate 692. The body 649 defines a top/bottom mode main chamber 652 and includes a top opening 650, a bottom mode opening 654, and a top mode opening 660. The top opening 650 provides access to the top/bottom mode main chamber 652, while the top/bottom mode valve body 649 is closed at the bottom. FIG. 74 is a perspective view of the top/bottom mode valve assembly 510 with the sealing plate 692 not shown in order to illustrate the bottom mode opening 654 and the top mode opening 660. The bottom mode opening 654 connects with a bottom mode outlet chamber 656 that is defined by a bottom mode outlet port 658 and a bottom mode nozzle 666. The bottom mode outlet port 658 and the bottom mode nozzle 666 extend from the top/bottom mode valve body 649. The bottom mode nozzle 666 includes a barbed end 668 (see FIG. 75). The top mode opening 660 connects with a top mode outlet chamber 662 that is defined by a top mode outlet port 664. The top mode outlet port 664 extends from the top/bottom mode valve body 649. As can be seen in FIG. 74, a hub 670 extends from the top/bottom mode valve assembly body 649 and defines a chamber 672. The hub 670 connects with the body 649, which includes an opening 674 that places the top/bottom mode main chamber 652 in connection with the chamber 672. The hub 670 allows the sealing plate 692 to be rotated by a source external to the top/bottom mode valve assembly 510, which is discussed in greater detail below.

A top/bottom mode selector 676 is connected to the top/bottom mode valve assembly 510. The top/bottom mode selector 676 includes a lever arm 678 having a first arm 680 and a second arm 682, a fulcrum 684, a user-engageable tab 686, and a plate 688. The fulcrum 684 engages the lever arm 678 between the first arm 680 and the second arm 682, such that the lever arm 678 can rotate about the fulcrum 684. The user-engageable tab 686 is positioned at the end of the first arm 680 and is positioned adjacent a wall of the pool cleaner 10, as shown in FIG. 53. Accordingly, a user can push the user-engageable tab 686 up or down to rotate the lever arm 678 about the fulcrum 684. The user-engageable tab 686 can include a plurality of ridges to facilitate use by a user. The second arm 682 includes a pin 689 that extends from an end of the second arm 682. The plate 688 is connected with a central shaft 690 (see FIG. 75) and includes an aperture 691 located near the periphery of the plate 688. The central shaft 690 extends through the hub 670, e.g., is positioned within the chamber 672, and engages the sealing plate 692. The pin 689 engages the aperture 691 of the plate 688, such that the pin 689 can rotate the plate 688, along with the central shaft 690 and the sealing plate 692, while itself rotating within the aperture 691. Accordingly, the tab 686 can be engaged by a user to rotate the top/bottom mod selector 676 clockwise or counter-clockwise to rotate the sealing plate 692 between two positions. In a first position, e.g., the position shown in FIG. 69 also referred to as the bottom mode position, the sealing plate 692 is positioned adjacent the top mode opening 660, thus sealing the top mode outlet chamber 662. In such a configuration, fluid can flow through the bottom mode opening 654, through the bottom mode outlet chamber 656, and out the bottom mode outlet port 658 and the bottom mode nozzle 666. In a second position, e.g., a top mode position, the sealing plate 692 is positioned adjacent the bottom mode opening 654, thus sealing the bottom mode outlet chamber 656. In such a configuration, fluid can flow through the top mode opening 660, through the top mode outlet chamber 662, and out the top mode outlet port 664. The bottom mode outlet port 658 and the top mode outlet port 664 are connected with the water distribution manifold 502, which will be discussed in greater detail.

Figure 76:
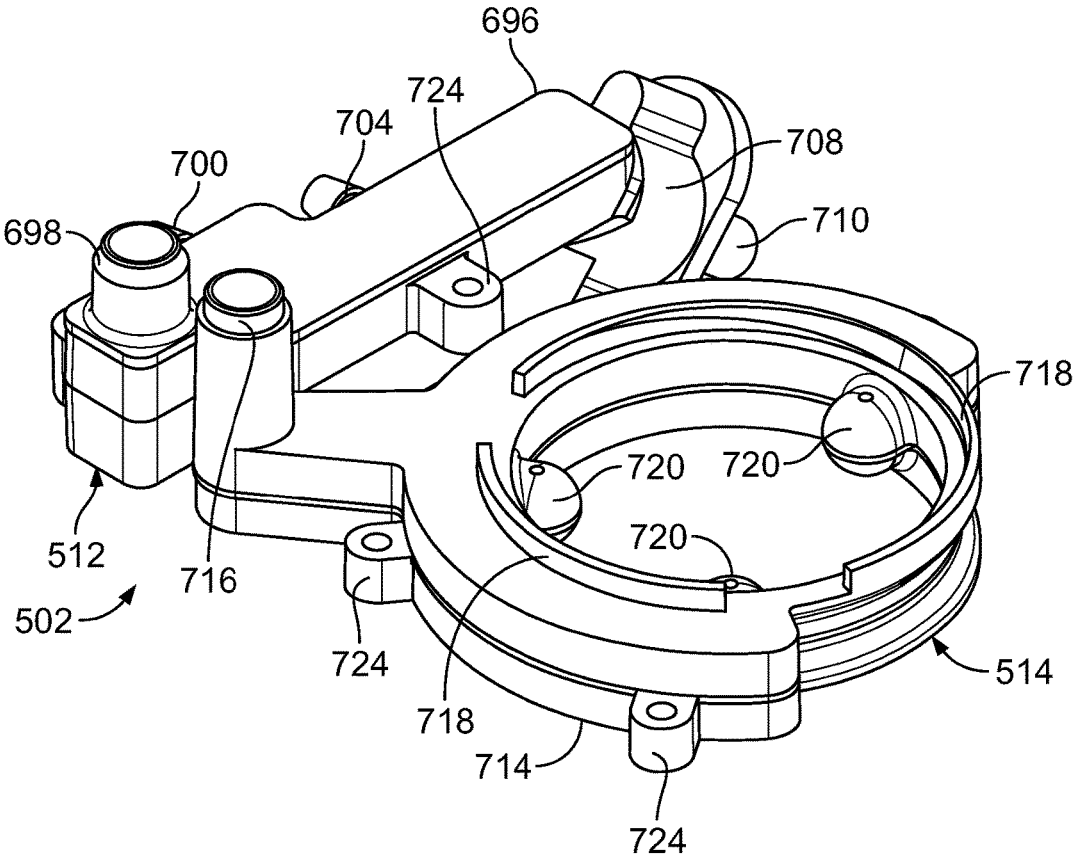
FIGS. 76-78 are perspective, left side, and sectional views, respectively, of the water distribution manifold of the pool cleaner of the present disclosure.
Figure 77:
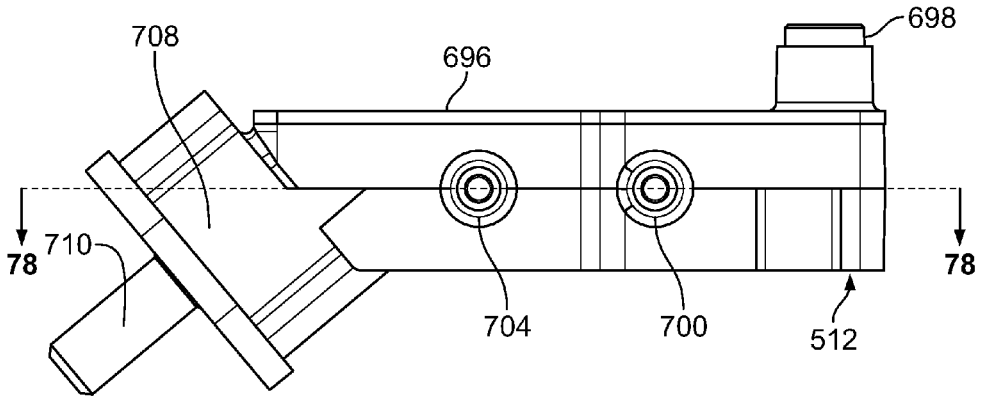
Figure 78:
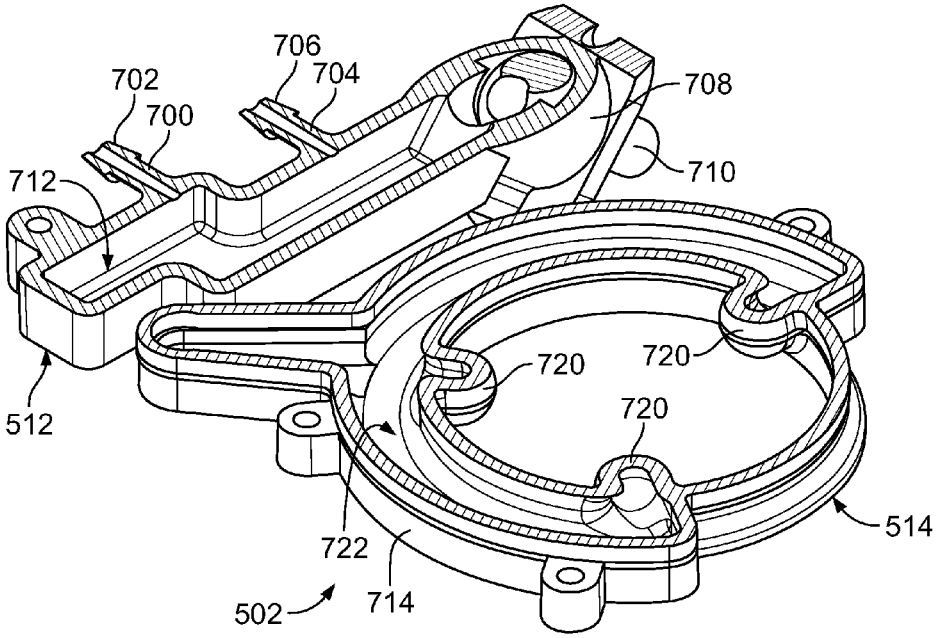

FIGS. 76-78 show the distribution manifold 502 in greater detail. FIG. 76 is a perspective view of the distribution manifold 502. The distribution manifold 502 includes the top mode manifold 512 and the jet ring 514. The top mode manifold 512 includes a manifold body 696, inlet port 698, first top mode skimmer outlet 700 having a barbed end 702, second top mode skimmer outlet 704 having a barbed end 706, and a top mode jet nozzle housing 708 that houses a top mode jet nozzle 710. The top mode manifold inlet port 698 is generally connected with the top mode outlet port 664 of the top/bottom mode valve assembly 510, such that the top mode manifold inlet port 698 is inserted into the top mode outlet port 664. The jet ring 512 includes a body 714, a bottom mode inlet port 716, a plurality of upper protrusions 718 that secure the suction tube 102, and a plurality of suction jet nozzles 720. The bottom mode inlet port 716 is connected with the bottom mode outlet port 658 of the top/bottom mode valve assembly 510, such that the bottom mode inlet port 716 is inserted into the bottom mode outlet port 658.

FIG. 78 is a sectional view of the distribution manifold 502 taken along line 78-78 of FIG. 77. The top mode manifold body 696 defines a top mode inner chamber 712, while the jet ring 512 defines a bottom mode inner chamber 722. The top mode inner chamber 712 is in fluidic communication with the inlet port 698, the first and second top mode skimmer outlets 700, 704, and the top mode jet nozzle housing 708 including top mode jet nozzle 710. Accordingly, fluid can flow through the top mode outlet port 664 of the top/bottom mode valve assembly 510, into the top mode manifold inlet port 698, through the top mode inner chamber 712, and out through the first and second top mode skimmer outlets 700, 704 and the top mode jet nozzle 710. The first and second top mode skimmer outlets 700, 704 are connected with the first and second skimmer tubes 503*e*, 503*d* (see FIGS. 53-54), which are each in turn connected to the skimmer/debris retention jets 60 (see FIGS. 7 and 53-54). The engagement of the top mode jet nozzle 710 with the top mode jet nozzle housing 708 can be a ball-and-socket joint such that the jet nozzle 710 can be rotated within the housing 708. Fluid provided from the top mode inner chamber 712 to the top mode jet nozzle 710 is forced out the top mode jet nozzle 710 under pressure, causing a jet of pressurized water directed generally rearward and downward. This jet of pressurized water propels the cleaner 10 toward the pool water line 16 for skimming of the pool water line 16. When the cleaner 10 is skimming the pool water line 16, the top mode jet nozzle 710 propels the cleaner 10 forward along the pool water line 16.

The bottom mode inner chamber 722 is in fluidic communication with the bottom mode inlet port 716 and the plurality of suction jet nozzles 720. Accordingly, fluid can flow through the bottom mode outlet port 658 of the top/bottom mode valve assembly 510, into the bottom mode inlet port 716, through the bottom mode inner chamber 722, and out through the plurality of suction jet nozzles 720. The suction jet nozzles 720 function in accordance with the suction jet nozzles 104 discussed in connection with FIGS. 1-44. Accordingly, the suction jet nozzles 720 spray pressurized water when water is provided to them by way of the bottom mode inner chamber 722. The suction jet nozzles 720 discharge pressurized water upward through the suction tube 102 toward the debris opening 58, forcing any loose debris through the suction aperture 100, across the suction tube 102, out the debris opening 58, and into the debris bag 54 (see FIG. 4). Furthermore, the jetting of water upward through the suction tube 102 causes a venturi-like suction effect causing the suction head 98 to loosen debris from the pool walls 14 and direct the loosened debris into the suction aperture 100. This debris is forced through the suction tube 102 by the suction jet nozzles 720.

Operation of the cleaner 10 utilizing the drive assembly 500 (discussed above in connection with FIGS. 52-78) is summarized as follows. In operation, the pump 18 provides pressurized water through the segmented hose 22, any connected swivels 24, filters 26, and floats 28, and to the cleaner 10. The segmented hose 22 is connected to the inlet port external nozzle 84. The barb 88 facilitates attachment of the segmented hose 22 to the inlet port external nozzle 84. Additionally, the nut 92 can be utilized to secure the segmented hose 22 to the inlet port external nozzle 84. In such embodiments, the nut 92 bites into the soft material of the segmented hose 22 to restrain the hose 22. The pressurized water flows through the inlet port 78 of the cleaner 10 and out through the inlet port external nozzle 86, where it flows through the hose 503*a* and to the inlet body inlet nozzle 530. The pressurized water flows into the inlet body 516. When in the inlet body 516, the water diverges into two flows. A first flow flows to the outlet nozzle 538 and a second flow flows toward the reverse/spin-out mode valve assembly 508.

The first flow flows out of the outlet nozzle 538, through the hose 547 and to the turbine housing inlet 542. The first flow enters the turbine housing 518 through the inlet 542, and places a force on the turbine blades 550. This force causes the turbine 546 to rotate about the first shaft 558. The first flow then exits the turbine housing 518 through the apertures 562. Rotation of the turbine 546 causes the output drive gear 554 to drive the first large gear 572 of the second gear stack 570*b*, which is in engagement of the first gear stack 570*a*, resulting in rotation of the plurality of large diameter gears 572 and small diameter gears 574. The first and second gear stacks 570*a*, 570*b* engage one another, with the final gear stack out 582 being rotated such that the small drive gear 584 thereof engages and rotates the output drive gear 586. Rotation of the output drive gear 586 causes rotation of the socket 590, and thus rotation of the cam plate 596 due to the mating relationship of the socket 590 and the shaped head 606 of the cam plate 596. As the cam plate 596 rotates, the reverse/spin-out seal post 634 rides within the cam track 618 to affect the position of the reverse/spin-out seal 624.

As discussed above, the reverse/spin-out seal 624 is configured to rotate about the stationary post 632 according to the position of the cam track post's 634 position in the cam track 618. When the cam track post 634 is positioned in the first radius portion of the cam track 618, e.g., the lesser radius portion, the reverse/spin-out seal 624 is positioned such that the sealing member 630 is adjacent the reverse/spin-out opening 640, thus sealing the reverse/spin-out chamber 638 and allowing fluid to flow through the forward chamber opening 646 and into the forward chamber 636. Conversely, when the cam track post 634 is positioned in the radially extended portion 620 of the cam track 618, the reverse/spin-out seal 624 is positioned such that the sealing member 630 is adjacent the forward chamber opening 646, thus sealing the forward chamber 636 and allowing fluid to flow through the reverse/spin-out opening 640 and into the reverse/spin-out chamber 638. Accordingly, the cam plate 596 determines what position the reverse/spin-out seal 624 is in, and rotates the seal between a forward position and a reverse/spin-out position. The length of time that the reverse/spin-out seal 624 stays in either position is determined by the length, e.g., circumferential length, of the radially extended portion 620. A greater length radially extended portion 620 results in a greater amount of time that the reverse/spin-out seal 624 will be positioned adjacent the forward chamber opening 646. Similarly, a lesser length radially extended portion 620 results in a lesser amount of time that the reverse/spin-out seal 624 will be positioned adjacent the forward chamber opening 646. If the radially extend portion 620 makes up one eighth ($1/8^{th}$) of the cam track 618 circumference, then the reverse/spin-out seal 624 will be positioned adjacent the forward chamber opening 646 one eighth ($1/8^{th}$) of the time. The circumferential length of the radially extended portion 620 can be determined based on a user's need, and a different cam plate 596 can be provided for different situations.

When the cam track post 634 is positioned in the radially extended portion 620 of the cam track 618, forcing the reverse/spin-out seal 624 to seal the forward chamber opening 646 and the forward chamber 636. When in such a position, water flows to the cleaner 10, through the inlet port 78, through the inlet tube 503*a*, into the inlet nozzle 530, into the inlet body internal chamber 534, into the reverse/spin-out chamber 638, out the reverse/spin-out chamber nozzle 642, through the reverse/spin-out tube 503*b*, and to the reverse/spin-out thrust jet nozzle 112 where it is discharged under pressure. Alternatively, when the cam track post 634 is not positioned in the radially extended portion 620 of the cam track 618, the reverse/spin-out seal 624 is adjacent the reverse/spin-out chamber opening 640, thus sealing the reverse/spin-out chamber 638. This allows water to enter the inlet body internal chamber 534 and flow into forward main chamber 636. From there, the water flows through the forward main chamber 636 and into the top/bottom mode valve assembly body 649.

Once in the top/bottom mode valve assembly body 649, the flow of the water is dictated by the position of the sealing plate 692. As discussed above, the sealing plate 692 can be positioned adjacent the bottom mode opening 654 to seal the bottom mode outlet chamber 656, or adjacent the top mode opening 660 to seal the top mode outlet chamber 662.

When the sealing plate 692 is positioned adjacent the bottom mode opening 654, the water flows through the top mode opening 660, through the top mode outlet chamber 662, out the top mode outlet port 664 of the top/bottom mode valve assembly 510, into the top mode manifold inlet port 698, through the top mode inner chamber 712, and out through the first and second top mode skimmer outlets 700, 704 and the top mode jet nozzle 710. The first and second top mode skimmer outlets 700, 704 are connected with the first and second skimmer tubes 503*e*, 503*d* (see FIGS. 53-54), which are each in turn connected to the skimmer/debris retention jets 60 (see FIGS. 7 and 53-54).

When the sealing plate 692 is positioned adjacent the top mode opening 660, the water flows through the bottom mode opening 654, across the bottom mode outlet chamber 656, and out the bottom mode outlet port 658 and the bottom mode nozzle 666 of the top/bottom mode valve assembly 510. The flow out from the bottom mode outlet port 658 flows into the bottom mode inlet port 716, through the bottom mode inner chamber 722, and out through the plurality of suction jet nozzles 720. The bottom mode nozzle 666 is connected with the bottom mode tube 503*c*, which is also connected with the forward thrust jet nozzle 82 where the water is discharged. Discharge of the water through the forward thrust jet nozzle 82 results in the cleaner 10 being driven forward.

Figure 79:
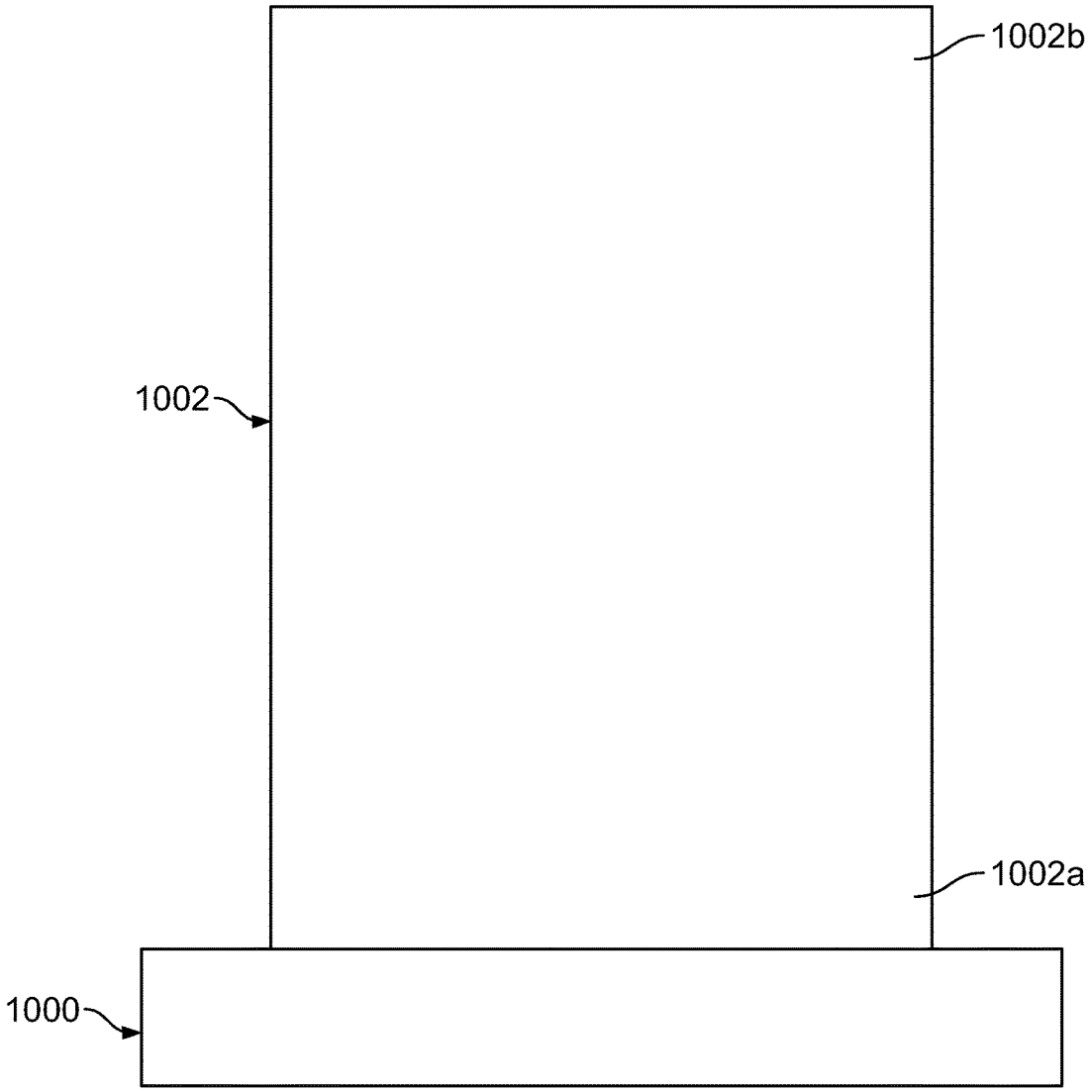
FIG. 79 is a side view of a jet nozzle assembly and vacuum suction tube of the present disclosure.
Figure 80:
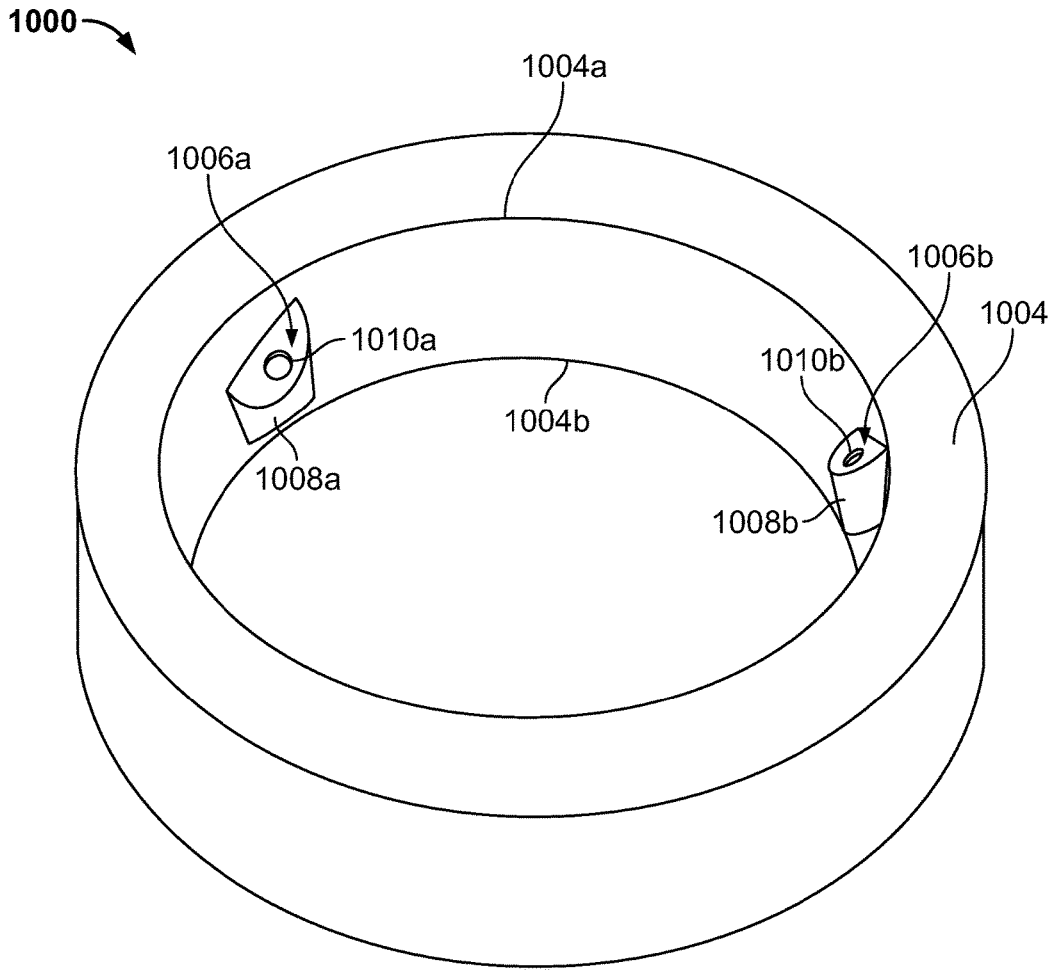
FIG. 80 is a perspective view of the jet nozzle assembly of FIG. 79.
Figure 81:
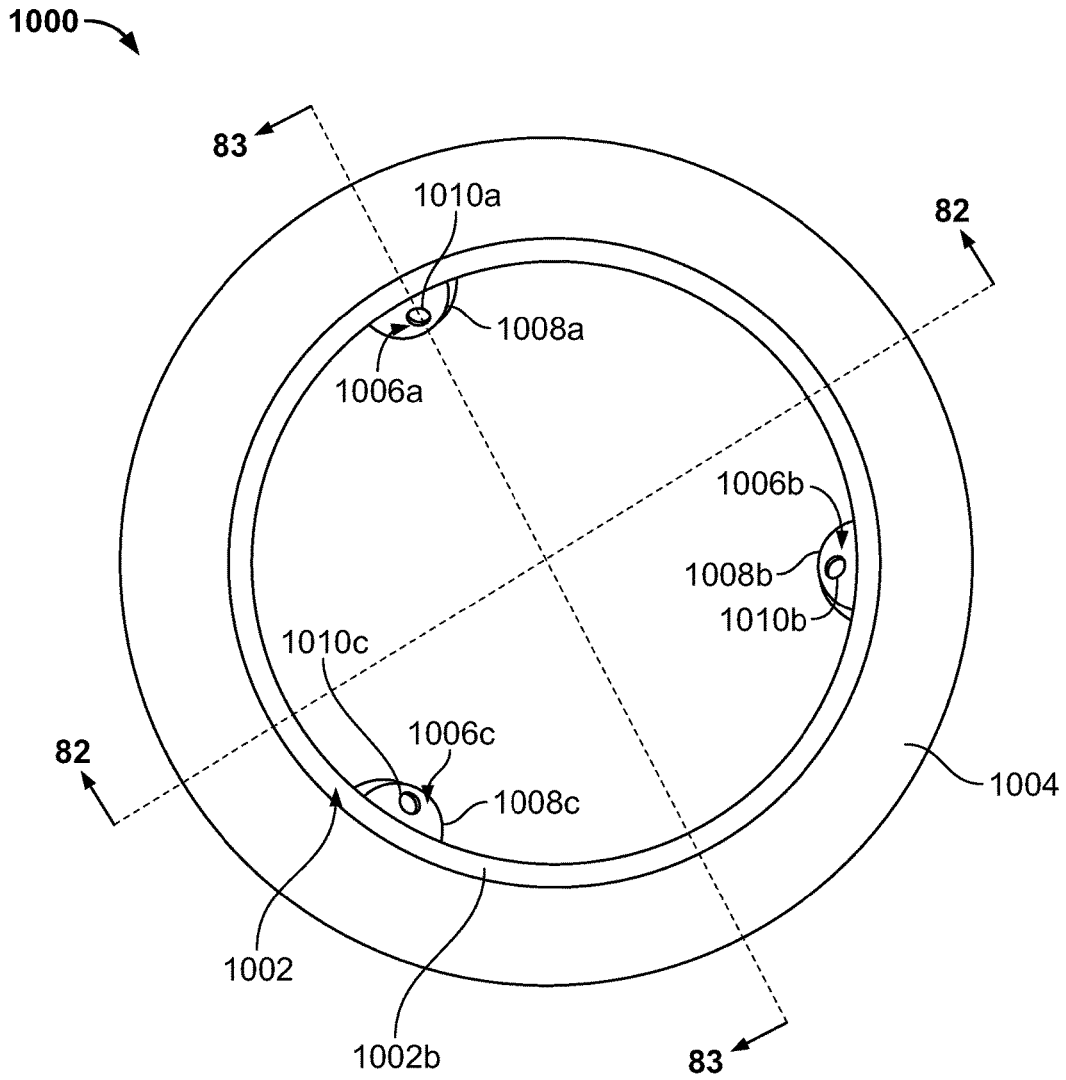
FIG. 81 is a top view of the jet nozzle assembly and vacuum suction tube of FIG. 79.

FIGS. 79-86 show a jet nozzle assembly 1000 and a vacuum suction tube 1002 of the present disclosure that can be utilized in a pressure or robotic pool cleaner such as the pool cleaner illustrated in FIGS. 1-44 and 52-78 and the accompanying disclosures thereof. FIG. 79 is a side view of the jet nozzle assembly 1000 and the vacuum suction tube 1002. The jet nozzle assembly 1000 is similar to the jet ring 132 described in connection with FIGS. 1-44, and the jet ring 514 described in connection with FIGS. 52-78. That is, the jet nozzle assembly 1000 can be used in place of the jet ring 132 and/or the jet ring 514. Similarly, the vacuum suction tube 1002 is similar to the suction tube 102 described in connection with FIGS. 1-44 and 52-78. The vacuum suction tube 1002 is a tubular component having a first open end 1002*a* and a second open end 1002*b*, and is positioned adjacent the jet nozzle assembly 1000. FIG. 80 is a perspective view of the jet nozzle assembly 1000 and FIG. 81 is a top view showing the jet nozzle assembly 1000 and the vacuum suction tube 1002. The jet nozzle assembly 1000 includes an annular body 1004 having a top opening 1004*a* and a bottom opening 1004*b*, and also includes first, second, and third jet nozzles 1006*a*, 1006*b*, 1006*c* positioned on an interior wall of the annular body 1004 (see FIG. 81 regarding the third jet nozzle 1006*c*). The jet nozzles 1006*a*, 1006*b*, 1006*c* each include a body 1008*a*, 1008*b*, 1008*c* and an outlet 1010*a*, 1010*b*, 1010*c*. The jet nozzles 1006*a*, 1006*b*, 1006*c* are positioned and arranged on the interior wall of the annular body 1004 such that water discharged therethrough is directed towards the top opening 1004*a* of the annular body 1004.

As shown in FIGS. 79 and 81, the vacuum suction tube 1002 is positioned with one of its ends, e.g., the first open end 1002*a*, adjacent the top opening 1004*a* of the jet nozzle assembly body 1004 such that the jet nozzles 1006*a*, 1006*b*, 1006*c* discharge water through the jet nozzle assembly body top opening 1004*a* and into the vacuum suction tube 1002. The discharged water exits the vacuum suction tube 1002 at the end opposite the jet nozzle assembly 1000, e.g., the second open end 1002*b*, which can be positioned adjacent an attached filter, filter bag, etc., which can be used to filter or trap any debris that is discharged through the vacuum suction tube 1002. Particularly, the jet nozzle assembly 1000 can be incorporated into a pressure or robotic pool cleaner such that the jet nozzle assembly body bottom opening 1004*b* is positioned at a bottom of the pool cleaner and open to the pool water, e.g., atmosphere. The pressurized discharge of water through the jet nozzles 1006*a*, 1006*b*, 1006*c* generates a venturi or suction effect at the bottom opening 1004*b* such that pool water is suctioned into the bottom opening 1004*b* from the pool and discharged through the vacuum suction tube 1002. This also results in any debris that may be on the pool floor or wall to also be suctioned through the vacuum suction tube 1002, and discharged therethrough and into an attached filter or filter bag.

Figure 82:
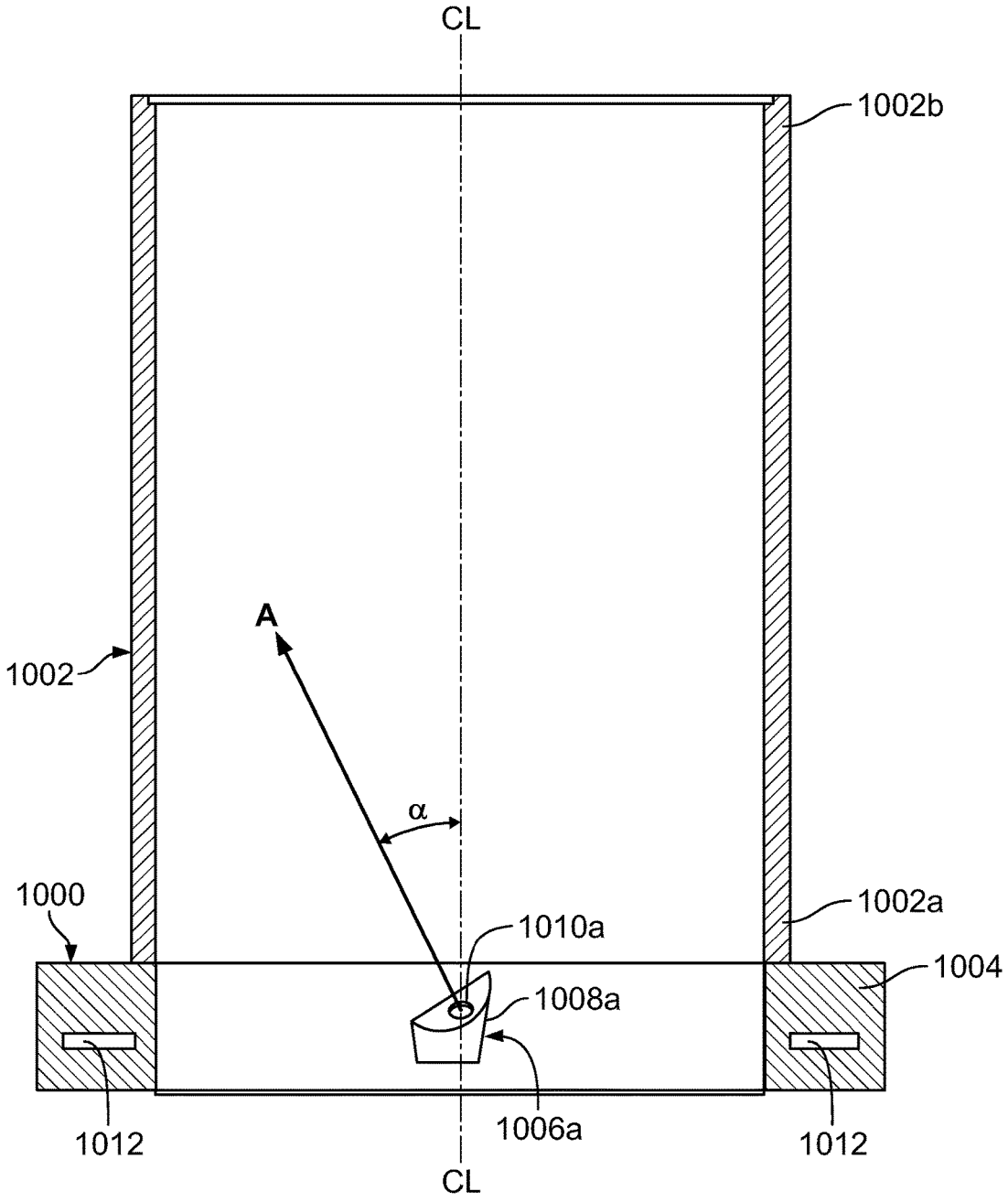
FIG. 82 is a cross-sectional view of the jet nozzle assembly and vacuum suction tube taken along line 82-82 of FIG. 81 showing the vortex angle of a jet nozzle.
Figure 83:
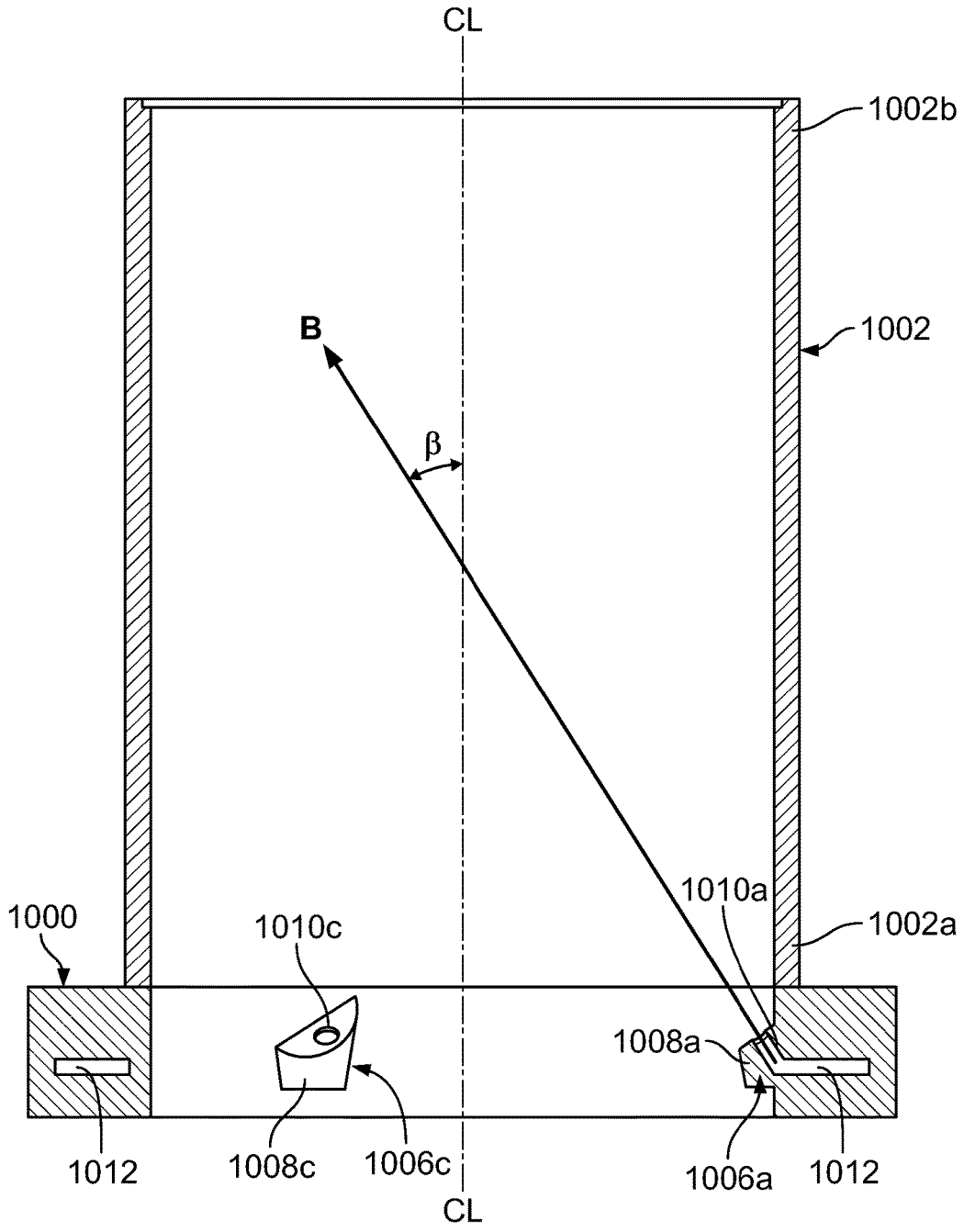
FIG. 83 is a cross-sectional view of the jet nozzle assembly and vacuum suction tube taken along line 83-83 of FIG. 81 showing the convergence angle of a jet nozzle.
Figure 84:
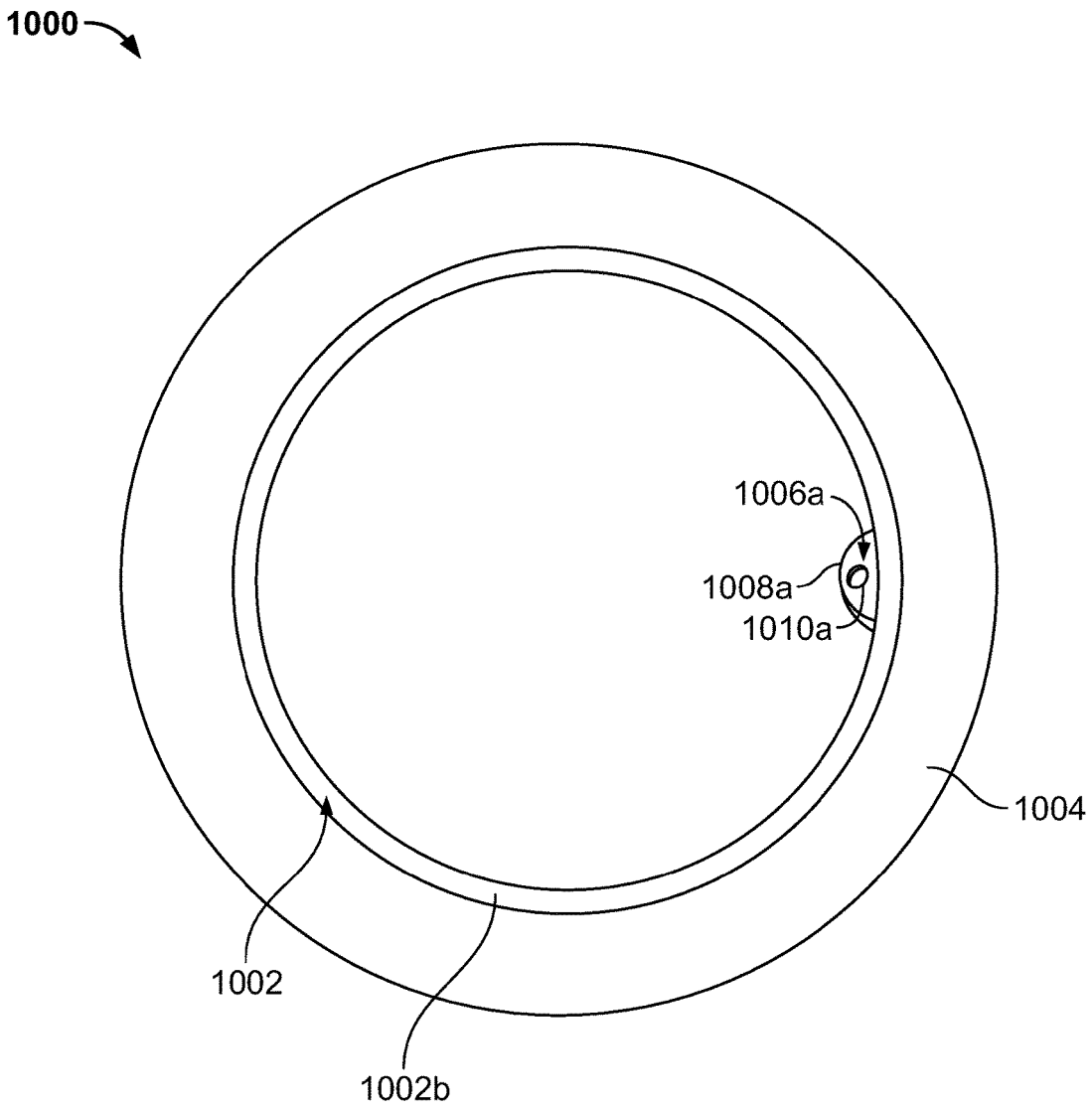
FIG. 84 is a top view of the jet nozzle assembly and vacuum suction tube with the jet nozzle assembly having one jet nozzle.
Figure 85:
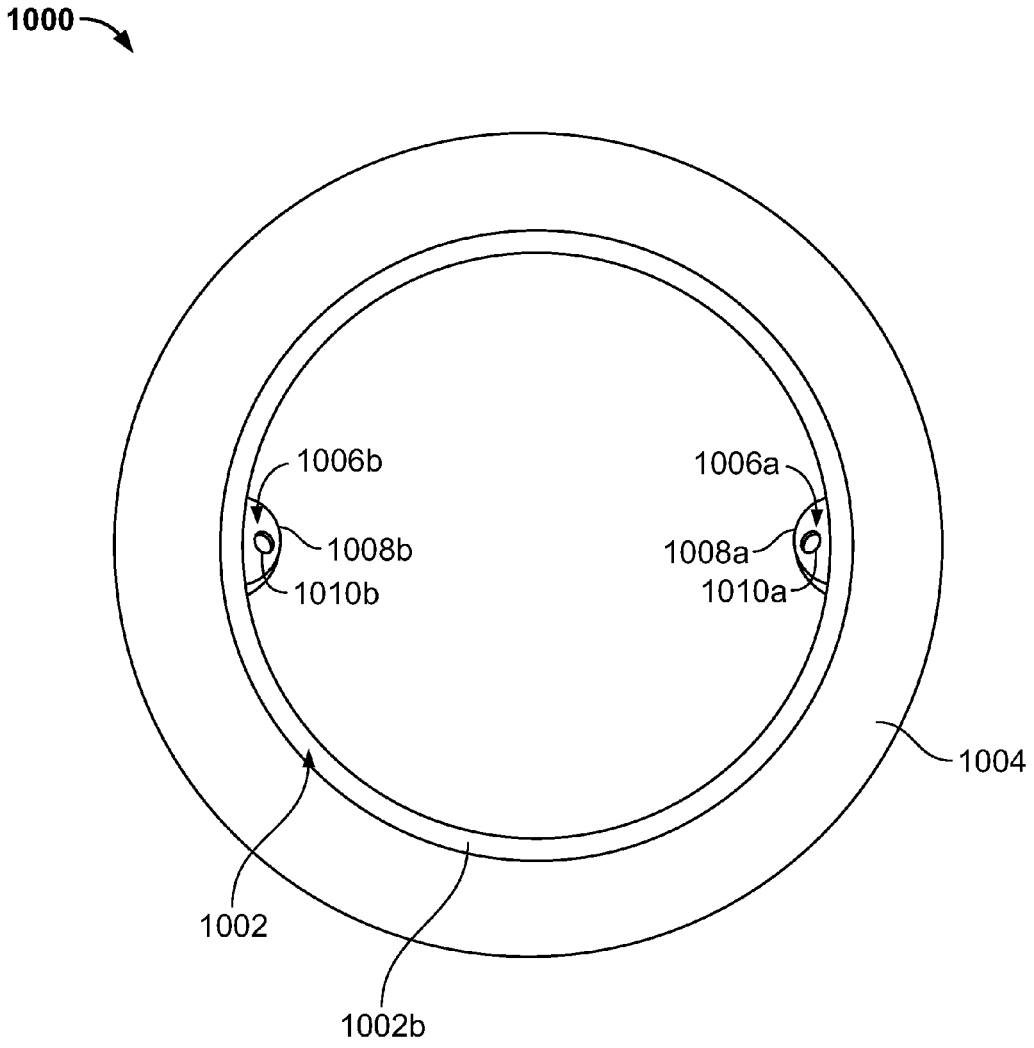
FIG. 85 is a top view of the jet nozzle assembly and vacuum suction tube with the jet nozzle assembly having two jet nozzles.
Figure 86:
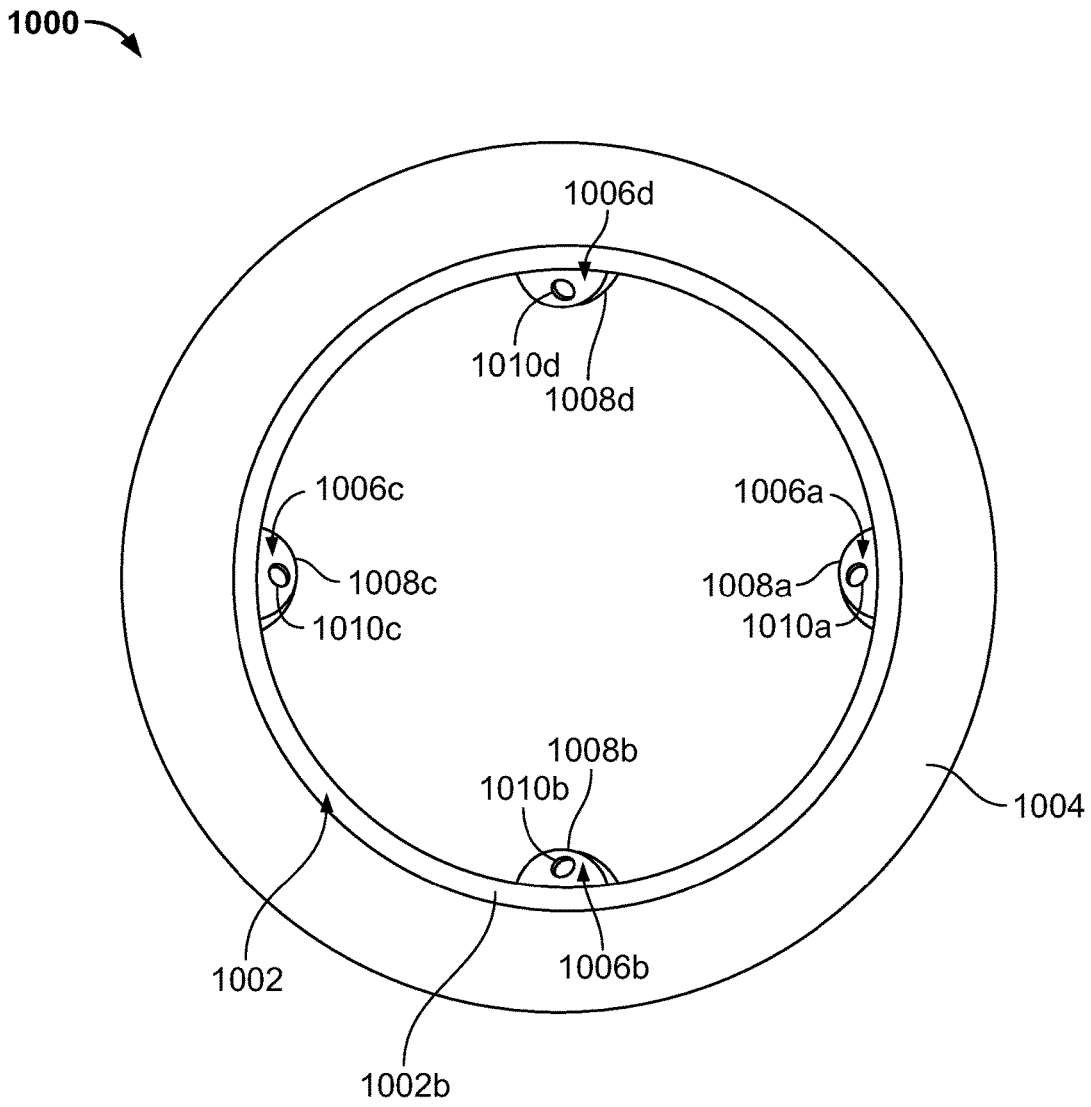
FIG. 86 is a top view of the jet nozzle assembly and vacuum suction tube with the jet nozzle assembly having four jet nozzles.

FIG. 82 is a cross-section view of the jet nozzle assembly 1000 and vacuum suction tube 1002 taken along line 82-82 of FIG. 81. FIG. 83 is a cross-section view of the jet nozzle assembly 1000 and vacuum suction tube 1002 taken along line 83-83 of FIG. 81. As can be seen in FIGS. 82 and 83, the jet nozzle assembly body 1004 includes an internal channel 1012 that is in fluidic communication with each of the jet nozzles 1006*a*, 1006*b*, 1006*c*. As illustrated in FIG. 83, the outlets 1010*a*, 1010*b*, 1010*c* of the jet nozzles 1006*a*, 1006*b*, 1006*c* are in fluidic communication with the internal channel 1012 such that pressurized fluid flowing through the internal channel 1012 can be discharged through each of the jet nozzles 1006*a*, 1006*b*, 1006*c* through the respective outlet 1010*a*, 1010*b*, 1010*c*. The internal channel 1012 is also in fluidic communication with a source of pressurized fluid, such as a pump that can be internal to the pool cleaner (e.g., for a robotic pool cleaner) or a pump that is external to the pool and provides positive pressure to the pool leaner (e.g., for a positive-pressure pool cleaner). Accordingly, pressurized fluid is provided from a source of pressurized fluid to the internal channel 1012, where it travels along the internal channel 1012 and is discharged through each of the jet nozzles 1006*a*, 1006*b*, 1006*c*.

Configuration of the nozzles 1006*a*, 1006*b*, 1006*c* will now be discussed in greater detail. It is noted that the nozzles 1006*a*, 1006*b*, 1006*c* are constructed and configured the same, and simply spaced apart from one another. Accordingly, reference hereinafter may be made with respect to a single nozzle and it should be understood that these statements hold true for the remaining nozzles. Each of the nozzles 1006*a*, 1006*b*, 1006*c* is configured to discharge fluid at a vortex angle $\alpha$ (see FIG. 82) and a convergence angle $\beta$ (see FIG. 83). As shown in FIG. 82, the nozzle 1006*a* discharges fluid in the direction of arrow A, which is at an angle $\alpha$ (e.g., vortex angle) in a first plane with respect to the centerline CL of the vacuum suction tube 1002 when the centerline CL is aligned with the nozzle outlet 1010*a*. Essentially, this means that the direction of water discharged from the nozzle 1006*a* is not in alignment with the direction of water flow across the vacuum suction tube 1002, e.g., along the centerline CL of the vacuum suction tube 1002 from the first open end 1002*a* to the second open end 1002*b*, but instead the water is discharged to flow in a helical path about the centerline CL and not in a straight line. This arrangement creates a vortex flow through the vacuum suction tube 1002. As mentioned previously, this holds true for the remaining nozzles 1006*b*, 1006*c*. Additionally, as shown in FIG. 83, the fluid discharged by the nozzle 1006*a* is also discharged in the direction of arrow B, which is at an angle $\beta$ (e.g., convergence angle) in a second plane with respect to the centerline CL of the vacuum suction tube 1002 when the centerline CL is not aligned with the nozzle outlet 1010*a*. Essentially, this means that the water discharged from the nozzle 1006*a* is directed toward the centerline CL, and not parallel to the centerline CL. As mentioned previously, this holds true for the remaining nozzles 1006*b*, 1006*c*. Thus, the water being discharged by all of the nozzles 1006*a*, 1006*b*, 1006*c* converges at the centerline CL. This arrangement creates a convergent flow through the vacuum suction tube 1002. Accordingly, the water discharged through the nozzles 1006*a*, 1006*b*, 1006*c* flow in helical paths that converge with one another. By angling the nozzles 1006*a*, 1006*b*, 1006*c* at a vortex angle $\alpha$ and/or a convergence angle $\beta$, the volumetric flow of water being suctioned into the jet nozzle assembly 1000 and through the vacuum suction tube 1002 is increased, creating a more efficient machine as no additional energy needs to be introduced in order to effect this increased volumetric flow rate. Additionally, the flow characteristics through the vacuum suction tube 1002 is smoothed, thereby providing a more uniform distribution of water flow.

It should be understood that it is not necessary to utilize both a vortex angle and a convergence angle at the same time; instead, each of a vortex angle and a convergence angle can be implemented absent the other, or can be utilized together. It should also be understood that the jet nozzle assembly 1000 can be provided with more or less than three nozzles as illustrated, e.g., the jet nozzle assembly 1000 can have one nozzle (see FIG. 84), two nozzles (see FIG. 85), four nozzles (see FIG. 86), etc.

Table 1 below shows simulated testing results illustrating how volumetric flow rate is affected by various configurations of the number of nozzles, vacuum tube diameter, nozzle convergence angle β, nozzle vortex angle α, nozzle diameter, and flow per nozzle. The column "Volume Flow Rate 1" indicates the volumetric flow rate at a point prior to the nozzles, e.g., upstream of the nozzles, and thus represents that volumetric flow rate of fluid that is being suctioned into the jet nozzle assembly. The column "Volume Flow Rate 2" indicates the volumetric flow rate at a point that is at the top of the tube, e.g., downstream of the nozzles, and thus represents that volumetric flow rate of fluid that is being discharged through the vacuum tube. As can be seen from Table 1, when the number of nozzles, vacuum tube diameter, nozzle outlet diameter, and flow per nozzle are kept constant, the greatest increase in flow rate results from a nozzle convergence angle β of 30° and a nozzle vortex angle α of 30°. In this configuration, a volumetric flow rate of 26.255 gallons per minute through the vacuum tube is achieved while only discharging 1.02 gallons per minute through each nozzle.

TABLE 1

Convergence and Vortex Angle Analysis

| Number of nozzles | Vacuum Tube diameter (in.) | Nozzle Convergence Angle β (°) | Nozzle Vortex Angle α (°) | Nozzle outlet diameter (in.) | Flow per nozzle (gallons per minute) | Volume Flow Rate 1 (gallons per minute) | Volume Flow Rate 2 (gallons per minute) |
|---|---|---|---|---|---|---|---|
| 3 | 2.5 | 30 | 0 | 0.095 | 1.02 | 19.1014231 | 22.1614116 |
| 3 | 2.5 | 20 | 20 | 0.095 | 1.02 | 17.1452074 | 20.2051716 |
| 3 | 2.5 | 20 | 30 | 0.095 | 1.02 | 19.4976677 | 22.5576560 |
| 3 | 2.5 | 30 | 30 | 0.095 | 1.02 | 23.1946716 | 26.2546880 |
| 3 | 3.125 × 2.00 ellipse | 30 | 30 | 0.095 | 1.02 | 22.8158551 | 25.8758734 |
| 3 grouped | 2.000 | 0 | 0 | 0.110 | 1.33 | 3.94641192 | 7.93642269 |
| 3 | 2.750 | 0 | 0 | 0.110 | 1.33 | 19.1217895 | 21.7818559 |

Table 2 below shows simulated testing results illustrating how volumetric flow rate is affected by various configurations of the number of nozzles, vacuum tube diameter, nozzle convergence angle β, nozzle diameter, and flow per nozzle. The column "Volume Flow Rate 1" indicates the volumetric flow rate at a point prior to the nozzles, e.g., upstream of the nozzles, and thus represents that volumetric flow rate of fluid that is being suctioned into the jet nozzle assembly. The column "Volume Flow Rate 2" indicates the volumetric flow rate at a point that is at the top of the tube, e.g., downstream of the nozzles, and thus represents that volumetric flow rate of fluid that is being discharged through the vacuum tube. As can be seen from Table 2, when the number of nozzles, nozzle outlet diameter, and flow per nozzle are kept constant, the greatest increase in flow rate results from a nozzle convergence angle β of 30° and a vacuum tube diameter of 2.75". In this configuration, a volumetric flow rate of 23.242 gallons per minute through the vacuum tube is achieved while only discharging 1.02 gallons per minute through each nozzle.

TABLE 2

Convergence Angle Analysis

| Number of nozzles | Vacuum Tube diameter (in.) | Nozzle Convergence Angle β | Nozzle outlet diameter (in.) | Flow per nozzle (gallons per minute) | Volume Flow Rate 1 (gallons per minute) | Volume Flow Rate 2 (gallons per minute) |
|---|---|---|---|---|---|---|
| 3 | 2.000 | 0 | 0.095 | 1.02 | 11.9752825 | 15.0353494 |
| 3 | 2.375 | 0 | 0.095 | 1.02 | 9.59365171 | 12.6536792 |

TABLE 2-continued

Convergence Angle Analysis

| Number of nozzles | Vacuum Tube diameter (in.) | Nozzle Convergence Angle β | Nozzle outlet diameter (in.) | Flow per nozzle (gallons per minute) | Volume Flow Rate 1 (gallons per minute) | Volume Flow Rate 2 (gallons per minute) |
|---|---|---|---|---|---|---|
| 3 | 2.500 | 0 | 0.095 | 1.02 | 13.1455821 | 16.2056329 |
| 3 | 2.625 | 0 | 0.095 | 1.02 | 15.466108 | 18.5261497 |
| 3 | 2.750 | 0 | 0.095 | 1.02 | 14.3846266 | 17.4446835 |
| 3 | 2.000 | 30 | 0.095 | 1.02 | 18.8003332 | 21.8603464 |
| 3 | 2.375 | 30 | 0.095 | 1.02 | 16.9372863 | 19.9973027 |
| 3 | 2.500 | 30 | 0.095 | 1.02 | 17.5032121 | 20.5632155 |
| 3 | 2.625 | 30 | 0.095 | 1.02 | 17.767893 | 20.8279138 |
| 3 | 2.750 | 30 | 0.095 | 1.02 | 20.1816962 | 23.2416961 |
| 3 | 2.750 | 0 | 0.110" | 1.33 | 19.12178957 | 21.78185593 |
| 3 grouped | 2.000 | 0 | 0.110" | 1.33 | 3.946411925 | 7.936422691 |

Figure 87:
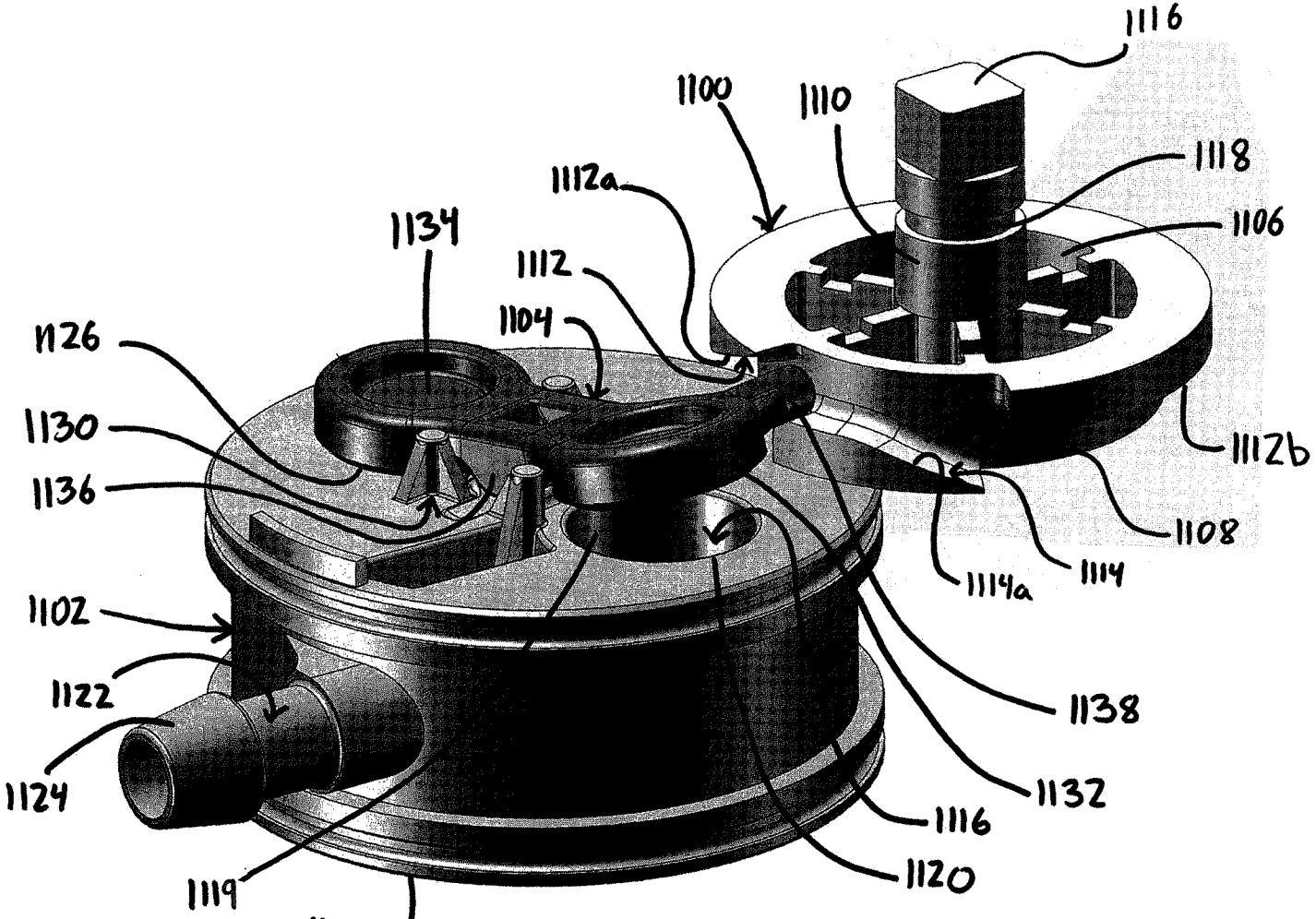
FIG. 87 is a perspective view of another reverse/spin-out mode cam and reverse/spin-out mode valve assembly of the present disclosure.

FIG. 87 is a perspective view of an alternative reverse/spin-out mode cam wheel 1100, reverse/spin-out mode valve assembly body 1102, and reverse/spin-out rocker seal 1104 of the present disclosure that can be utilized in the pressure cleaner 10 described previously. The reverse/spin-out mode cam wheel 1100, reverse/spin-out mode valve assembly body 1102, and reverse/spin-out rocker seal 1104 provide an alternative mode of switching the pressure cleaner 10 between reverse and spin-out modes. Particularly, the reverse/spin-out mode cam wheel 1100 can be utilized in place of the cam plate 596 of, for example, FIG. 69, the reverse/spin-out mode valve assembly body 1102 can be utilized in placed of the reverse/spin-out mode valve assembly 508 of, for example, FIG. 69, and the reverse/spin-out rocker seal 1104 can be utilized in place of the reverse/spinout seal 624 of, for example, FIG. 69.

Figure 65:
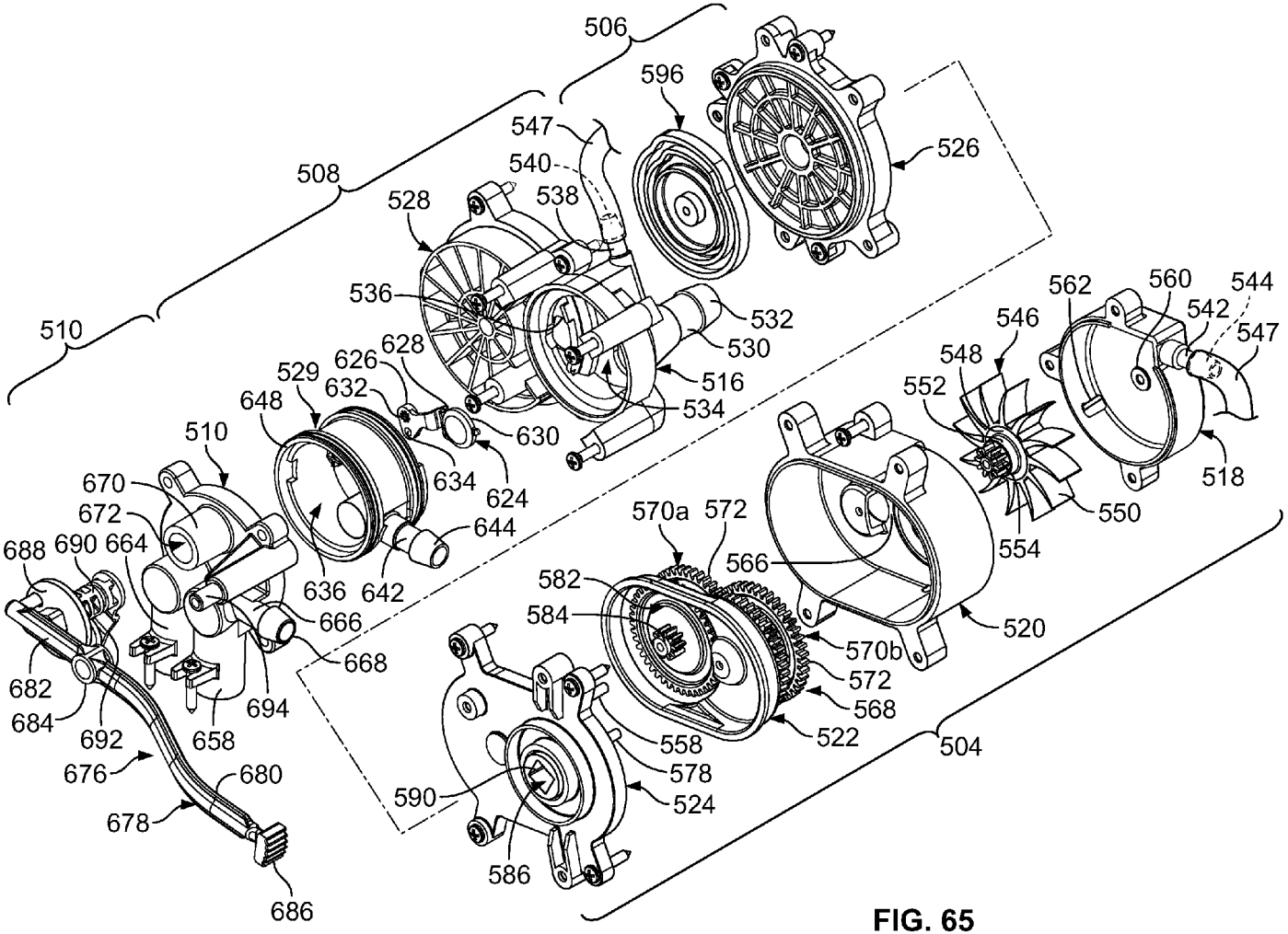
FIG. 65 is an exploded perspective view of the drive assembly of FIG. 52.

The reverse/spin-out mode cam wheel 1100 can be positioned between the cam upper housing 526 and the cam lower housing 528 of FIG. 65, in place of the cam plate 596. The reverse/spin-out mode cam wheel 1100 includes a body 1106, a radial wall 1108, a shaft 1110 extending from the body 1106, and first and second cam tracks 1112, 1114 extending radially from the radial wall 1108. The shaft 1110 extends from the center of the body 1106 and includes a shaped head 1116 at the end thereof, and a circumferential notch 1118. The circumferential notch 1118 can include an o-ring positioned therein. The shaft 1110 from the reverse/spin-out mode cam wheel 1100 and through the cam upper housing 526, where it engages the socket 590. The shaped head 1116 and the socket 590 have matching geometries such that rotation of the socket 590 will drivingly rotate the shaped head 1116, and thus the entirety of the reverse/spin-out mode cam wheel 1100. Accordingly, rotation of the reverse/spin-out mode cam wheel 1100 is achieved in the same fashion as that of the cam plate 596 described above in connection with FIGS. 52-75, which need not be repeated in its entirety. The first cam track 1112 extends radially from an upper portion of the radial wall 1108 of the reverse/spin-out mode cam wheel 1100 and along a portion of the circumference of the radial wall 1108, for example, along $\frac{7}{8}^{ths}$ of the radial wall 1108. The first cam track 1112 includes a cam ramp 1112*a* that levels out into a flat portion 1112*b*. The cam ramp 1112*a* extends from a top of the radial wall 1108 to the center of the radial wall 1108. The second cam track 1114 extends radially from a lower portion of the radial wall 1108 of the reverse/spin-out mode cam wheel 1100 and along a portion of the circumference of the radial wall 1108 where the first cam track 1112 is missing, for example, along $\frac{1}{8}^{th}$ of the radial wall 1108. The second cam track 1114 includes a cam ramp 1114*a*. The cam ramp 1114*a* extends from a bottom of the radial wall 1108 to the center of the radial wall 1108.

The reverse/spin-out mode valve assembly body 1102 is positioned adjacent the inlet body 516 and generally defines a forward chamber and a reverse/spin-out chamber 1116 separated from the forward chamber and defined by a chamber wall 1119. The reverse/spin-out mode valve assembly body 1102 includes a reverse/spin-out chamber opening 1120 and a reverse/spin-out chamber nozzle 1122 having a barbed end 1124. The reverse/spin-out chamber 1116 is in fluidic communication with the reverse/spin-out chamber opening 1120 and the reverse/spin-out chamber nozzle 1122, such that fluid can flow through the reverse/spin-out opening 1120, into the reverse/spin-out chamber 1116 and out the reverse/spin-out chamber nozzle 1122 without entering the forward chamber. The reverse/spin-out valve assembly body 1102 further includes a forward chamber opening 1126 and an open end 1128, such that the forward chamber opening 1126 and the open end 1128 are in fluidic communication. Accordingly, fluid flows into the forward chamber opening 1126, through the forward chamber, and out the open end 1128. The reverse/spin-out mode valve assembly body 1102 also includes a pivot assembly 1130 that secures the reverse/spin-out rocker seal 1104 to the reverse/spin-out mode valve assembly body 1102 and permits the reverse/spin-out rocker seal 1104 to pivot.

The reverse/spin-out rocker seal 1104 includes a first seal 1132, a second seal 1134, a pivot 1136 extending between the first and second seals 1132, 1134, and a cam post 1138 extending from the first seal 1132. The reverse/spin-out rocker seal 1104 is placed on top of the reverse/spin-out mode valve assembly body 1102 with the pivot 1136 being placed within the pivot assembly 1130, and with the first seal 1132 adjacent the reverse/spin-out opening 1120 and the second seal 1134 adjacent the forward chamber opening 1126. The first seal 1132 is configured to engage and seal the reverse/spin-out opening 1120, while the second seal 1134 is configured to engage and seal the forward chamber opening 1126. The reverse/spin-out rocker seal 1104 is configured so that only one of the first and second seals 1132, 1134 engages the respective reverse/spin-out opening 1120 and forward chamber opening 1126 at a time.

The reverse/spin-out mode cam wheel 1100, reverse/spin-out mode valve assembly body 1102, and reverse/spin-out rocker seal 1104 are arranged such that the cam post 1138 of the reverse/spin-out rocker seal 1104 extends to the reverse/spin-out mode cam wheel 1100 and can engage the first and second cam tracks 1112, 1114. As the reverse/spin-out mode cam wheel 1100 rotates counter-clockwise, the cam post 1138 alternates between engaging the first cam track 1112 and the second cam track 1114. More specifically, as the reverse/spin-out mode cam wheel 1100 rotates, e.g., is driven through rotation of the socket 590, the cam post 1138 will engage the cam ramp 1112*a* of the first cam track 1112 and ride therealong until it is at the bottom of the radial wall 1108 and kept in that position by the flat portion 1112*b* of the first cam track 1112. This results in the reverse/spin-out rocker seal 1104 being rotated about the pivot 1130 such that the reverse/spin-out mode rocker seal 1104 is placed in a first position. In the first position, the first seal 1132 engages the reverse/spin-out opening 1120, thus sealing the reverse/spin-out opening 1120 and preventing water from entering the reverse/spin-out chamber 1116, and the second seal 1134 disengages from the forward chamber opening 1126, thus allowing water to enter the forward chamber through the forward chamber opening 1126. Further, in the first position, the cleaner 10 is in a forward mode where water flows through the open end 1128 of the reverse/spin-out mode valve assembly body 1102 and to the top/bottom mode valve assembly 510, such as that illustrated in FIG. 69, whereby the fluid flow is utilized to propel the cleaner 10 in a forward direction. Continued rotation of the reverse/spin-out mode cam wheel 1100 results in the first cam track 1112 ending and the cam post 1138 engaging the second cam track 1114. Upon completion of the first cam track 1112, the cam post 1138 engages the cam ramp 1114*a* of the second cam track 1114, which the cam post 1138 rides along until it is at the top of the radial wall 1108. This results in the reverse/spin-out rocker seal 1104 being rotated about the pivot 1130 such that the reverse/spin-out mode rocker seal 1104 is placed in a second position. In the second position, the first seal 1132 disengages from the reverse/spin-out opening 1120, thus allowing water to enter the reverse/spin-out chamber 1116 through the reverse/spin-out opening 1120, and the second seal 1134 engages the forward chamber opening 1126, thus preventing water from entering the forward chamber through the forward chamber opening 1126. Further, in the second position, the cleaner 10 is in a reverse/spin-out mode where water flows through the reverse/spin-out chamber nozzle 1112 of the reverse/spin-out mode valve assembly body 1102 and to the reverse/spin-out thrust jet nozzle 112, such as that illustrated in FIG. 53, whereby the fluid flow is utilized to propel the cleaner 10 in a reverse/spin-out direction. Continued rotation of the reverse/spin-out mode cam wheel 1100 results in the second cam track 1114 ending and the cam post 1138 once again engaging the first cam track 1112. This rotation is continued ad infinitum.

One of ordinary skill in the art should understand that since the first cam track 1112 is longer than the second cam track 1114, the cleaner 10 will stay in forward mode for a longer period of time than the reverse/spin-out mode. Accordingly, the time that the cleaner 10 stays in each one of these modes can be altered by changing the length of the first and second cam tracks 1112, 1114.

Having thus described the invention in detail, it is to be understood that the foregoing description is not intended to limit the spirit or scope thereof. It will be understood that the embodiments of the present invention described herein are merely exemplary and that a person skilled in the art may make any variations and modification without departing from the spirit and scope of the invention. All such variations and modifications, including those discussed above, are intended to be included within the scope of the invention.

What is claimed is:

1. A fluid distribution system for an underwater pool cleaner, comprising:

an inlet body having an inlet for receiving a supply of pressurized fluid;

a valve assembly body in fluid communication with said inlet of said inlet body and including a plurality of fluid outlets, a first one of said outlets for providing fluid for propelling the underwater pool cleaner in a forward direction and a second one of said outlets for providing fluid for propelling the underwater pool cleaner in a reverse direction; and a valve subassembly including a turbine rotatably driven by the supply of pressurized fluid and a cam wheel including a first cam track and a second cam track, the cam wheel being operatively engaged with the turbine such that the cam wheel is rotatably driven by the turbine and periodically switching the supply of pressurized fluid from said first one of said outlets to said second one of said outlets to periodically change direction of propulsion of the underwater pool cleaner.

2. The fluid distribution system of claim 1, wherein the valve subassembly further comprises a rocker seal including a first sealing member, a second sealing member, and a cam post, the rocker seal being pivotally mounted adjacent the cam wheel and the valve assembly body with the cam post being engageable with the first and second cam tracks, and the rocker seal being pivotal between a first position and a second position, wherein (i) when the cam post is engaged with the first cam track the rocker seal is placed in the first position where the first sealing member prevents fluid from flowing through said second one of said outlets, and (ii) when the cam post is engaged with the second cam track the rocker seal is placed in the second position where the second sealing member prevents fluid from flowing through said first one of said outlets.

3. The fluid distribution system of claim 2, further comprising a gear reduction stack positioned between the turbine and the cam wheel, the gear reduction stack being engaged with the turbine and the cam wheel, wherein the gear reduction stack transfers a first number of rotations of the turbine into a second number of rotations of the cam wheel.

4. The fluid distribution system of claim 2, wherein the inlet body includes an outlet that provides pressurized fluid to rotationally drive the turbine.

5. The fluid distribution system of claim 2, wherein said first cam track has a first length and said second cam track has a second length, said first length being longer than said second length.

6. The fluid distribution system of claim 5, wherein the first cam track is associated with a first operation of the underwater pool cleaner and the second cam track is associated with a second operation of the underwater pool cleaner, the first length determining the amount of time that the first operation is to be operative and the second length determining the amount of time that the second operation is to be operative.

7. The fluid distribution system of claim 2, wherein the first and second cam tracks extend radially outward from the cam wheel and along a portion of a circumference thereof.

8. The fluid distribution system of claim 2, further comprising:

a second valve assembly body including an inlet, a first fluid outlet, and a second fluid outlet, and defining a valve chamber, wherein the inlet of said second valve body is positioned adjacent said first one of said outlets of said valve assembly body;

a valve seal including a sealing member, the valve seal positioned within the valve chamber of the second valve assembly body and being rotatable between a first position wherein the valve seal sealing member is adjacent the first fluid outlet of the second valve assembly body and a second position wherein the valve seal sealing member is adjacent the second fluid outlet of the second valve assembly body; and a rotatable lever arm engaged with the valve seal for rotating the valve seal about a rotational axis, wherein (i) when the valve seal is in the first position the valve seal prevents fluid from flowing through the first fluid outlet of the second valve assembly body, and (ii) when the valve seal is in the second position the valve seal prevents fluid from flowing through the second fluid outlet of the second valve assembly body.

9. The fluid distribution system of claim 8, wherein the fluid distribution system is connected with a water jet propulsion system of the underwater pool cleaner.

10. The fluid distribution system of claim 9, wherein the first fluid outlet of the second valve assembly body is in fluidic communication with a forward thrust jet nozzle of the underwater pool cleaner to propel the underwater pool cleaner in a first direction underwater, the second fluid outlet of the second valve assembly body is in fluidic communication with a top mode jet nozzle of the underwater pool cleaner to propel the underwater pool cleaner along a pool water surface, and said second one of said fluid outlets of the first valve assembly body is in fluidic communication with a reverse thrust jet nozzle of the underwater pool cleaner to propel the underwater pool cleaner in a second direction that is different than the first direction.

11. The fluid distribution system of claim 8, wherein the first outlet of the second valve assembly body is in fluidic communication with a suction system of the underwater pool cleaner.

12. The fluid distribution system of claim 1, wherein the inlet of the inlet body is in fluidic communication with a pump external to the underwater pool cleaner, the supply of pressurized fluid being provided by the pump.

13. The fluid distribution system of claim 1, wherein the fluid distribution system is connected with a water jet propulsion system of the underwater pool cleaner.

14. The fluid distribution system of claim 13, wherein said first one of said outlets is in fluidic communication with a forward thrust jet nozzle of the underwater pool cleaner to propel the underwater pool cleaner in a first direction, and said second one of said outlets is in fluidic communication with a reverse thrust jet nozzle of the underwater pool cleaner to propel the underwater pool cleaner in a second direction that is different than the first direction.

15. The fluid distribution system of claim 1, wherein said first one of said outlets is in fluidic communication with a suction system of the underwater pool cleaner.

16. An underwater pool cleaner comprising:

a housing having an inlet opening and an outlet opening;

a pressurized fluid inlet connected with a source of pressurized fluid;

a bottom mode forward thrust jet nozzle;

a reverse/spinout mode jet nozzle;

a suction tube extending between the inlet opening and the outlet opening;

a suction jet ring positioned within the suction tube and including one or more suction jet nozzles; and an automatic timing valve positioned in the housing and in fluidic communication with the bottom mode forward thrust jet nozzle, the top mode forward thrust jet nozzle, the reverse/spinout mode jet nozzle, and the suction jet ring, the automatic timing valve including:

a) an inlet body having an inlet in fluid communication with the pressurized fluid inlet for receiving a supply of pressurized fluid;

b) a valve assembly body in fluid communication with said inlet of said inlet body and including a plurality of fluid outlets, a first one of said outlets in fluid communication with the bottom mode forward thrust jet nozzle and the suction jet ring, said first one of said outlets for providing fluid for propelling the pool or spa cleaner in a forward direction, and a second one of said outlets in fluid communication with the reverse/spinout mode jet nozzle, said second one of said outlets for providing fluid for propelling the pool or spa cleaner in a reverse direction; and c) a valve subassembly including a turbine rotatably driven by the supply of pressurized fluid and a cam wheel including a first cam track and a second cam track, the cam wheel being operatively engaged with the turbine such that the cam wheel is rotatably driven by the turbine and periodically switching the supply of pressurized fluid from said first one of said outlets to said second one of said outlets to periodically change direction of propulsion of the underwater pool cleaner.

17. The underwater pool cleaner of claim 16, wherein the valve subassembly further comprises a rocker seal including a first sealing member, a second sealing member, and a cam post, the rocker seal being pivotally mounted adjacent the cam wheel and the valve assembly body with the cam post being engageable with the first and second cam tracks, and the rocker seal being pivotal between a first position and a second position, wherein (i) when the cam post is engaged with the first cam track the rocker seal is placed in the first position where the first sealing member prevents fluid from flowing through said second one of said outlets, and (ii) when the cam post is engaged with the second cam track the rocker seal is placed in the second position where the second sealing member prevents fluid from flowing through said first one of said outlets.

18. The underwater pool cleaner of claim 17, further comprising:

a top mode forward thrust jet nozzle;

one or more skimmer/debris retention jets;

a second valve assembly body including an inlet, a first fluid outlet in fluidic communication with the bottom mode forward thrust jet nozzle and for providing fluid to propel the underwater pool cleaner in a forward direction along the bottom of a pool, and a second fluid outlet in fluidic communication with the top mode forward thrust jet nozzle for providing fluid to propel the underwater pool cleaner along a pool water surface and the skimmer/debris retention jets for retaining debris, and defining a valve chamber, wherein the inlet of said second valve body is positioned adjacent said first one of said outlets of said valve assembly body;

a valve seal including a sealing member, the valve seal positioned within the valve chamber of the second valve assembly body and being rotatable between a first position wherein the valve seal sealing member is adjacent the first fluid outlet of the second valve assembly body and a second position wherein the valve seal sealing member is adjacent the second fluid outlet of the second valve assembly body; and a rotatable lever arm engaged with the valve seal for rotating the valve seal about a rotational axis, wherein (i) when the valve seal is in the first position the valve seal prevents fluid from flowing through the first fluid outlet of the second valve assembly body, and (ii) when the valve seal is in the second position the valve seal prevents fluid from flowing through the second fluid outlet of the second valve assembly body.

19. The pool cleaner of claim 17, further comprising a gear reduction stack positioned between the turbine and the cam wheel, the gear reduction stack being engaged with the turbine and the cam wheel, wherein the gear reduction stack transfers a first number of rotations of the turbine into a second number of rotations of the cam wheel.

20. The pool cleaner of claim 17, wherein the inlet body includes an outlet that provides pressurized fluid to rotationally drive the turbine.

21. The pool cleaner of claim 17, wherein said first section of said cam track has a first length and said second section of said cam track has a second length, said first length being longer than said second length.

22. The pool cleaner of claim 21, wherein the first section of said cam track is associated with a first operation of the pool cleaner and the second section of said cam track is associated with a second operation of the pool cleaner, the first length determining the amount of time that the pool cleaner is to be in the first operation and the second length determining the amount of time that the pool cleaner is to be in the second operation.

23. The pool cleaner of claim 16, further comprising one or more wheels mounted to the housing for facilitating locomotion of the pool cleaner along a pool bottom or pool wall.

24. The pool cleaner of claim 16, wherein the suction jet nozzles create a venturi effect in the suction tube to suction water and debris into the suction tube through the inlet opening.

* * * * *